US009181606B2

(12) United States Patent
Murray et al.

(10) Patent No.: US 9,181,606 B2
(45) **Date of Patent: *Nov. 10, 2015**

(54) LOW LEAD ALLOY

(75) Inventors: Michael Murray, Franklin Park, IL (US); Mahi Sahoo, Ottawa (CA)

(73) Assignee: Sloan Valve Company, Franklin Park, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/464,631

(22) Filed: May 4, 2012

(65) Prior Publication Data

US 2012/0237393 A1 Sep. 20, 2012

Related U.S. Application Data

(63) Continuation-in-part of application No. 13/317,785, filed on Oct. 28, 2011.

(60) Provisional application No. 61/482,893, filed on May 5, 2011, provisional application No. 61/408,518, filed on Oct. 29, 2010, provisional application No. 61/410,752, filed on Nov. 5, 2010, provisional application No. 61/451,476, filed on Mar. 10, 2011.

(51) Int. Cl.

| | |
|---|---|
| ***C22B 15/00*** | (2006.01) |
| ***C22B 4/06*** | (2006.01) |
| ***C22C 9/04*** | (2006.01) |
| ***C22C 1/02*** | (2006.01) |
| ***C22F 1/08*** | (2006.01) |

(Continued)

(52) U.S. Cl.

CPC ... *C22C 1/02* (2013.01); *C22C 1/03* (2013.01); *C22C 9/00* (2013.01); *C22C 9/04* (2013.01); *C22F 1/08* (2013.01)

(58) Field of Classification Search

USPC ..... 148/433, 434; 420/476

IPC ..... B22D 7/00; C22C 9/02,9/04, 1/02, C22C 1/03, 9/00; A45F 3/047, 3/06; C22F 1/08

See application file for complete search history.

(56) References Cited

U.S. PATENT DOCUMENTS

| | | | | |
|---|---|---|---|---|
| 3,816,187 | A * | 6/1974 | Smith et al. | 148/681 |
| 4,612,164 | A | 9/1986 | Ramsey et al. | |

(Continued)

FOREIGN PATENT DOCUMENTS

| | | |
|---|---|---|
| CA | 2 603 811 | 3/2007 |
| CN | 1688732 | 10/2005 |

(Continued)

OTHER PUBLICATIONS

Copper & Brass Alloy composition, Application Datasheet, Copper Alloy No. C84020,http://www.eosmetals.com/resources, Mar. 6, 2014.*

"Distributed sulfide, Lead-free copper alloy castings, Light Liquat", BIWALITE, http://tanslategoogleusecontent.com/translate_c?hl=en&sl-ja&u-http://www.shiga-vl.jp, 3 pages, 2010.

(Continued)

*Primary Examiner* — Sikyin Ip

(74) *Attorney, Agent, or Firm* — Foley & Lardner LLP

(57) ABSTRACT

A composition for a low lead ingot containing primarily copper and including tin, zinc, sulfur, phosphorus, nickel. The composition may contain carbon. The low lead ingot, when solidified, includes sulfur or sulfur containing compounds such as sulfides distributed through the ingot. The presence and a substantially uniform distribution of these sulfur compounds imparts improved machinability and better mechanical properties.

1 Claim, 45 Drawing Sheets

(51) Int. Cl.

| | |
|---|---|
| ***C22C 1/03*** | (2006.01) |
| ***C22C 9/00*** | (2006.01) |

(56) References Cited

U.S. PATENT DOCUMENTS

| | | | |
|---|---|---|---|
| 4,734,254 | A | 3/1988 | Nippert |
| 5,137,685 | A | 8/1992 | McDevitt et al. |
| 5,346,668 | A | 9/1994 | Tanaka et al. |
| 5,409,552 | A | 4/1995 | McDevitt et al. |
| 5,653,827 | A | 8/1997 | Kramer et al. |
| 6,136,104 | A | 10/2000 | Miyafuji et al. |
| 6,413,330 | B1 | 7/2002 | Oishi |
| 6,419,766 | B1 | 7/2002 | Ikemiya et al. |
| 6,458,222 | B1 | 10/2002 | Matsubara et al. |
| 6,464,810 | B1 | 10/2002 | Nakamura et al. |
| 6,471,792 | B1 | 10/2002 | Breedis et al. |
| 6,695,934 | B1 | 2/2004 | Bhargava |
| 6,942,742 | B2 | 9/2005 | Yamagishi |
| 7,297,215 | B2 | 11/2007 | Kurose et al. |
| 7,351,372 | B2 | 4/2008 | Inohana et al. |
| 7,628,872 | B2 | 12/2009 | Zhang et al. |
| 7,806,996 | B2 | 10/2010 | Kurose et al. |
| 8,063,471 | B2 | 11/2011 | Aruga et al. |
| 2003/0047259 | A1 | 3/2003 | Miyafuji |
| 2004/0159375 | A1 | 8/2004 | Yamagishi |
| 2004/0241038 | A1 | 12/2004 | Hofmann et al. |
| 2006/0065336 | A1 | 3/2006 | Gillieron et al. |
| 2006/0289094 | A1 | 12/2006 | Zhang et al. |
| 2007/0062615 | A1 | 3/2007 | Oishi |
| 2007/0243096 | A1 | 10/2007 | Kurose et al. |
| 2008/0286142 | A1 | 11/2008 | Yamamoto et al. |
| 2009/0220375 | A1 | 9/2009 | Ozasa et al. |
| 2011/0027612 | A1 | 2/2011 | Funaki et al. |
| 2011/0064602 | A1 | 3/2011 | Lo et al. |
| 2012/0082588 | A1 | 4/2012 | Kobayashi et al. |
| 2012/0121455 | A1 | 5/2012 | Murray et al. |
| 2013/0294965 | A1 | 11/2013 | Sahoo et al. |

FOREIGN PATENT DOCUMENTS

| | | | |
|---|---|---|---|
| CN | 1961089 | | 5/2007 |
| CN | 101619404 | A | 1/2010 |
| JP | 05-033087 | | 2/1993 |
| JP | 05-279772 | A | 10/1993 |
| JP | 08-283889 | | 10/1996 |
| JP | 2000-336442 | A | 12/2000 |
| JP | 2002-088427 | | 3/2002 |
| JP | 3370789 | B2 | 1/2003 |
| JP | 2006-152373 | | 6/2006 |
| JP | 3957308 | B | 8/2007 |
| JP | 2007-297675 | | 11/2007 |
| JP | 2007-297675 | A | 11/2007 |
| JP | 2008-088499 | | 4/2008 |
| JP | 2009-126918 | | 6/2009 |
| JP | 2009-132986 | A | 6/2009 |
| JP | 2010-031347 | A | 2/2010 |
| JP | 2010-150649 | A | 7/2010 |
| JP | 2010-275573 | | 12/2010 |
| JP | 2010-275573 | A | 12/2010 |
| KR | 10-1995-0032668 | A | 12/1995 |
| KR | 10-2005-0057293 | A | 6/2005 |
| KR | 10-2007-0119039 | A | 12/2007 |
| WO | WO92/15718 | | 9/1992 |
| WO | WO-2007/126006 | A1 | 11/2007 |
| WO | WO-2009/136457 | | 11/2009 |
| WO | WO2013-166454 | | 11/2013 |

OTHER PUBLICATIONS

Abe et al., "Castability and Cutting Conditions of Sulfide Dispersed Lead Free Bronze Castings", Journal of Japan Foundry Engineering, vol. 81, No. 12, pp. 661-666, Dec. 2009, Japan Foundry Engineering Society, Japan.

Kobayashi et al., "Structure Control and Characteristics of Solidification on Sulfide Dispersed Lead-Free Bronze Castings", Journal of Japan Foundry Engineering, vol. 81, No. 12, pp. 650-660, Dec. 2009, Japan Foundry Engineering Society.

Lead-Free Bronze Products—BIWALITE, Joetsu Bronzi Corporation, http://www.jcp.joemate.co.jp/english/biwalite, html, Jul. 16, 2010, 4 pages.

Maruyama et al., "Preparation and Properties of Lead Free Copper Alloy Castings with Dispersed Sulfide Particles", Proceedings of EMC 2007, Submitted just title.

Maruyama et al., "Some Properties of Sulfide Dispersed Lead Free Copper Alloy Castings", AFS Transactions, 2008, pp. 299-307, (2009), American Foundry Society.

Sueyoshi et al, "Mechanical Properties of Copper Sulfide-Dispersed Lead-Free Bronze", Materials Transactions, (2009), vol. 50, No. 4, pp. 776-781, Japan Institute of Metals, Japan.

Sueyoshi et al., "Life Cycle Assessment of Copper Sulfide-Dispersed Lead-Free Bronze", Journal of Japan Research Institute for Advanced Copper-Base Materials and Technologies, vol. 48, No. 1, p. 285, (2009, Japan Copper and Brass Research Association, Japan.

Wakai et al., "Effect of Zn Contents on Properties of Sulfide Dispersed Lead Free Copper Alloy Castings" Proceedings of EMC 2007, Submitted just title.

PCT International Preliminary Report on Patentability, PCT Application No. PCT/US2011/058448, dated Nov. 12, 2012, 3 pages.

PCT International Search Report, PCT Application No. PCT/US2011/058448, dated Apr. 17, 2012, 2 pages.

"Need a Lead Free Copper Alloy Casting? BIWALTE is the BEST. Great Performance for casting, Great for the world environment;" 2010; 4 pages.

Maruyama et al., "Sulfide Dispersed Lead Free Copper Alloy Castings", Kansai University, 3-3-35 Yamate-cho, Suita Japan, Jun. 1, 2009; 9 pages.

In re Application of: Michael Murray et al., U.S. Appl. No. 13/317,785, "Third Party Submission Under 37 CFR 1.99", Jul. 12, 2012, 38 pages.

Davies, D. D., "A Note on the Dezincification of Brass and the Inhibiting Effect of Elemental Additions," Copper development Association, Inc. New York, New York, Jul. 1993.

Maruyama, T. et al. "Lead Free Bronze Castings with Sulfide Dispersing for Water Supply Products," PowerPoint Presentation given at WFO Technical Forum at GIFA, Jul. 1, 2011.

"Recommendation on the Non-Use of Business for Lead Substitution," European Copper Institute, Sep. 2007, 2 pages.

"Lead Free Brass Ingot for Low-Pressure Die Casings and Gravity Die Castings," Joetsu Bronzi Corporation, http://www.jcp.joemate.co.jp/English/seihin8_11.HTML, Mar. 29, 2010.

"Lead Free Bronze Products Biwalite," Joetsu Bronzi Corporation, http://www.jcp.joemate.co.jp/English/seihin8_11.HTML, Mar. 29, 2010.

"Kurika Bronze," Joetsu Bronzi Corporation, http://www.jcp.joemate.co.jp/English/kurika.html, Mar. 29, 2010.

International Search Report and Written Opinion for PCT Application No. PCT/US 2013/039567, issued Aug. 26, 2013,13 pages.

Notice of Reasons for Rejection for Japanese Application No. 2013-536894, dated Apr. 4, 2014, 13 pages.

Japanese Office Action for Appl. No. 2013-536894, Mailed Feb. 2, 2015, 5 pages with English translation.

* cited by examiner

Figure 1

| Alloy Type | Cu | S | Sn | Pb | Zn | Fe | Sb | NI | P | Al | Si | Mn | Bi | Se |
|---|---|---|---|---|---|---|---|---|---|---|---|---|---|---|
| Biwalite™ - C83470 | 90.0-96.0 | 0.20-0.60 | 3.0-5.0 | 0.09 | 1.0-3.0 | 0.50 | 0.20 | 0.1-1.0 | 0.05 | 0.01 | 0.01 | - | - | - |
| **Bismuth Brass** | | | | | | | | | | | | | | |
| SeBiLOY™ - C89520 | 85-87 | 0.08 | 5.0-6.0 | 0.25 | 4.0-6.0 | 0.20 | 0.25 | 1.0 | - | 0.005 | - | - | 1.6-2.2 | 0.8-1.1 |
| C89836 | 87.0-91.0 | 0.08 | 4.0-7.0 | 0.25 | 2.0-4.0 | 0.35 | 0.25 | 0.90 | 0.06 | 0.005 | 0.005 | - | 1.5-3.5 | - |
| C89833 | 86.0-91.0 | 0.08 | 4.0-6.0 | .09 | 2.0-6.0 | 0.30 | 0.25 | 1.0 | 0.500 | 0.005 | 0.005 | - | 1.7-2.7 | 0 |
| **Silicon Brass** | | | | | | | | | | | | | | |
| C87500 | >79.0 | -- | -- | 0.09 | 12.0-16.0 | -- | - | - | - | 0.50 | 3.0-5.0 | - | - | - |
| Eco Brass™ - C87850 | 74.0-78.0 | -- | 0.30 | 0.09 | Rem. | 0.10 | - | 0.20 | - | - | 2.7-3.4 | 0.1 | - | - |
| **Leaded Semi-Red Brass** | | | | | | | | | | | | | | |
| C84400 | 78.0-82.0 | 0.08 | 2.3-3.5 | 6.0-8.0 | 7.0-10.0 | 0.40 | 0.25 | 1.0 | 0.02 | 0.005 | 0.005 | - | - | - |
| **Tin Bronze** | | | | | | | | | | | | | | |
| 90300 | 86-89 | 0.05 | 7.5-9 | 0.3 | 3-5 | 0.2 | 0.2 | 1.0 | 0.05 | 0.005 | 0.005 | - | - | - |

Figure 2

| | Cu | Sn | Pb | Zn | Fe | Sb | Ni | S | P | Al | Si | Mn | Zr | B | C | Ti |
|---|---|---|---|---|---|---|---|---|---|---|---|---|---|---|---|---|
| Lead-Free Semi-Red Brass - Sand Cast | | | | | | | | | | | | | | | | |
| C84000 | 82.0-89.0 | 2.0-4.0 | 0.09 | 5.0-14.0 | 0.4 | 0.02 | 0.5-2.0 | 0.01-0.65 | 0.05 | 0.005 | 0.005 | 0.20 | 0.20 | 0.20 | -- | -- |
| C84010 | 82.0-89.0 | 2.0-4.0 | 0.09 | 5.0-14.0 | 0.4 | 0.02 | 0.5-2.0 | 0.01-0.65 | 0.05 | 0.005 | 0.005 | 0.01-0.7 | 0.20 | 0.20 | -- | -- |
| C84020 | 82.0-89.0 | 2.0-4.0 | 0.09 | 5.0-14.0 | 0.4 | 0.02 | 0.5-2.0 | 0.01-0.65 | 0.05 | 0.005 | 0.005 | 0.20 | 0.20 | 0.20 | 0.1 | 0.30 |
| Lead-Free Tin Bronze - Sand Cast | | | | | | | | | | | | | | | | |
| C90400 | 86.0-89.0 | 7.5-8.5 | 0.09 | 1.0-5.0 | 0.4 | 0.02 | 1.0 | 0.01-0.65 | 0.05 | 0.005 | 0.005 | 0.2 | 0.20 | 0.20 | -- | -- |
| C90410 | 86.0-89.0 | 7.5-8.5 | 0.09 | 1.0-5.0 | 0.4 | 0.02 | 1.0 | 0.01-0.65 | 0.05 | 0.005 | 0.005 | 0.01-0.7 | 0.20 | 0.20 | -- | -- |
| C90420 | 86.0-89.0 | 7.5-8.5 | 0.09 | 1.0-5.0 | 0.4 | 0.02 | 1.0 | 0.01-0.65 | 0.05 | 0.010 | 0.010 | 0.2 | 0.20 | 0.20 | 0.1 | 0.30 |
| Lead-Free Yellow Brass - Permanent Mold Cast | | | | | | | | | | | | | | | | |
| C85900 | 58.0-62.0 | 1.5 | 0.09 | 31.0-41.0 | 0.50 | 0.20 | 1.5 | 0.01-0.65 | 0.01 | 0.1-0.6 | 0.25 | 0.20 | 0.20 | 0.20 | -- | -- |
| C85910 | 58.0-62.0 | 1.5 | 0.09 | 31.0-41.0 | 0.50 | 0.20 | 1.5 | 0.01-0.65 | 0.01 | 0.1-0.6 | 0.25 | 0.01-0.7 | 0.20 | 0.20 | -- | -- |
| C85920 | 58.0-62.0 | 1.5 | 0.09 | 31.0-41.0 | 0.50 | 0.20 | 1.5 | 0.01-0.65 | 0.01 | 0.1-0.6 | 0.25 | 0.2 | 0.20 | 0.20 | 0.01-0.5 | 0.30 |
| Lead-Free Yellow Brass Wrought | | | | | | | | | | | | | | | | |
| C28300 | 58.0-62.0 | -- | 0.09 | 31.0-41.0 | 0.35 | -- | -- | 0.01-0.65 | -- | -- | -- | 0.20 | 0.20 | 0.20 | -- | -- |
| C28310 | 58.0-62.0 | -- | 0.09 | 31.0-41.0 | 0.35 | -- | -- | 0.01-0.65 | -- | -- | -- | 0.01-0.7 | 0.20 | 0.20 | -- | -- |
| C28320 | 58.0-62.0 | -- | 0.09 | 31.0-41.0 | 0.35 | -- | -- | 0.01-0.65 | -- | -- | -- | 0.2 | 0.20 | 0.20 | 0.01-0.5 | 0.50 |

Figure 3

I-C C84020 Group

| Heat No | Cu | Sn | Zn | Ni | S | P | Mn | Pb | Fe | Sb | Al | Si | Zr | B | Ti | C |
|---|---|---|---|---|---|---|---|---|---|---|---|---|---|---|---|---|
| *Aim* | *82-89* | *2-4* | *5-14* | *0.5-2* | *.01-0.65* | *<0.05* | *<0.2* | *<0.09* | *<0.4* | *<0.02* | *<0.005* | *<0.005* | *<0.2* | *<0.2* | *<0.3* | *< 0.1* |
| 1104232 | 89.33 | 2.7 | 6.89 | 0.842 | 0.130 | 0.004 | 0.006 | .005 | 0.075 | 0.003 | 0.002 | 0.003 | | | | 0.006 |
| 1104262 | 86.63 | 2.75 | 9.31 | 0.979 | 0.137 | 0.013 | 0.018 | .028 | 0.115 | 0.003 | 0.002 | 0.003 | | | | 0.006 |
| 1104272 | 87.68 | 2.73 | 8.24 | 0.862 | 0.141 | 0.014 | 0.020 | .021 | 0.250 | 0.016 | 0.002 | 0.004 | | | | 0.009 |
| 1109363 | 87.00 | 3.10 | 8.61 | 0.952 | 0.087 | 0.012 | 0.024 | 0.017 | 0.183 | 0.003 | 0.001 | 0.003 | | | | 0.001 |
| 1109374 | 86.34 | 3.18 | 8.96 | 0.992 | 0.27 | 0.013 | 0.05 | 0.016 | 0.16 | 0.003 | 0.002 | 0.003 | | | | 0.001 |
| 1109385 | 87.10 | 3.0 | 8.51 | 0.941 | 0.18 | 0.011 | 0.026 | 0.027 | 0.187 | 0.002 | 0.002 | 0.003 | | | | 0.001 |
| H1-P1-7-ZR-C | 88.16 | 2.96 | 7.19 | 1.04 | 0.229 | 0.011 | 0.058 | 0.017 | 0.302 | 0.004 | 0.001 | 0.003 | 0.01 | | | 0.004 |
| H3-P3-7- | 89.07 | 3.71 | 5.38 | 1.12 | 0.274 | 0.011 | 0.088 | 0.017 | 0.309 | 0.002 | 0.002 | 0.003 | | | | 0.006 |
| H4-P1-7-ZR-C | 85.78 | 3.63 | 8.9 | 1.01 | 0.264 | 0.014 | 0.094 | 0.020 | 0.252 | 0.002 | 0.002 | 0.003 | 0.011 | | | 0.008 |
| H5-P1-7-Ti-C | 85.94 | 3.45 | 9.1 | 1.01 | 0.201 | 0.012 | 0.069 | 0.017 | 0.177 | 0.005 | 0.002 | 0.002 | | | 0.003 | 0.003 |
| H6-P2-7-Ti-C | 83.20 | 2.88 | 11.67 | 1.54 | 0.278 | 0.013 | 0.068 | 0.057 | 0.272 | 0.004 | 0.001 | 0.002 | | | <.001 | 0.004 |
| H7-P2-7-C | 82.40 | 2.83 | 12.69 | 1.45 | 0.269 | 0.014 | 0.057 | 0.019 | 0.254 | 0.004 | 0.001 | 0.002 | | | | 0.004 |
| H10-P2-7-B-C | 86.49 | 3.32 | 8.57 | 1.02 | 0.254 | 0.019 | 0.062 | 0.020 | 0.222 | 0.003 | 0.002 | 0.001 | | <.0003 | | 0.003 |
| H11-P3-7-C | 88.90 | 3.03 | 6.61 | 1.01 | 0.165 | 0.011 | 0.041 | 0.018 | 0.192 | 0.004 | 0.001 | 0.003 | | | | 0.004 |
| H12-P4-7-B-C | 88.77 | 3.60 | 6.05 | 1.02 | 0.257 | 0.009 | 0.057 | 0.019 | 0.197 | 0.003 | 0.002 | 0.001 | | <.0003 | | 0.004 |
| H13-P1-7-C | 85.35 | 2.89 | 9.62 | 1.47 | 0.324 | 0.010 | 0.053 | 0.018 | 0.241 | 0.005 | 0.001 | 0.008 | | | | 0.002 |
| C84XX2-H3P3-7C | 86.83 | 3.00 | 8.81 | 1.040 | 0.087 | 0.014 | 0.046 | .017 | 0.138 | 0.004 | 0.001 | 0.005 | | | | 0.002 |
| C84XX2-H4P4-7C | 86.67 | 3.03 | 8.86 | 1.030 | 0.108 | 0.014 | 0.053 | .017 | 0.198 | 0.005 | 0.002 | 0.004 | | | | 0.001 |
| C84XX7-H12P1-7CPC | 87.66 | 2.95 | 8.06 | 0.983 | 0.121 | 0.012 | 0.047 | .018 | 0.126 | 0.004 | 0.001 | 0.002 | | | | 0.005 |
| C84XX7-H13P2-7CPC | 87.33 | 2.92 | 8.37 | 1.02 | 0.122 | 0.015 | 0.052 | .018 | 0.128 | 0.004 | 0.001 | 0.002 | | | | 0.007 |
| C84XX101-H23P2-7-C | 86.45 | 2.99 | 8.87 | 1.06 | 0.409 | 0.013 | 0.001 | .011 | 0.173 | 0.003 | 0.001 | 0.001 | | | | 0.007 |
| C84XX102-H24P3-7-C | 86.29 | 2.98 | 9.07 | 1.01 | 0.394 | 0.013 | 0.001 | .011 | 0.205 | 0.004 | 0.001 | 0.002 | | | | 0.010 |

Figure 4

II-C C90420 Group

| Heat No | Cu | Sn | Zn | Ni | S | P | Pb | Fe | Sb | Al | Si | Mn | Zr | B | C |
|---|---|---|---|---|---|---|---|---|---|---|---|---|---|---|---|
| Aim | 86-89 | 7.5-8.5 | 1-5 | <1.0 | 0.01-0.65 | 0.05 | 0.09 | <0.4 | <0.02 | <0.005 | <0.005 | <0.2 | <0.2 | <0.2 | <0.1 |
| 90420-022312-H2P1-9A-ZR-C | 86.22 | 8.11 | 4.47 | .663 | .216 | .014 | .006 | .150 | .003 | .002 | .003 | .113 | .017 | | .006 |
| 90420-022312-H4P2-9A-C | 88.21 | 8.05 | 2.61 | .693 | .128 | .012 | .006 | .194 | .002 | .001 | .005 | .072 | | | .006 |
| 90420-022312-H5P3-9A-B-C | 88.56 | 8.10 | 2.31 | .658 | .094 | .015 | .005 | .126 | .003 | .001 | .003 | .114 | | <.0003 | .005 |
| 90420-022312-H6P4-9A-ZR-C | 86.32 | 7.97 | 4.60 | .632 | .192 | .011 | .006 | .159 | .003 | .001 | .004 | .071 | .016 | | .004 |
| 90420-022412-H7P1-7-C | 86.55 | 8.07 | 4.35 | .742 | .140 | .013 | .008 | .049 | .003 | .002 | .001 | .058 | | | .005 |
| 90420-022412-H8P2-7-C | 86.98 | 8.26 | 3.61 | .646 | .161 | .015 | .007 | .170 | .005 | .001 | .005 | .131 | | | .002 |
| 90420-022412-H9P3-7-C | 87.6 | 8.23 | 3.05 | .628 | .188 | .014 | .008 | .158 | .004 | .001 | .003 | .104 | | | .002 |
| 90420-022712-H10P1-7-B-C | 86.03 | 7.98 | 4.84 | .686 | .155 | .012 | .007 | .179 | .003 | .002 | .003 | | | <.0005 | .005 |
| 90420-022712-H11P2-7-B-C | 85.74 | 7.99 | 5.0 | .640 | .160 | .013 | .007 | .301 | .003 | .001 | .005 | .130 | | <.0005 | .001 |
| 90420-022712-H12P3-7-ZR-C | 87.21 | 8.03 | 3.41 | .696 | .232 | .012 | .007 | .282 | .004 | .001 | .002 | .015 | 0.015 | | .002 |

Figure 5

II-B C90410 Group

| Heat No | Cu | Sn | Zn | Ni | S | P | Pb | Fe | Sb | Al | Si | Mn | Zr | B |
|---|---|---|---|---|---|---|---|---|---|---|---|---|---|---|
| Aim | 86-89 | 7.5-8.5 | 1-5 | <1.0 | 0.01-0.65 | 0.05 | 0.09 | 0.4 | <0.02 | <0.005 | <0.005 | 0.01-0.7 | <0.2 | <0.2 |
| 1110348 | 87.38 | 7.78 | 3.53 | 0.840 | 0.239 | 0.012 | 0.030 | 0.127 | 0.003 | 0.001 | 0.004 | 0.042 | | |
| 1110357 | 88.06 | 7.93 | 2.95 | 0.789 | 0.163 | 0.009 | 0.009 | 0.033 | 0.004 | 0.001 | 0.026 | 0.008 | | |
| H2-P3-7-ZR | 86.93 | 7.99 | 3.57 | 0.864 | 0.334 | 0.01 | 0.006 | 0.233 | 0.003 | 0.002 | 0.001 | 0.031 | 0.015 | |
| H3-P1-7X | 86.71 | 7.7 | 4.07 | 0.778 | 0.397 | 0.007 | 0.007 | 0.279 | 0.003 | 0.002 | 0.003 | 0.034 | | |
| H4-P1-7-X | 88.46 | 7.71 | 2.62 | 0.874 | 0.158 | 0.008 | 0.006 | 0.118 | 0.002 | 0.001 | 0.002 | 0.030 | | |
| H5-P1-7-B | 88.37 | 7.67 | 2.66 | 0.919 | 0.277 | 0.008 | 0.008 | 0.157 | 0.003 | 0.002 | 0.001 | 0.027 | | <.0003 |
| H5-P3-7-B | 88.56 | 7.77 | 2.17 | 0.864 | 0.340 | 0.008 | 0.006 | 0.220 | 0.004 | 0.001 | 0.010 | 0.038 | | <.0003 |
| H6-P2-7-ZR | 87.05 | 7.67 | 3.72 | 0.834 | 0.367 | 0.009 | 0.007 | 0.277 | 0.002 | 0.002 | 0.002 | 0.038 | 0.016 | |
| H8-P3-7-X | 87.89 | 7.97 | 2.63 | 0.803 | 0.346 | 0.009 | 0.006 | 0.301 | 0.002 | 0.002 | 0.003 | 0.029 | | |
| H9-P2-7-X | 87.38 | 8.11 | 2.83 | 0.986 | 0.356 | 0.009 | 0.008 | 0.274 | 0.003 | 0.001 | 0.002 | 0.030 | | |
| H10-P4-7-B | 86.95 | 7.66 | 3.82 | 0.89 | 0.356 | 0.009 | 0.007 | 0.263 | 0.002 | 0.001 | 0.003 | 0.028 | | <.0003 |
| H11-P1-7-B | 86.96 | 7.74 | 3.80 | 0.819 | 0.252 | 0.013 | 0.008 | 0.292 | 0.005 | 0.001 | 0.003 | 0.096 | | <.0003 |
| H12-P2-7-ZR | 89.48 | 7.78 | 1.24 | 0.819 | 0.285 | 0.009 | 0.008 | 0.203 | 0.006 | 0.001 | 0.003 | 0.057 | 0.010 | |
| H13-P3-7-ZR | 87.57 | 7.77 | 3.19 | 0.916 | 0.250 | 0.009 | 0.009 | 0.179 | 0.006 | 0.001 | 0.003 | 0.076 | 0.010 | |
| H14-P4-7-X | 87.72 | 7.84 | 2.89 | 0.946 | 0.320 | 0.008 | 0.009 | 0.210 | 0.003 | 0.002 | 0.001 | 0.046 | | |

Figure 6A

I-C, C84020 Group

| Heat No | Cu | Sn | Zn | S | Ni | Mn | Zr | B | C | UTS, ksi | YS, ksi | %Elong | BHN | Modulus of Elasticity, Mpsi |
|---|---|---|---|---|---|---|---|---|---|---|---|---|---|---|
| 1104234-A | 89.33 | 2.7 | 6.89 | .130 | .842 | .006 | | | | 39.6 | 16.4 | 43 | 55 | 14.9 |
| 1104234-B | 89.33 | 2.7 | 6.89 | .130 | .842 | .006 | | | | 39.9 | 16.8 | 42 | 57 | 14.8 |
| 1104264-A | 86.63 | 2.75 | 9.31 | .137 | .979 | .018 | | | .005 | 39.0 | 18.07 | 33 | 67 | 14.0 |
| 1104264-B | 86.63 | 2.75 | 9.31 | .137 | .979 | .018 | | | .005 | 39.1 | 16.75 | 42 | 63 | 14.1 |
| 1104274-A | 87.68 | 2.73 | 8.24 | .141 | .862 | .020 | | | .009 | 39.6 | 18.51 | 39 | 65 | 14.4 |
| 1104274-B | 87.68 | 2.73 | 8.24 | .141 | .862 | .020 | | | .009 | 39.5 | 18.84 | 37 | 61 | 14.1 |
| 1109365 1A | 87.00 | 3.1 | 8.61 | .087 | 0.952 | 0.024 | | | .001 | 42.1 | 17.93 | 47 | 68 | 12.8 |
| 1109367 2A | 87.00 | 3.1 | 8.61 | .087 | 0.952 | 0.024 | | | .001 | 40.6 | 18.01 | 35 | 67 | 12.9 |
| 1109376 1A | 86.34 | 3.18 | 8.96 | .270 | 0.992 | 0.05 | | | .001 | 39.9 | 18.59 | 37 | 67 | 12.8 |
| 1109378 2A | 86.34 | 3.18 | 8.96 | .270 | 0.992 | 0.05 | | | .001 | 40.2 | 19.03 | 33 | 69 | 13 |
| 1109387 1A | 87.10 | 3.0 | 8.51 | .180 | 0.941 | 0.026 | | | .001 | 42.6 | 18.33 | 51 | 65 | 12.8 |
| 1109389 2A | 87.10 | 3.0 | 8.51 | .180 | 0.941 | 0.026 | | | .001 | 42.9 | 18.25 | 51 | 65 | 12.8 |
| | | | | | | | | | | | | | | |
| H1P1-9A-ZR-C | 88.16 | 2.96 | 7.19 | .229 | 1.04 | 0.058 | 0.01 | | .004 | 42.4 | 19.23 | 35 | 67 | 16.2 |
| H1P1-10A-ZR-C | 88.16 | 2.96 | 7.19 | .229 | 1.04 | 0.058 | 0.01 | | .004 | 43.3 | 20.1 | 39 | 67 | 16.4 |
| H3P3-9A-C | 89.07 | 3.71 | 5.38 | .274 | 1.12 | 0.088 | | | .006 | 43.0 | 20.5 | 39 | 69 | 16.3 |
| H4P1-9A-ZR-C | 85.78 | 3.63 | 8.9 | .264 | 1.01 | 0.094 | .011 | | .008 | 41.1 | 18.57 | 35 | 64 | 16.4 |
| H4P1-10A-ZR-C | 85.78 | 3.63 | 8.9 | .264 | 1.01 | 0.094 | .011 | | .008 | 41.6 | 18.7 | 32 | 65 | 16.5 |
| H5-P1-9A-Ti-C | 85.94 | 3.45 | 9.1 | .201 | 1.01 | 0.069 | | 0.003 | .003 | 40.7 | 18.68 | 27 | 61 | 15.6 |
| H5-P1-10A-Ti-C | 85.94 | 3.45 | 9.1 | .201 | 1.01 | 0.069 | | 0.003 | .003 | 43.2 | 18.9 | 35 | 65 | 15.5 |
| H6-P2-9A-Ti-C | 83.20 | 2.88 | 11.67 | .278 | 1.54 | 0.068 | | <.001 | .004 | 37.6 | 17.71 | 22 | 59 | 15.4 |
| H6-P2-10A-Ti-C | 83.20 | 2.88 | 11.67 | .278 | 1.54 | 0.068 | | <.001 | .004 | 39.6 | 17.8 | 28 | 61 | 15.4 |
| H7P2-9A-C | 82.4 | 2.83 | 12.69 | .269 | 1.45 | 0.057 | | | .004 | 37.9 | 16.22 | 36 | 59 | 15.1 |
| H10P2-9A-B-C | 86.49 | 3.32 | 8.57 | .254 | 1.02 | 0.062 | | <.0003 | .003 | 41.7 | 18.64 | 37 | 65 | 16.0 |
| H10P2-10A-B-C | 86.49 | 3.32 | 8.57 | .254 | 1.02 | 0.062 | | <.0003 | .003 | 41.0 | 18.69 | 30 | 67 | 16.1 |

Figure 6B

| Heat No | Cu | Sn | Zn | S | Ni | Mn | Zr | B | C | UTS, ksi | YS, ksi | %Elong | BHN | Modulus of Elasticity, Mpsi |
|---|---|---|---|---|---|---|---|---|---|---|---|---|---|---|
| H11P3-9A-C | 88.90 | 3.03 | 6.61 | .165 | 1.01 | 0.041 | | | .004 | 42.1 | 19.48 | 41 | 65 | 16.2 |
| H11P3-10A-C | 88.90 | 3.03 | 6.61 | .165 | 1.01 | 0.041 | | | .004 | 42.5 | 19.24 | 42 | 65 | 16.0 |
| H12P4-9A-B-C | 88.77 | 3.6 | 6.05 | .257 | 1.02 | 0.057 | | <.0003 | .004 | 41.3 | 19.58 | 30 | 69 | 16.0 |
| H12P4-10A-B-C | 88.77 | 3.6 | 6.05 | .257 | 1.02 | 0.057 | | <.0003 | .004 | 40.7 | 19.77 | 25 | 69 | 16.0 |
| C84XXX2-H3P3-9A-C | 86.83 | 3.00 | 8.81 | .087 | 1.040 | 0.046 | | | .002 | 42.3 | 18.11 | 44 | 74 | 15.0 |
| C84XXX2-H3P3-10A-C | 86.83 | 3.00 | 8.81 | .087 | 1.040 | 0.046 | | | .002 | 42.5 | 17.83 | 46 | 72 | 14.9 |
| C84XXX2-H4P4-9A-C | 86.67 | 3.03 | 8.86 | .108 | 1.030 | 0.053 | | | .001 | 41.3 | 17.43 | 47 | 71 | 14.9 |
| C84XXX2-H4P4-10A-C | 86.67 | 3.03 | 8.86 | .108 | 1.030 | 0.053 | | | .001 | 43.1 | 17.64 | 58 | 74 | 15.0 |
| C84XXX7-H12P1-9A-CPC | 87.66 | 2.95 | 8.06 | .121 | 0.983 | 0.047 | | | .005 | 41.2 | 17.89 | 46 | 66 | 14.8 |
| C84XXX7-H12P1-10A-CPC | 87.66 | 2.95 | 8.06 | .121 | 0.983 | 0.047 | | | .005 | 41.2 | 18.04 | 43 | 67 | 14.9 |
| C84XXX7-H13P2-9A-CPC | 87.33 | 2.92 | 8.37 | .128 | 1.02 | 0.052 | | | .007 | 41.1 | 17.86 | 45 | 66 | 14.8 |
| C84XXX7-H13P2-10A-CPC | 87.33 | 2.92 | 8.37 | .128 | 1.02 | 0.052 | | | .007 | 42.2 | 17.87 | 50 | 66 | 14.8 |
| C84X101-H23P2-9A-C | 86.45 | 2.99 | 8.87 | .409 | 1.06 | 0.001 | | | .007 | 40.3 | 21.6 | 27 | 65 | 14.9 |
| C84X101-H23P2-10A-C | 86.45 | 2.99 | 8.87 | .409 | 1.06 | 0.001 | | | .007 | 40.2 | 19.03 | 28 | 65 | 14.8 |
| C84X102-H24P3-9A-C | 86.29 | 2.98 | 9.07 | .394 | 1.01 | 0.001 | | | .01 | 38.7 | 19.57 | 24 | 66 | 14.8 |
| C84X102-H24P3-10A-C | 86.29 | 2.98 | 9.07 | .394 | 1.01 | 0.001 | | | .01 | 39.2 | 18.86 | 25 | 65 | 14.7 |
| **Average** | | | | | | | | | | **39.96** | **18.48** | **37.6** | **65.6** | **14.53** |

Figure 7 II-C, C90420 Group

| Heat No | Cu | Sn | Zn | S | Ni | Mn | Zr | B | C | UTS, ksi | YS, ksi | %Elong | BHN | Modulus of Elasticity, Mpsi |
|---|---|---|---|---|---|---|---|---|---|---|---|---|---|---|
| H2P1-9A-ZR-C | 86.22 | 8.11 | 4.47 | .216 | .663 | .113 | 0.017 | | 0.006 | 42.6 | 23.4 | 20 | 74 | 15.5 |
| H2P1-10A-ZR-C | 86.22 | 8.11 | 4.47 | .216 | .663 | .113 | 0.017 | | 0.006 | 43.2 | 24.5 | 17 | 74 | 15.6 |
| H4P2-9A-C | 88.21 | 8.05 | 2.61 | .128 | .693 | .072 | | | 0.006 | 47.2 | 25.1 | 22 | 80 | 15.6 |
| H4P2-10A-C | 88.21 | 8.05 | 2.61 | .128 | .693 | .072 | | | 0.006 | 46.8 | 25.0 | 23 | 77 | 15.6 |
| H5P3-9A-B-C | 88.56 | 8.10 | 2.31 | .094 | .658 | .114 | | <.0003 | 0.005 | 43.8 | 24.5 | 21 | 80 | 15.5 |
| H5P3-10A-B-C | 88.56 | 8.10 | 2.31 | .094 | .658 | .114 | | <.0003 | 0.005 | 45.7 | 24.9 | 18 | 77 | 15.6 |
| H6P4-9A-ZR-C | 86.32 | 7.97 | 4.60 | .192 | .632 | .071 | 0.016 | | 0.004 | 43.5 | 23.9 | 20 | 74 | 15.5 |
| H6P4-10A-ZR-C | 86.32 | 7.97 | 4.60 | .192 | .632 | .071 | 0.016 | | 0.004 | 46.9 | 23.7 | 26 | 77 | 15.5 |
| 90420-022412-H7P1-9A-C | 86.55 | 8.07 | 4.35 | .140 | .742 | .058 | | | .005 | 46.3 | 23.5 | 27 | 74 | 15.4 |
| 90420-022412-H7P1-10A-C | 86.55 | 8.07 | 4.35 | .140 | .742 | .058 | | | .005 | 42.3 | 24.3 | 17 | 76 | 15.6 |
| 90420-022412-H8P2-9A-C | 86.98 | 8.26 | 3.61 | .161 | .646 | .131 | | | .002 | 42.8 | 23.4 | 20 | 74 | 15.7 |
| 90420-022412-H8P2-10A-C | 86.98 | 8.26 | 3.61 | .161 | .646 | .131 | | | .002 | 44.0 | 24.6 | 20 | 76 | 15.6 |
| 90420-022412-H9P3-9A-C | 87.6 | 8.23 | 3.05 | .188 | .628 | .104 | | | .002 | 48.3 | 25.5 | 25 | 78 | 15.7 |
| 90420-022412-H9P3-10A-C | 87.6 | 8.23 | 3.05 | .188 | .628 | .104 | | | .002 | 47.6 | 25.3 | 24 | 78 | 15.5 |
| 90420-022712-H10P1-9A-B-C | 86.03 | 7.98 | 4.84 | .155 | .686 | | | <.0005 | .005 | 44.1 | 23.8 | 20 | 74 | 15.4 |
| 90420-022712-H10P1-10A-B-C | 86.03 | 7.98 | 4.84 | .155 | .686 | | | <.0005 | .005 | 45.9 | 24.2 | 22 | 74 | 15.7 |
| 90420-022712-H11P2-9A-B-C | 85.74 | 7.99 | 5.0 | .160 | .640 | .130 | | <.0005 | .001 | 49.1 | 25.5 | 26 | 77 | 15.7 |
| 90420-022712-H11P2-10A-B-C | 85.74 | 7.99 | 5.0 | .160 | .640 | .130 | | <.0005 | .001 | 46.7 | 24.7 | 22 | 78 | 15.6 |
| 90420-022712-H12P3-9A-ZR-C | 87.21 | 8.03 | 3.41 | .232 | .696 | .015 | | | .002 | 48.3 | 26.7 | 21 | 80 | 15.8 |
| **Average** | | | | | | | | | | **45.5** | **24.55** | **21.6** | **76.4** | **15.58** |

Figure 8 II-B C90410 Group

| Heat No | Cu | Sn | Zn | S | Ni | Mn | Zr | B | UTS, ksi | YS, ksi | %Elong | BHN | Modulus of Elasticity, Mpsi |
|---|---|---|---|---|---|---|---|---|---|---|---|---|---|
| 1110346 | 87.38 | 7.78 | 3.53 | .239 | 0.84 | 0.042 | | | 41.8 | 23.1 | 20 | 63 | 17.2 |
| 1110348 | 87.38 | 7.78 | 3.53 | .239 | 0.84 | 0.042 | | | 43.2 | 23.4 | 22 | 59 | 16.1 |
| 1110357 | 88.06 | 7.93 | 2.95 | .163 | 0.789 | 0.008 | | | 46.9 | 23.2 | 31 | 63 | 16.4 |
| 1110357 | 88.06 | 7.93 | 2.95 | .163 | 0.789 | | | | 45.0 | 22.9 | 26 | 59 | 16.6 |
| H2-P3-9A | 86.93 | 7.99 | 3.57 | .334 | 0.864 | 0.031 | 0.015 | | 45.3 | 24.6 | 23 | 80 | 16.2 |
| H2-P3-10A | 86.93 | 7.99 | 3.57 | .334 | 0.864 | 0.031 | 0.015 | | 44.7 | 23.9 | 24 | 76 | 16.0 |
| H3-P1-10A | 86.71 | 7.7 | 4.07 | .397 | 0.778 | 0.034 | | | 41.7 | 24.0 | 18 | 80 | 15.9 |
| H4-P1-9A | 88.46 | 7.71 | 2.62 | .158 | 0.874 | 0.030 | | | 46.5 | 23.7 | 27 | 69 | 16.4 |
| H4-P1-9A-X | 88.46 | 7.71 | 2.62 | 0.158 | 0.874 | 0.030 | | | 44.7 | 23.4 | 24 | 77 | 16.4 |
| H4-P1-10A-X | 88.46 | 7.71 | 2.62 | 0.158 | 0.874 | 0.030 | | | 47.8 | 23.8 | 32 | 80 | 16.1 |
| H5-P1-9A | 88.37 | 7.67 | 2.66 | .277 | 0.919 | 0.027 | | <0.0003 | 44.1 | 23.3 | 24 | 74 | 16.1 |
| H5-P1-10A | 88.37 | 7.67 | 2.66 | .277 | 0.919 | 0.027 | | <0.0003 | 47.9 | 24.2 | 30 | 76 | 16.1 |
| H5-P2-9A-B | 88.37 | 7.67 | 2.66 | 0.277 | 0.919 | 0.027 | | <0.0003 | 47.2 | 23.9 | 30 | 80 | 16.3 |
| H5-P2-10A-B | 88.37 | 7.67 | 2.66 | 0.277 | 0.919 | 0.027 | | <0.0003 | 45.8 | 23.8 | 27 | 80 | 16.2 |
| H5-P3-9A-B | 88.56 | 7.77 | 2.17 | .340 | 0.864 | 0.038 | | <0.0003 | 48.5 | 24.1 | 32 | 77 | 16.4 |
| H6-P2-9A | 87.05 | 7.67 | 3.72 | .367 | 0.834 | 0.038 | 0.016 | | 42.2 | 23.9 | 18 | 80 | 16.1 |
| H6-P2-10A | 87.05 | 7.67 | 3.72 | .367 | 0.834 | 0.038 | 0.016 | | 45.7 | 23.9 | 26 | 80 | 16.0 |
| H8-P3-9A | 87.89 | 7.97 | 2.63 | .346 | 0.803 | 0.029 | | | 44.0 | 24.0 | 23 | 80 | 16.2 |
| H8-P3-10A | 87.89 | 7.97 | 2.63 | .346 | 0.803 | 0.029 | | | 45.9 | 24.0 | 25 | 80 | 16.1 |
| H9-P2-9A-X | 87.38 | 8.11 | 2.83 | .356 | 0.986 | 0.030 | | | 46.6 | 26.5 | 22 | 80 | 16.4 |
| H9-P2-10A-X | 87.38 | 8.11 | 2.83 | .356 | 0.986 | 0.030 | | | 47.6 | 25.7 | 23 | 80 | 16.3 |
| H11-P1-9A-B | 86.96 | 7.74 | 3.80 | .252 | 0.819 | 0.096 | | <0.0003 | 47.2 | 26.4 | 23 | 81 | 16.3 |
| H12-P2-9A-ZR | 89.48 | 7.78 | 1.24 | .285 | 0.912 | 0.057 | 0.010 | | 49.5 | 24.8 | 44 | 76 | 16.0 |
| H12-P2-10A-ZR | 89.48 | 7.78 | 1.24 | .285 | 0.912 | 0.057 | 0.010 | | 48.0 | 24.5 | 30 | 76 | 16.1 |
| H13-P3-9A-ZR | 87.57 | 7.77 | 3.19 | .250 | 0.916 | 0.076 | 0.010 | | 44.9 | 24.3 | 21 | 76 | 16.0 |
| H13-P3-10A-ZR | 87.57 | 7.77 | 3.19 | .250 | 0.916 | 0.076 | 0.010 | | 46.0 | 24.3 | 25 | 77 | 16.0 |
| H14-P4-10A-X | 87.72 | 7.84 | 2.89 | 0.320 | 0.946 | 0.046 | | | 46.5 | 25.4 | 22 | 79 | 16.2 |
| **Average** | | | | | | | | | **45.7** | **24.1** | **25.7** | **75.3** | **16.2** |

Figure 9

Typical and Minimum Mechanical Properties

| *Alloy* | *UTS, ksi* | | *YS, ksi* | | *% Elongation* | | *Brinell Hardness* | *Modulus of Elasticity(ksi)* |
|---|---|---|---|---|---|---|---|---|
| | *Minimum* | *Typical* | *Minimum* | *Typical* | *Minimum* | *Typical* | | |
| **Semi-Red Brass,C84400** | 29.0 | 34.0 | 13 | 15 | 18 | 26 | 55 | 13,000 |
| **Sloan GreenAlloy,C84000** | 37.0 | 38.0 | 16.4 | 17.3 | 18 | 35 | 63 | 14,010 |
| **Sloan GreenAlloy,C84010** | 34.8 | 38.6 | 15.37 | 18.04 | 17 | 30.6 | 64 | 14,650 |
| **Sloan GreenAlloy,C84020** | 37.6 | 40.0 | 16.22 | 18.5 | 22 | 37.6 | 66 | 14,530 |
| | | | | | | | | |
| **SeBiLOY - C89520** | 26.0 | 31.0 | 18.0 | 21.0 | 6 | 10 | 54 | |
| **Bismuth Red Brass, C89833** | | 37.0 | | 17.0 | | 28 | 60 | |
| **Bismuth Bronze, C89836** | 33.0 | 37.0 | 15.0 | 19.0 | 20 | 30 | 65 | |
| **Biwalite -C83470** | 29.0 | 36.0 | | | 17 | 25 | | |
| **Silicon Brass,C87500** | 60.0 | 67.0 | 24.0 | 30.0 | 16 | 21 | 115 | 15,400 |
| **Ecobrass - C87850** | | 63.0 | | 26.0 | | 25 | 78 | 15,400 |
| | | | | | | | | |
| **Leaded Tin Bronze , C90300** | 40.0 | 45.0 | 18.0 | 21.0 | 20 | 30 | 70 | 14,000 |
| **Sloan GreenAlloy,C90400** | 41.1 | 44.2 | 22.4 | 23.2 | 20 | 26.1 | 77 | 15,080 |
| **Sloan GreenAlloy, C90410** | 41.8 | 45.7 | 22.9 | 24.1 | 18 | 25.7 | 75 | 16,200 |
| **Sloan GreenAlloy, C90420** | 42.3 | 45.5 | 23.4 | 24.55 | 17 | 21.6 | 76.4 | 15,580 |

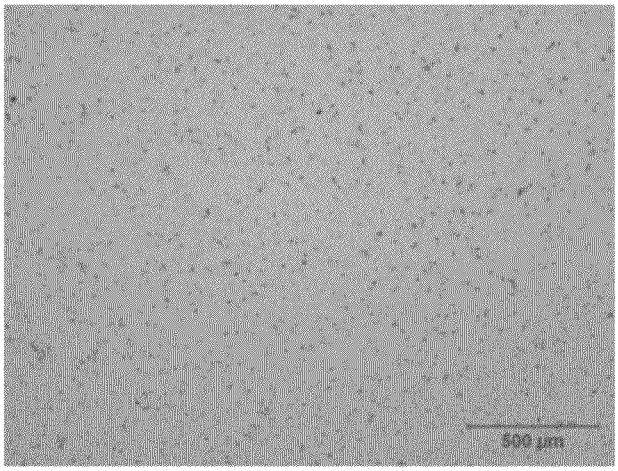
Figure 11A 84020-012112-H6-P2-7-Ti-C - As polished at 50X original magnification
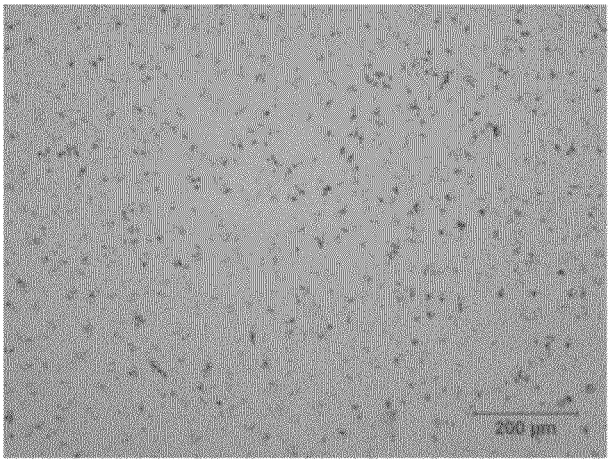
Figure 11B 84020-012112-H6-P2-7-Ti-C - As polished at 100X original magnification

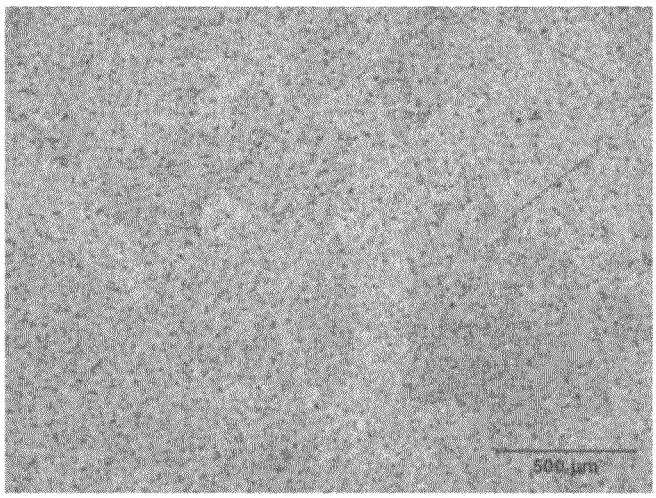
Figure 11C 84020-012112-H6-P2-7-Ti-C - Etched at 50X original magnification
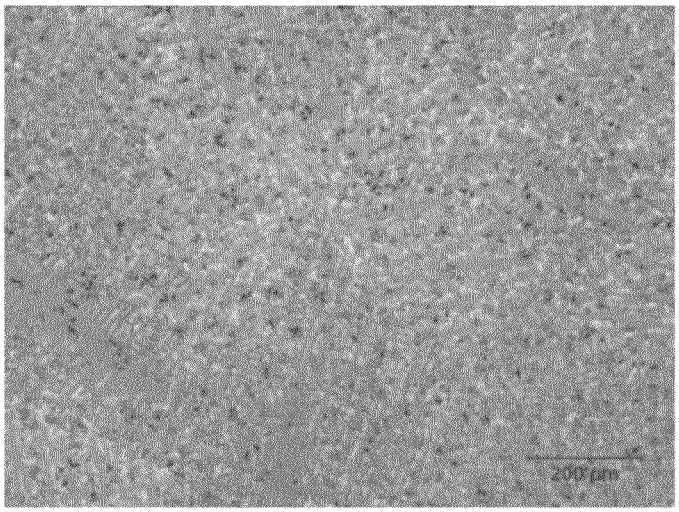
Figure 11D 84020-012112-H6-P2-7-Ti-C - Etched at 100X original magnification Figure 12A Figure 12B Figure 12C
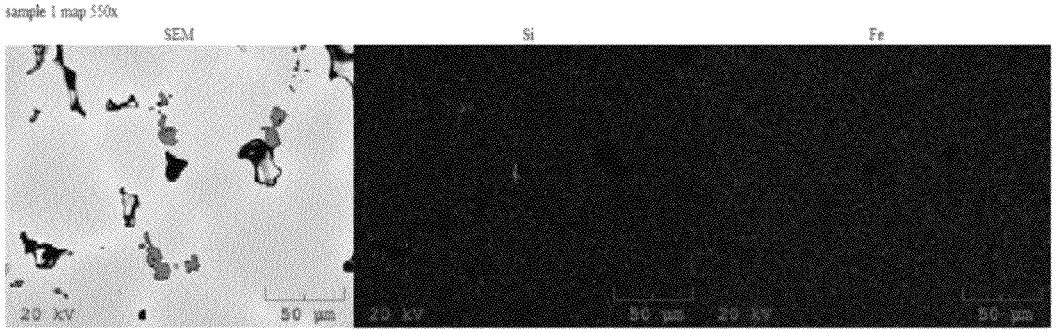
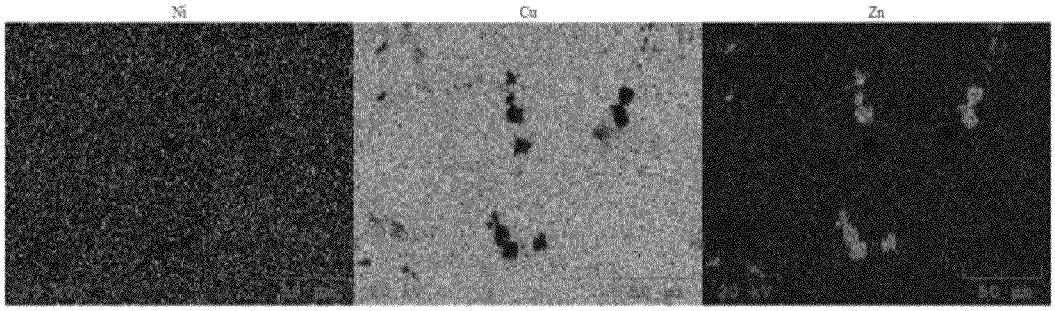
Fig 12D Fig 12E Fig 12F
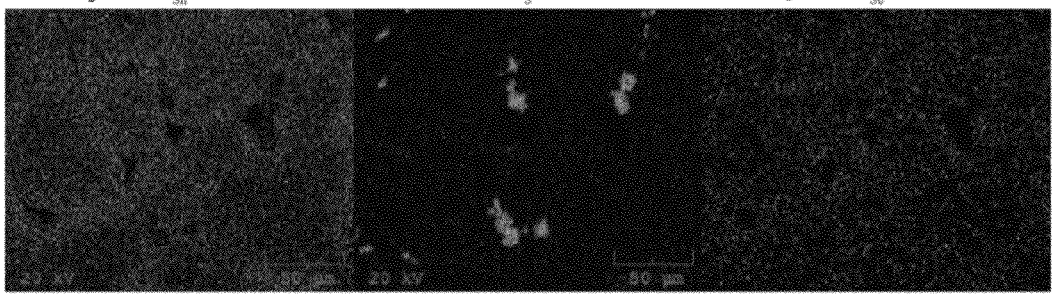
Figure 12G Figure 12H Figure 12I
Figures 12A-I Figure 13A Figure 13B Figure 13C Figure 13D
84020 map data 550x
SEM Si S Mn
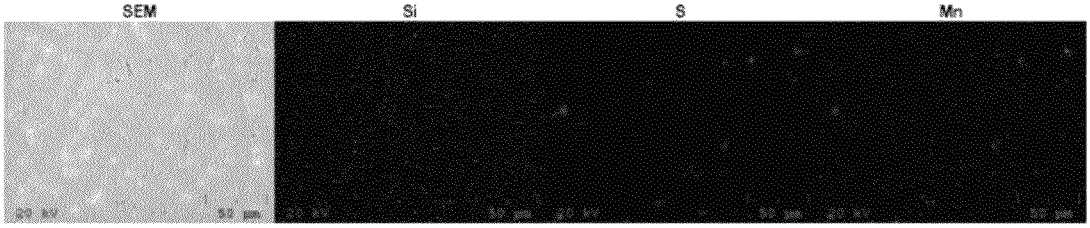
Fe Ni Cu Zn
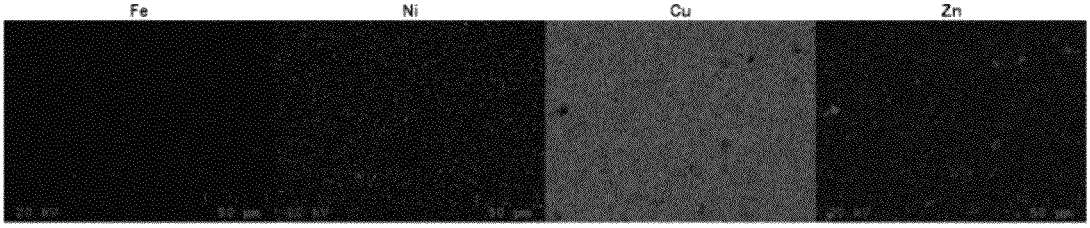
Fig 13E Fig 13F Fig 13G Fig 13H
Sn
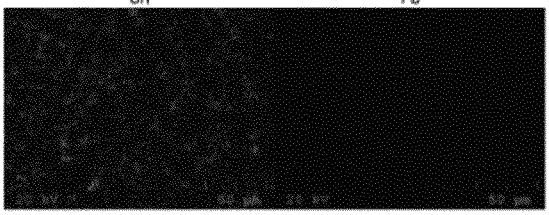
Figure 13I Figure 13J
Figures 13A-J

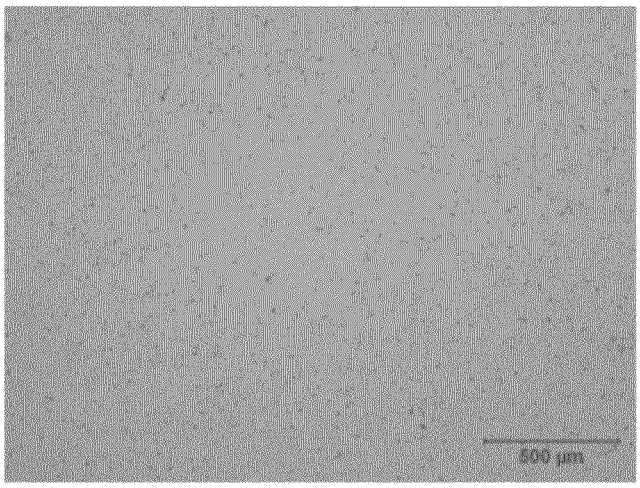
Figure 15A: 90420-022712-H10-P1-8-B-C - As polished at 50X original magnification
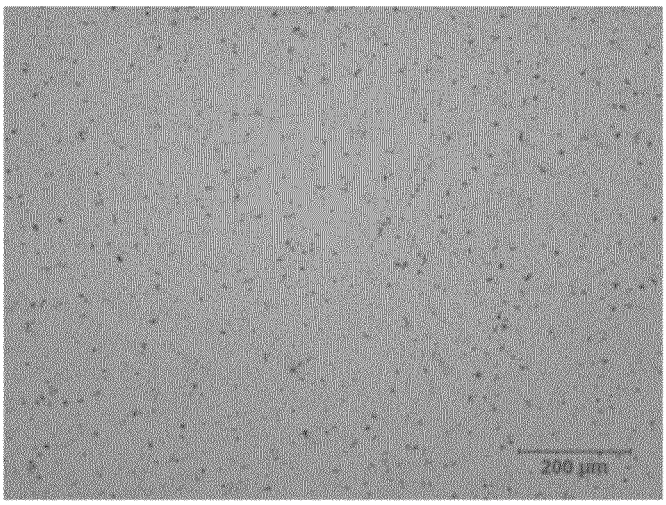
Figure 15B: 90420-022712-H10-P1-8-B-C - As polished at 100X original magnification

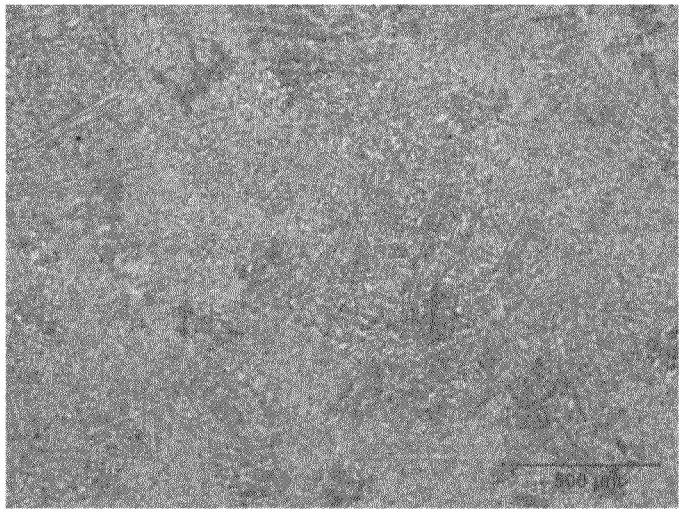
Figure 15C: 90420-022712-H10-P1-8-B-C - Etched at 50X original magnification
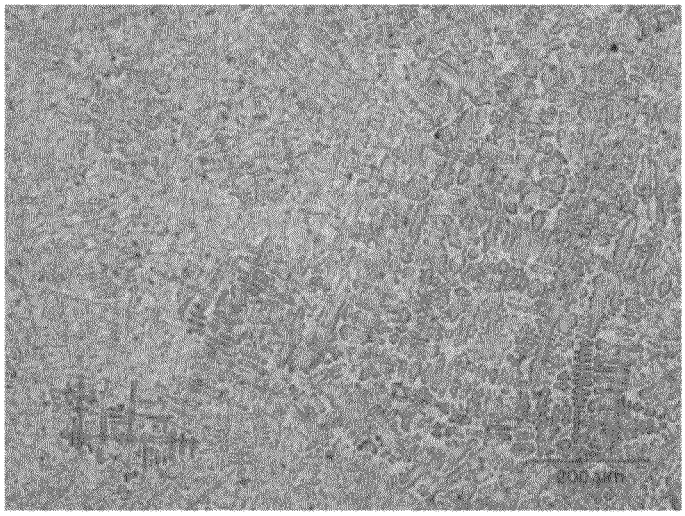
Figure 15D: 90420-022712-H10-P1-8-B-C - Etched at 100X original magnification

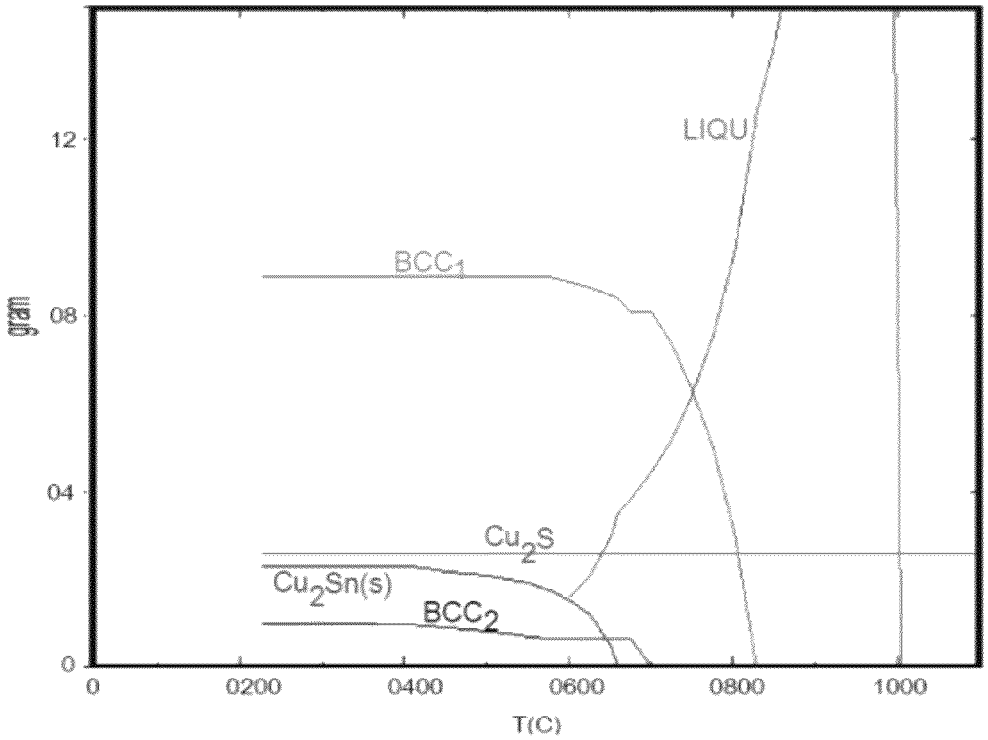
Figure 22A 94 Cu + 3 Zn + 2.5 Sn + 0.6 S

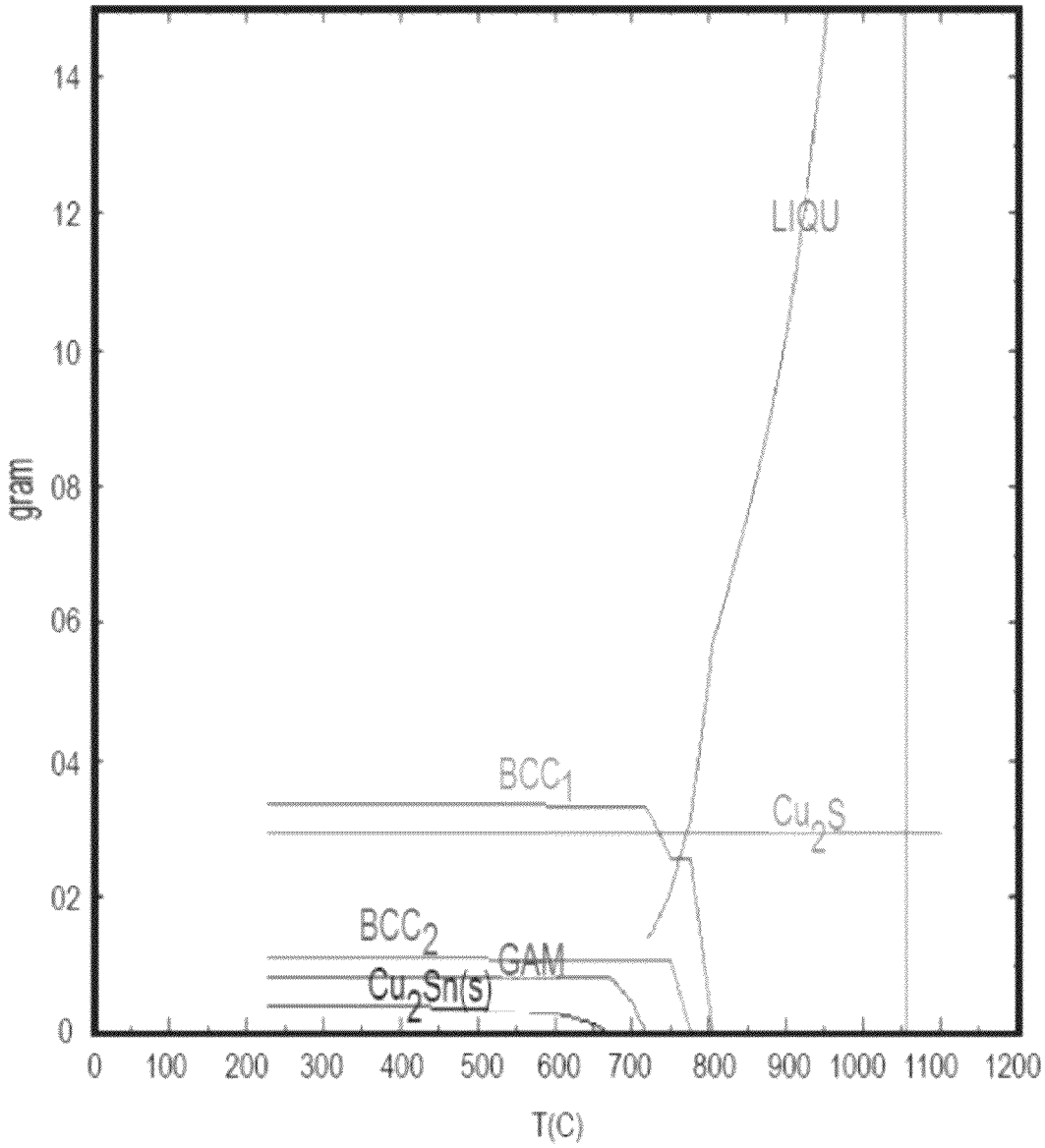
Figure 22B 94 Cu + 3 Zn + 2.5 Sn + 0.6 S

86 Cu + 9 Zn +3 Sn + 0.4 S + 0.5 Mn

86 Cu + 9 Zn + 3 Sn + 0.4 S + 0.5 Mn

87 Cu + 3 Zn + 8 Sn + 0.4 S

87 Cu + 3 Zn + 8 Sn + 0.4 S

CDA # 84X102 Pour Date 022912 Heat #24 Pour #3.xlsm

Chips from:

84x102 - 022912 - H # P 3 - 2

Thru

84x102 - 022912 - H # P 3 - 5

CDA # 90420 Pour Date 022412 Heat #8 Pour #2.xlsm

Chips from:

90420 - 022412 - H 8 P 2 - 2

Thru

90420 - 022412 - H 8 P 2 - 5

Fig 35A
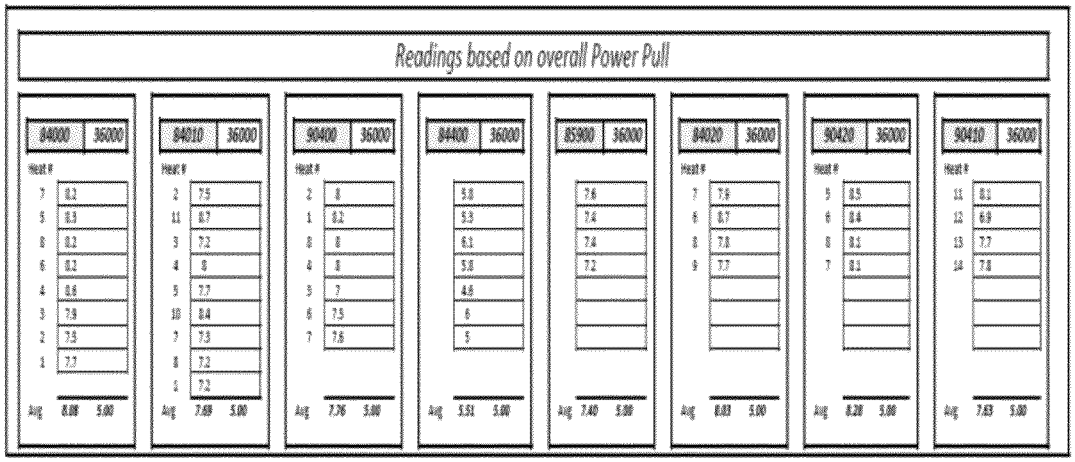
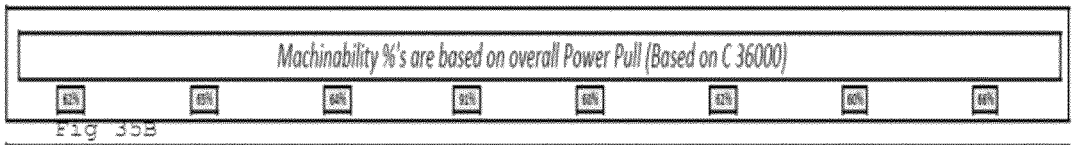
Fig 35B
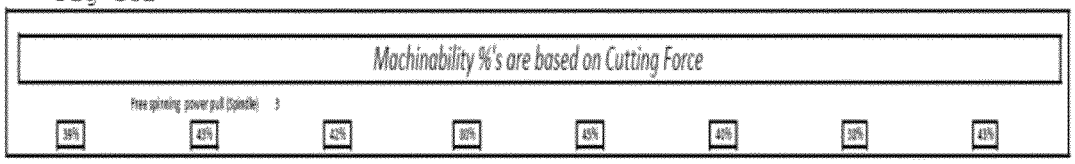
Fig 35C
Figure 35A-C

LOW LEAD ALLOY

CROSS-REFERENCE TO RELATED PATENT APPLICATIONS

This application claims priority to U.S. Provisional Patent Application No. U.S. Provisional Patent Application No. 61/482,893 filed May 5, 2011 and as a continuation-in-part to U.S. Utility application Ser. No. 13/317,785, filed Oct. 28, 2011, which claims priority to U.S. Provisional Patent Application No. 61/408,518, filed Oct. 29, 2010, U.S. Provisional Patent Application No. 61/410,752, filed Nov. 5, 2010 and U.S. Provisional Patent Application No. 61/451,476, filed Mar. 10, 2011. These applications are herein incorporated by reference in their entirety.

BACKGROUND OF THE INVENTION

Current plumbing materials are typically made from lead containing copper alloys. One standard brass alloy formulation is referred to in the art as C84400 or the "81,3,7,9" alloy (consisting of 81% copper, 3% tin, 7% lead, and 9% zinc) (herein in after the "81 alloy"). While there has been a need, due to health and environmental issues (as dictated, in part, by the U.S. Environmental Protection Agency on maximum lead content in copper alloys for drinking water applications) and also for cost reasons, to reduce lead contained in plumbing fitting, the presence of lead has continued to be necessary to achieve the desired properties of the alloy. For example, the presence of lead in a brass alloy provides for desirable mechanical characteristics and assists in machining and finishing the casting. Simple removal of lead or reduction below certain levels substantially degrades the machinability as well as the structural integrity of the casting and is not practicable.

Removal or reduction of lead from brass alloys has been attempted previously. Such previous attempts in the art of substituting other elements in place of lead has resulted in major machining and finishing issues in the manufacturing process, which includes primary casting, primary machining, secondary machining, polishing, plating, and mechanical assembly.

Several low or no lead formulations have previously been described. See, for example, products sold under the trade names SeBiLOY® or EnviroBrass®, Federalloy®, Biwalite™, Eco Brass®, Bismuth Red Brass (C89833), and Bismuth Bronze (C89836) as well as U.S. Pat. Nos. 7,056,396 and 6,413,330. FIG. 1 is a table that includes the formulation of several known alloys based upon their registration with the Copper Development Association. The existing art for low lead or no lead copper based castings consists of two major categories: silicon based materials and bismuth/selenium materials.

However, there is a need for a low-lead solution providing a low-cost alloy with similar properties to current copper/lead alloys without degradation of mechanical properties or chemical properties, as well as significant disruption to the manufacturing process because of lead substitution in the material causing cutting tool and finishing problems.

SUMMARY OF THE INVENTION

One embodiment of the invention relates to an alloy composition comprising a copper content of about 82% to about 89%, a sulfur content of about 0.01% to about 0.65%, a tin content of about 2.0% to about 4.0%, a lead content of less than about 0.09%, a zinc content of about 5.0% to about 14.0%, a carbon content of about 0.1%, and a nickel content of about 0.5% to about 2.0%.

One embodiment of the invention relates to an alloy composition comprising a copper content of about 86% to about 89%, a sulfur content of about 0.01% to about 0.65%, a tin content of about 7.5% to about 8.5%, a lead content of less than 0.09%, a zinc content of 1.0% to about 5.0%, a carbon content of about 0.1%, and a nickel content of about 1.0%.

One embodiment of the invention relates to an alloy composition comprising a copper content of about 58% to about 62%, a sulfur content of about 0.01% to about 0.65%, a tin content of about 1.5%, a lead content of less than 0.09%, a zinc content of 31.0% to about 41.0%, and a nickel content of about 1.5%.

One embodiment of the invention relates to an alloy composition comprising a copper content of about 58% to about 62%, a sulfur content of about 0.01% to about 0.65%, a lead content of less than 0.09%, and zinc content of 31.0% to about 41.0%.

One embodiment of the invention relates to a method for producing a copper alloy comprising adding carbon to a vessel prior to heating. A base ingot is heated in the vessel to a temperature of about 1,149 degrees Celsius to form a melt. Heating is ceased and additives added, except for sulfur, into the melt between 15 to 20 seconds. At least a partial amount of slag is skimmed from the melt. The melt is heated to a temperature of about 1,171 degrees Celsius. The sulfur is plunged into the melt. The melt is heated to a temperature of about 1,177 degrees Celsius. The slag is removed from the melt.

Additional features, advantages, and embodiments of the present disclosure may be set forth from consideration of the following detailed description, drawings, and claims. Moreover, it is to be understood that both the foregoing summary of the present disclosure and the following detailed description are exemplary and intended to provide further explanation without further limiting the scope of the present disclosure claimed.

BRIEF DESCRIPTION OF THE DRAWINGS

The foregoing and other objects, aspects, features, and advantages of the disclosure will become more apparent and better understood by referring to the following description taken in conjunction with the accompanying drawings, in which:

FIG. 1 provides a table listing formulations for several known commercial copper alloys.

FIG. 2 provides a table listing formulations for Alloy Groups in accordance with embodiments of the present invention.

FIG. 3 provides a table listing alloy formulations for Group I-C (C84020) examples by their respective casting heat.

FIG. 4 provides a table listing alloy formulations for Group II-C (C90420) examples by their respective casting heat.

FIG. 5 provides a table listing alloy formulations for Group II-B (C90410) examples by their respective casting heat.

FIGS. 6A-6B provides a table listing the results of the average mechanical property testing of embodiments of Group I-C (C84020) examples by their respective casting heat.

FIG. 7 provides a table listing the results of the average mechanical property testing of embodiments of Group II-C (C90420) examples by their respective casting heat.

FIG. 8 provides a table listing the results of the average mechanical property testing of embodiments of Group II-B (C90410) examples by their respective casting heat.

FIG. 9 provides listing the typical and minimum properties observed for embodiments of certain Alloy Groups of the present invention and those properties reported for commercially available alloys such as those in FIG. 1.

FIG. 11A is a micrograph of alloy C84020-012112-H6-P2-7-Ti—C as polished at 50× original magnification; FIG. 11B is an micrograph of alloy C84020-012112-H6-P2-7-Ti—C as polished at 100× original magnification; FIG. 11C is a micrograph of alloy C84020-012112-H6-P2-7-Ti—C etched by ammonium hydroxide and peroxide at 50×; FIG. 11D is a micrograph of alloy C84020-012112-H6-P2-7-Ti—C etched by ammonium hydroxide and peroxide at 100×;

FIG. 12A is a SEM image of C84010-111711-H4P4-12; FIG. 12B illustrates elemental mapping of silicon in the portion shown in FIG. 12A; FIG. 12C illustrates elemental mapping of iron in the portion shown in FIG. 12A; FIG. 12D illustrates elemental mapping of nickel in the portion shown in FIG. 12A; FIG. 12E illustrates elemental mapping of copper in the portion shown in FIG. 12A; FIG. 12F illustrates elemental mapping of zinc in the portion shown in FIG. 12A; FIG. 12G illustrates elemental mapping of tin in the portion shown in FIG. 12A; FIG. 12H illustrates elemental mapping of sulfur in the portion shown in FIG. 12A; FIG. 12I illustrates elemental mapping of antimony in the portion shown in FIG. 12A.

FIG. 13A is a SEM image of C84020-012112-H6-P2-7-Ti—C; FIG. 13B illustrates elemental mapping of silicon in the portion shown in FIG. 13A; FIG. 13C illustrates elemental mapping of sulfur in the portion shown in FIG. 13A; FIG. 13D illustrates elemental mapping of manganese in the portion shown in FIG. 13A; FIG. 13E illustrates elemental mapping of iron in the portion shown in FIG. 13A; FIG. 13F illustrates elemental mapping of nickel in the portion shown in FIG. 13A; FIG. 13G illustrates elemental mapping of copper in the portion shown in FIG. 13A; FIG. 13H illustrates elemental mapping of zinc in the portion shown in FIG. 13A; FIG. 13I illustrates elemental mapping of tin in the portion shown in FIG. 13A; FIG. 13J illustrates elemental mapping of lead in the portion shown in FIG. 13A.

FIG. 15A is a micrograph of alloy C90420-022712-H10-P1-8-B—C as polished at 50× original magnification; FIG. 15B is an micrograph of alloy C90420-022712-H10-P1-8-B—C as polished at 100× original magnification. FIG. 15C is a micrograph of alloy C90420-022712-H10-P1-8-B—C etched by ammonium hydroxide and peroxide at 50×; FIG. 15D is a micrograph of alloy C90420-022712-H10-P1-8-B—C etched by ammonium hydroxide and peroxide at 100×.

FIG. 16D illustrates elemental mapping of nickel in the portion shown in FIG. 16A; FIG. 16E illustrates elemental mapping of copper in the portion shown in FIG. 16A; FIG. 16F illustrates elemental mapping of zinc in the portion shown in FIG. 16A.

FIG. 22A is a phase distribution diagram of C83470 commercial alloy using Scheil cooling, FIG. 22B is a magnified part of the phase distribution diagram showing the relative amounts of secondary phases.

FIG. 35A is a machinability chart listing the overall power pull for select alloys; FIG. 35B is a machinability chart listing the percentage of overall power pull with C 36000 as the reference alloy; and FIG. 35C is a chart listing the machinability percentage based on cutting force.

DETAILED DESCRIPTION OF THE PREFERRED EMBODIMENTS

Figure 10A:
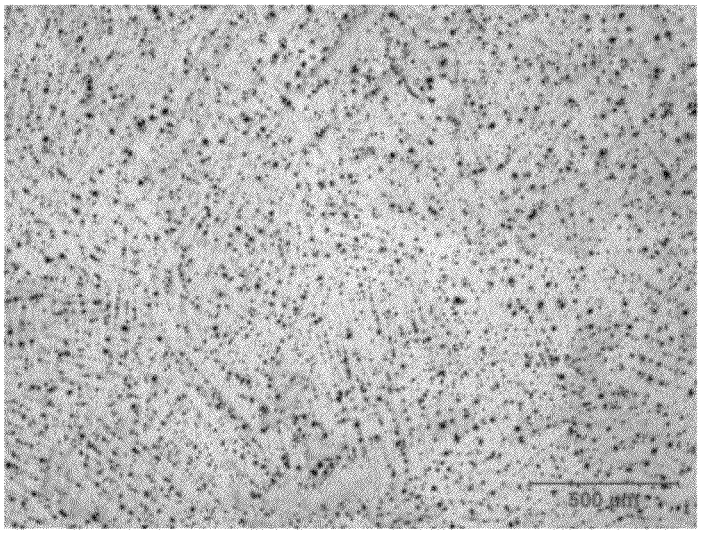
FIG. 10A is a micrograph of alloy C84010-120611-H7P1-8 as polished at 50× original magnification.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

In one embodiment, the invention relates to a composition of matter and methods for making same. The composition of matter is a copper-based alloy having a "low" level of lead as would be understood by one of ordinary skill in the art of cavity devices that make contact with potable water, including, for example, plumbing fixtures. The level of lead is below that which are normally used to impart the beneficial properties to the alloy necessary for usefulness in most applications, such as tensile strength, elongation, machinability, and pressure tightness. Prior art no-lead alternatives to leaded brass typically require changes to the metal feeding for sand castings in order to produce sufficient pressure tightness (such as having no material porosity). The alloys of the present invention include particular amounts of sulfur, and in certain embodiments, the sulfur is added through a preferred method, to impart the beneficial properties lost by the reduction in lead.

In certain embodiments, the alloys of the present invention relate generally to formulations of tin-bronze, and yellow brass. Certain embodiments are formulated for use primarily in sand cast applications, permanent mold cast applications, or wrought applications.

FIG. 2 illustrates a group of alloys in accordance with the present invention. Each of the alloys is characterized, at least in part, by the relative low level of lead (about 0.09% or less) and the presence of sulfur (about 0.01% to 0.65%). Three groups of semi-red brass, labeled Alloy Group I-A (C84000), Alloy Group I-B (C84010), and Alloy Group I-C (C84020) are provided. In one embodiment, these semi-red brass alloys are suitable for sand casting. Three groups of tin bronze, labeled Alloy Group II-A (C90400), Alloy Group II-B (C90410), and Alloy Group II-C (C90420) are provided. In one embodiment, these tin bronze alloys are suitable for sand casting. Six groups of yellow brass, labeled Alloy Group III-A (C85900), Alloy Group III-B (C85910), Alloy Group III-C (C85920, Alloy Group IV-A, Alloy Group IV-B, and Alloy Group IV-C are provided. In one embodiment the Alloy Group III alloys are suitable for permanent mold casting. In one embodiment, the Alloy Group IV alloys are suitable for wrought applications.

TABLE 10

| Formulations for Alloy Groups | | | | | | | | | | | | | | | | |
|---|---|---|---|---|---|---|---|---|---|---|---|---|---|---|---|---|
| | Cu | Sn | Pb | Zn | Fe | Sb | Ni | S | P | Al | Si | Mn | Zr | B | C | Ti |
| Lead-Free Semi-Red Brass - Sand Cast | | | | | | | | | | | | | | | | |
| C84000 | 82.0-89.0 | 2.0-4.0 | 0.09 | 5.0-14.0 | 0.4 | 0.02 | 0.5-2.0 | 0.01-0.65 | 0.05 | 0.005 | 0.005 | 0.20 | 0.20 | 0.20 | — | — |
| C84010 | 82.0-89.0 | 2.0-4.0 | 0.09 | 5.0-14.0 | 0.4 | 0.02 | 0.5-2.0 | 0.01-0.065 | 0.05 | 0.005 | 0.005 | 0.01-0.7 | 0.20 | 0.20 | — | — |
| C84020 | 82.0-89.0 | 2.0-4.0 | 0.09 | 5.0-14.0 | 0.4 | 0.02 | 0.5-2.0 | 0.01-0.065 | 0.05 | 0.005 | 0.005 | 0.20 | 0.20 | 0.20 | 0.1 | 0.30 |
| Lead-Free Tin Bronze - Sand Cast | | | | | | | | | | | | | | | | |
| C90400 | 86.0-89.0 | 7.5-8.5 | 0.09 | 1.0-5.0 | 0.4 | 0.02 | 1.0 | 0.01-0.065 | 0.05 | 0.005 | 0.005 | 0.2 | 0.20 | 0.20 | — | — |
| C90410 | 86.0-89.0 | 7.5-8.5 | 0.09 | 1.0-5.0 | 0.4 | 0.02 | 1.0 | 0.01-0.065 | 0.05 | 0.005 | 0.005 | 0.01-0.7 | 0.20 | 0.20 | — | — |
| C90420 | 86.0-89.0 | 7.5-8.5 | 0.09 | 1.0-5.0 | 0.4 | 0.02 | 1.0 | 0.01-0.065 | 0.05 | 0.010 | 0.010 | 0.2 | 0.20 | 0.20 | 0.1 | 0.30 |
| Lead-Free Yellow Brass - Permanent Mold Cast | | | | | | | | | | | | | | | | |
| C85900 | 58.0-62.0 | 1.5 | 0.09 | 31.0-41.0 | 0.50 | 0.20 | 1.5 | 0.01-0.065 | 0.01 | 0.1-0.6 | 0.25 | 0.20 | 0.20 | 0.20 | — | — |
| C85910 | 58.0-62.0 | 1.5 | 0.09 | 31.0-41.0 | 0.50 | 0.20 | 1.5 | 0.01-0.8065 | 0.01 | 0.1-0.6 | 0.25 | 0.01-0.7 | 0.20 | 0.20 | — | — |
| C85920 | 58.0-62.0 | 1.5 | 0.09 | 31.0-41.0 | 0.50 | 0.20 | 1.5 | 0.01-0.065 | 0.01 | 0.1-0.6 | 0.25 | 0.2 | 0.20 | 0.20 | 0.01-0.5 | 0.30 |
| Lead-Free Yellow Brass Wrought | | | | | | | | | | | | | | | | |
| C28300 | 58.0-62.0 | — | 0.09 | 31.0-41.0 | 0.35 | — | — | 0.01-0.065 | — | — | — | 0.20 | 0.20 | 0.20 | — | — |
| C28310 | 58.0-62.0 | — | 0.09 | 31.0-41.0 | 0.35 | — | — | 0.01-0.65 | — | — | — | 0.01-0.7 | 0.20 | 0.20 | — | — |
| C28320 | 58.0-62.0 | — | 0.09 | 31.0-41.0 | 0.35 | — | — | 0.01-0.65 | — | — | — | 0.2 | 0.20 | 0.20 | 0.01-0.5 | 0.50 |

Alloy Components

The alloys of the present invention comprise copper, zinc, tin, sulfur, nickel, and phosphorus. In certain embodiments, one or more of manganese, zirconium, boron, titanium and/or carbon are included. Certain embodiments include one or more of antimony, tin, nickel, phosphorus, aluminum, and silicon.

The alloys, comprise as a principal component, copper. Copper provides basic properties to the alloy, including antimicrobial properties and corrosion resistance. Pure copper has a relatively low yield strength, and tensile strength, and is not very hard relative to its common alloy classes of bronze and brass. Therefore, it is desirable to improve the properties of copper for use in many applications through alloying. The copper will typically be added as a base ingot. The base ingot's composition purity will vary depending on the source mine and post-mining processing. The copper may also be sourced from recycled materials, which can vary widely in composition. Therefore, it should be appreciated that ingot chemistry can vary, so, in one embodiment, the chemistry of the base ingot is taken into account. For example, the amount of zinc in the base ingot is taken into account when determining how much additional zinc to add to arrive at the desired final composition for the alloy. The base ingot should be selected to provide the required copper for the alloy while considering the secondary elements in the base ingot and their intended presence in the final alloy since small amounts of various impurities, such as iron, are common and have no material effect on the desired properties.

Lead has typically been included as a component in copper alloys, particularly for applications such as plumbing where machinability is an important factor. Lead has a low melting point relative to many other elements common to copper alloys. As such, lead, in a copper alloy, tends to migrate to the interdendritic or grain boundary areas as the melt cools. The presence of lead at interdendritic or grain boundary areas can greatly improve machinability and pressure tightness. However, in recent decades the serious detrimental impacts of lead have made use of lead in many applications of copper alloys undesirable. In particular, the presence of the lead at the interdendritic or grain boundary areas, the feature that is generally accepted to improve machinability, is, in part, responsible for the unwanted ease with which lead can leach from a copper alloy.

Figure 20:
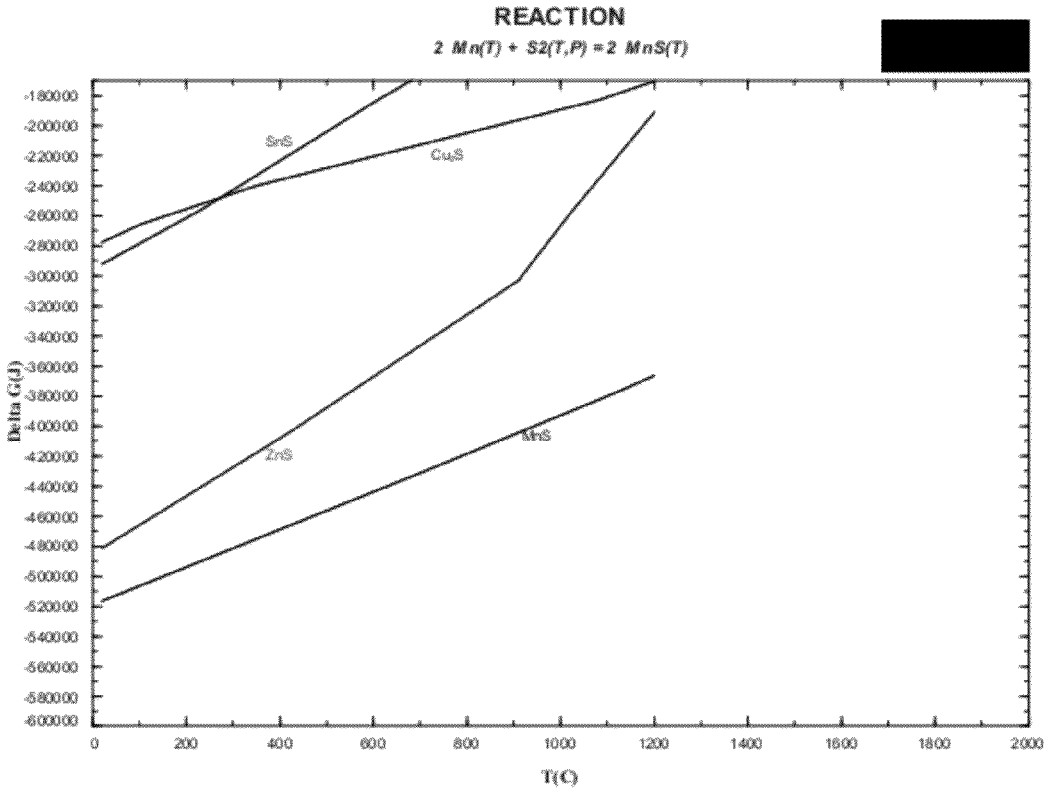
FIG. 20 is a sulfur free-energy diagram of primary sulfides.

Sulfur is added to the alloys of the present invention to overcome certain disadvantages of using leaded copper alloys. Sulfur present in the melt will typically react with transition metals also present in the melt to form transition metal sulfides. For example, copper sulfide and zinc sulfide may be formed, or, for embodiments where manganese is present, it can form manganese sulfide. FIG. 20 illustrates a free-energy diagram for several transition metal sulfides that may form in embodiments of the present invention. The melting point for copper sulfide is 1130 Celsius, 1185 Celsius for zinc sulfide, 1610 Celsius for manganese sulfide, and 832 Celsius for tin sulfide. Thus, without limiting the scope of the invention, in light of the free energy of formation, it is believed that a significant amount of the sulfide formation will be zinc sulfide for those embodiments having no manganese. It is believed that sulphides that solidify after the copper has become to solidify, thus forming dendrites in the melt, aggregate at the interdendritic areas or grain boundaries.

Sulfur provides similar properties as lead would impart to a copper alloy, without the health concerns associated with lead. Sulfur forms sulfides which it is believed tend to aggregate at the interdendritic or grain boundary areas. The presence of the sulfides provides a break in the metallic structure and a point for the formation of a chip in the grain boundary region and improve machining lubricity, allowing for improved overall machinability. The sulfides predominate in the alloys of the present invention provide lubricity. Good distribution of sulphides improves pressure tightness, as well as, machinability. In one embodiment the sulfur content is below 0.65%. An increased sulfur content can reduce the overall properties. It is believed that one mechanism causing such reduction may be the formation of sulfur dioxide during the melt, which leads to gas bubbles in the finished alloy product.

It is believed that the presence of tin in some embodiments increases the strength and hardness but reduces ductility by solid solution strengthening and by forming Cu—Sn intermetallic phase such as $Cu_3Sn$. It also increases the solidification range. Casting fluidity increases with tin content. Tin also increases corrosion resistance. However, currently Sn is very expensive relative to other components.

With respect to zinc, it is believed that the presence of Zn is similar to that of Sn, but to a lesser degree, in certain embodiments approximately 2% Zn is roughly equivalent to 1% Sn with respect to the above mentioned improvements to characteristics noted above. Zn increases strength and hardness by solid solution hardening. However, Cu—Zn alloys have a short freezing range. Zn is much less expensive than Sn.

With respect to certain embodiments, iron can be considered an impurity picked up from stirring rods, skimmers, etc during melting and pouring operations, or as an impurity in the base ingot. Such categories of impurity have no material effect on alloy properties.

For red brass and tin bronzes, antimony may be considered an impurity in the described alloys. Typically, antimony is picked up from inferior brands of tin, scrap and poor quality of ingots and scrap. However, antimony is deliberately added to yellow brasses in a permanent mold to increase the dezincification resistance.

In some embodiments, nickel is included to increase strength and hardness. Further, nickel aids in distribution of the sulfide particles in the alloy. In one embodiment, adding nickel helps the sulfide precipitate during the cooling process of the casting. The precipitation of the sulfide is desirable as the suspended sulfides act as a substitute to the lead for chip breaking and machining lubricity during the post casting machining operations. With the lower lead content, it is believed that the sulfide precipitate will minimize the effects of lowered machinability.

Phosphorus may be added to provide deoxidation. The addition of phosphorus reduces the gas content in the liquid alloy. Removal of gas generally provides higher quality castings by reducing gas content in the melt and reducing porosity in the finished alloy. However, excess phosphorus can contribute to metal-mold reaction giving rise to low mechanical properties and porous castings.

Aluminum is, in some embodiments, such as semi-red brasses and tin bronzes, treated as an impurity. In such embodiments, aluminum has harmful effects on pressure tightness and mechanical properties. However, aluminum in yellow brass castings can selectively improve casting fluidity. It is believed that aluminum encourages a fine feathery dendritic structure in such embodiments which allows for easy flow of liquid metal.

Silicon is also considered an impurity. In foundries with multiple alloys, silicon based materials can lead to silicon contamination in non silicon containing alloys. A small amount of residual silicon can contaminate semi red brass alloys, making production of multiple alloys near impossible. In addition, the presence of silicon can reduce the mechanical properties of semi-red brass alloys.

Manganese may be added in certain embodiments. The manganese is believed to aid in the distribution of sulfides. In particular, the presence of manganese is believed to aid in the formation of and retention of zinc sulfide in the melt. In one embodiment, a small amount of manganese is added to improve pressure tightness. In one embodiment, manganese is added as MnS.

Either zirconium or boron may be added individually (not in combination) to produce a fine grained structure which improves surface finish of castings during polishing.

Carbon may be added in certain embodiments to improve pressure tightness, reduce porosity, and improve machinability. In one embodiment, carbon may be added to the alloy as copper coated graphite ("CCG"). One type of copper coated graphite product is available from Superior Graphite and sold under the name DesulcoMC™. One embodiment of the copper coated graphite utilizes graphite that contains 99.5% min carbon, 0.5% max ash, and 0.5% max moisture. US mesh size of particles is 200 or 125 microns. This graphite is coated with 60% Cu by weight and has very low S.

In another embodiment, carbon may be added to the alloy as calcinated petroleum coke (CPC) also known as thermally purified coke. CPC may be screened to size. In one aspect, 1% sulfur is added and the CPC is coated with 60% Cu by weight. CPC wrapped copper, because of its relatively higher and coarser S content compared to copper coated graphite, imparts slightly higher S to the alloy and hence, better machinability. It has been observed that the use of CPC provides a similar contribution of sulfur as CCG, but the observed machinability of the embodiments utilizing CPC is superior to those embodiments having CCG.

It is believed that a majority of the carbon is not present in the final alloy. Rather, it is believed that carbon particles are formed that float to the surface as dross or reacting to form carbon monoxide (around 1,149 degrees Celsius) that is released from the melt as a gas. It has been observed that final carbon content of alloy is about 0.005% with a low density of 2.2 g/cc. Carbon particles float and form $CO_2$ at 1,149 degrees Celsius (like a carbon boil) and purify the melt. Thus, the alloys utilizing carbon may be more homogeneous and pure compared with other additions such as S, MnS, stibnite etc. Further, the atomic radius of carbon is $0.91\times10^{-10}$ M, which is smaller than that of copper ($1.57\times^{-10}$ M). Without limiting the scope of the invention, it is believed that carbon because of its low atomic volume remains in the face centered cubic crystal lattice of copper, thus contributing to strength and ductility.

The presence of carbon is observed to improve mechanical properties. Generally, a small amount of carbon (0.006%) is effective in increasing the strength, hardness and % elongation.

Titanium may be added in combination with carbon, such as in graphite form. Without limiting the scope of the invention, it is believed that the titanium aides in bonding the carbon particles with the copper matrix, particularly for raw graphite. For embodiments utilizing copper coated with carbon, titanium may not be useful to distribute the carbon such as by acting as a wetting agent.

Alloy Characteristics

In one embodiment, an alloy of the present invention solidifies in a manner such that a multitude of discrete particles of sulfur/sulfide are distributed throughout in a generally uniform manner throughout the casting. These nonmetallic sulfur particles serve to improve lubricity and break chips developed during the machining of parts cast in this new alloy, thereby improving machinability with a significant or complete reduction in the amount of lead. Without limiting the scope of the invention, the sulfides are believed to improved lubricity.

The preferred embodiments of the described alloy retain machinability advantages of the current alloys such as the "81" alloy or a similar leaded alloy. Further, it is believe that due to the relative scarcity of certain materials involved, the preferred embodiments of the ingot alloy will cost considerately less than that of the bismuth and/or selenium alloyed brasses that are currently advocated for replacement of leaded brass alloys such as "81". The sulfur is present in certain embodiments described herein as a sulfide which is soluble in the melt, but is precipitated as a sulfide during solidification and subsequent cooling of the alloy in a piece part. This precipitated sulfur enables improved machinability by serving as a chip breaker similar to the function of lead in alloys such as the "81" and in bismuth and selenium alloys. In the case of bismuth and/or selenium alloys the formation of bismuthides or selenides, along with some metallic bismuth, accomplishes a similar objective as this new sulfur containing alloy. The improvement in machinability may show up as increased tool life, improved machining surfaces, reduced tool forces, etc. This new idea also supplies the industry with a low lead brass/bronze which in today's environment is seeing any number of regulatory authorities limit by law the amount of lead that can be contained in plumbing fittings.

Further, alloys to which lead has been added result in an increase in the temperature range over which solidification occurs, normally making it more difficult to produce a leak tight casting, critical in plumbing fittings. However, lead segregates to the last regions to solidify and thereby seals the interdendritic and grain boundary shrinkage which occurs. This sealing of interdendritic or grain boundary porosity is not accomplished in the sulfur/sulfide containing alloys. Neither is it accomplished in the bismuth and/or selenium alloys. While bismuth is similar to lead in the periodic table of the elements, and expands during solidification, the amount of bismuth used is small compared to the amount of lead in conventional alloys such as the "81". Bi is typically present in commercial alloys in the elemental form.

One of ordinary skill will appreciate the additional benefits beyond the performance properties of the present alloys. Compared to bismuth and selenium the alloys of the present invention utilize abundantly found elements, whereas both bismuth and selenium are in relatively limited supply; and the conversion of brass castings to these materials will significantly increase the demand for these limited supply materials. In addition, bismuth has some health concerns associated with its use in plumbing fixtures, in part due to its proximity to lead as a heavy metal on the periodic table. Further, in certain embodiments, the alloys of the present invention utilizes a lower percent of copper than prior art bismuth and selenium compositions.

Yield Benefits

It has been observed that the use of sulfur as a substitute for lead rather than silicon provides superior "yield per melt". With sulfur, the yield per melt ranges from 70 to 80% as compared to silicon which can yield 40 to 60% per melt. Normal leaded brass alloys yield 70 to 80% depending upon process efficiency. As can be appreciated by one of ordinary skill, such an increase in yield reflects a substantial cost of goods differential. Therefore, the capacity of the metal casting facility is significantly reduced utilizing the silicon based materials. Also, certain embodiments of the present invention have a lower zinc content than the silicon based prior art alloys which normally contain upwards of 20% of zinc which can lead to leaks due to the interaction of the zinc and water resulting in corrosion. The lower, relative to those silicon based alloys, zinc of the present invention reduces the tendency for de-zincification. Further, if typically the product is to be finished with a chrome plated surface, the silicon based materials require a copper or tin strike prior to plating which increases the cost of the plating. The alloys of the present invention do not require the additional step (and its associated costs) to allow for chrome plating.

Melt Process

In one embodiment, graphite is placed on the bottom of the crucible prior to heating. In one embodiment, silicon carbide or clay graphite crucibles may be used in the melts. It is believed that the use of graphite reduces the loss of zinc during the heat without substantially becoming incorporated into the final alloy. In one embodiment, approximately two cups of graphite are used for a 90 to 95 lbs capacity crucible. For the examples used herein, a B-30 crucible was used for the melts, which has a capacity of 90 to 95 lbs of alloy. For embodiments using CPC or CCG, the carbon is wrapped in copper foil, preheated in oven at 150 C to drive off moisture and plunged into the melt followed by stirring.

Based upon the desired end alloy's formulation, the required base ingot is placed in the crucible and the furnace started. The base ingot, is brought to a temperature of about 1,149 degrees Celsius to form a melt. In one embodiment a conventional gas-fired furnace is used, and in another an induction furnace is used. The furnace is then turned off, i.e. the melt is no longer heated. Then the additives, except, in one embodiment, for sulfur and phosphorus, are then plunged into the melt between 15 to 20 seconds to achieve desired levels of Zn, Ni and Sn. The additives comprise the materials needed to achieve the final desired alloy composition for a given base ingot. In one embodiment, the additives comprise elemental forms of the elements to be present in the final alloy. Then a partial amount of slag is skimmed from the top of the melt.

The furnace is then brought to a temperature of about 1,171 Celsius. The furnace is then shut off and the sulfur additive is plunged in. For certain embodiments having phosphorus added, such as for degassing of the melt, the furnace is then reheated to a temperature of about 1,177 degrees Celsius and phosphorous is plunged into the melt as a Cu—P master alloy. Next, preferably all of the slag is skimmed from the top of the crucible. Tail castings for pressure testing and evaluation of machinability and plating, buttons, wedges and mini ingots for chemical analysis, and web bars for tensile testing are poured at about 1,149, about 1,116, and about 1,093 degrees Celsius respectively.

TESTING/EXAMPLES

Mechanical Properties

Mechanical properties of various embodiments of the present alloys were tested. FIGS. 3-4 and 6-8 correspond to the specific tested formulations and the corresponding results for carbon-containing alloys Alloy Group I-C (semi-red brass with carbon, C84020) and Alloy Group II-C (tin bronze with carbon C90420). FIGS. 5 and 8 correspond to specific tested formulations and the corresponding results for alloy group II-B (C90410).

FIG. 3 corresponds to the specific tested formulations and FIG. 6A-6B to the corresponding results for the Alloy Group I-C. Sample heats, prepared in accordance with the process above to achieve a Group I-C alloy, were tested for ultimate tensile strength ("UTS"), yield strength ("YS"), percent elongation ("E %"), Brinnell hardness ("BHN"), and Modulus of Elasticity ("MoE"). The average for the Alloy Group I-C alloys was 39.96 ksi for ultimate tensile strength, 18.48 ksi for yield strength, 37.6 for percent elongation, 65.6 for Brinnell hardness, and 14.53 Mpsi for Modulus of Elasticity.

These results indicate that the minimum and typical UTS values for alloy I-C are 45%, 12%, and 23% for minimum and 29%, 8%, and 11% for typical with respect to alloys C89520, C89836, and C83470 respectively. The E % is 267%, 10%, and 29% of the minimum and 276%, 25%, and 50% for typical with respect to C89520, C89836, and C83470 respectively. With respect to the C84400 alloy, for the I-C alloy, the minimum UTS, YS and % elongation values are higher by 30%, 25% and 22% and the typical UTS, YS, and % elongation values are higher by 18%, 23% and 45% respectively. The hardness is higher by 20%

FIG. 4 corresponds to the specific tested formulations and FIG. 7 to the corresponding results for the Alloy Group II-C. Sample heats, prepared in accordance with the process above to achieve a Group II-C alloy, were tested for ultimate tensile strength, yield strength, percent elongation, Brinnell hardness, and Modulus of Elasticity. The average for the Alloy Group II-C alloys was 45.5 ksi for ultimate tensile strength, 24.5 ksi for yield strength, 21.6 for percent elongation, 76.4 for Brinnell hardness, and 15.58 Mpsi for Modulus of Elasticity.

With respect to II-C, these values are higher by 6%, for minimum UTS, 1%, for typical UTS; 29% for minimum YS, 17% for typical YS %, with respect to alloy C90300. However, the elongation values for C90420 are lower for than the C90300 alloys (15% for minimum and 28% for typical elongation)

Regarding Group I-C, the observed UTS was consistently higher than the commercial alloys. The observed YS was consistently higher than the C89836 but slightly less than that of C89520, an alloy containing the expensive rare element bismuth. The observed elongation was consistently much higher than all of the commercial alloys. With respect to known Bismuth Bronze alloy C89836, the present group I-C alloys exhibit UTS and YS values consistently higher as well as hardness.

With respect to embodiments of the present invention utilizing carbon it has been observed that in C84020, carbon addition helps to increase the average UTS and % elongation over C84000 (by 5% and 7% respectively) and C84010 (by 4% and 25% respectively). However, in comparison with the leaded 81 alloy (C84400), the minimum and typical UTS values increase by 30% and 18% respectively. With respect to minimum and typical YS, the increases are 25% and 23% respectively. Similar increase for minimum and typical elongation values are 22% and 45% respectively. These are significant increases over the 81 metal, especially the elongation values.

This (% increase in elongation) is not the case for C90420 probably because of its high volume fraction of the beta phase, and high Sn content. It is believed the high Sn content contributes to high strength at the expense of ductility.

The percent increases in minimum UTS, typical UTS, minimum YS and typical UTS of C90420 over the 81 alloy are respectively 46%, 34%, 80% and 64%. Although, there is some decreases in the minimum and typical elongation values, % elongation of 17 for minimum and 22 for typical are still very respectable for plumbing applications. Carbon is effective in contributing to the strength, hardness and % elongation.

With respect to the II-B alloy properties can be observed to be superior to those of the common leaded semi-read brass C84400. In addition, Group II-B (C90410) was observed to have minimum and typical UTS and YS properties as well as minimum % elongation comparable with those of II-C. However, typical % elongation (26%) is higher in II-B than the II-C by 19% despite the presence of carbon in II-C. The minimum and typical values for UTS and YS over the 81 metal, these are higher by 44%, 34%, 76% and 61% respectively, The minimum and typical elongation values have remained unchanged and hence, very respectful.

FIG. 9 illustrates the range of mechanical properties determined experimentally for alloys of the present invention, as well as for several known commercial alloys.

TABLE 11

Typical and Minimum Properties Observed for Certain Alloy Groups

| Alloy | UTS, ksi | | YS, ksi | | % Elongation | | Brinell | Modulus of |
|---|---|---|---|---|---|---|---|---|
| | Minimum | Typical | Minimum | Typical | Minimum | Typical | Hardness | Elasticity (ksi) |
| Semi-Red Brass, C84400 | 29.0 | 34.0 | 13 | 15 | 18 | 26 | 55 | 13,000 |
| Sloan GreenAlloy, C84000 | 37.0 | 38.0 | 16.4 | 17.3 | 18 | 35 | 63 | 14,010 |
| Sloan GreenAlloy, C84010 | 34.8 | 38.6 | 15.37 | 18.04 | 17 | 30.6 | 64 | 14,650 |
| Sloan GreenAlloy, C84020 | 37.6 | 40.0 | 16.22 | 18.5 | 22 | 37.6 | 66 | 14,530 |
| SeBiLOY - C89520 | 26.0 | 31.0 | 18.0 | 21.0 | 6 | 10 | 54 | |
| Bismuth Red Brass, C89833 | | 37.0 | | 17.0 | | 28 | 60 | |
| Bismuth Bronze, C89836 | 33.0 | 37.0 | 15.0 | 19.0 | 20 | 30 | 65 | |
| Biwalite - C83470 | 29.0 | 36.0 | | | 17 | 25 | | |
| Silicon Brass, C87500 | 60.0 | 67.0 | 24.0 | 30.0 | 16 | 21 | 115 | 15,400 |
| Ecobrass - C87850 | | 63.0 | | 26.0 | | 25 | 78 | 15,400 |
| Leaded Tin Bronze, C90300 | 40.0 | 45.0 | 18.0 | 21.0 | 20 | 30 | 70 | 14,000 |
| Sloan GreenAlloy, C90400 | 41.1 | 44.2 | 22.4 | 23.2 | 20 | 26.1 | 77 | 15,080 |
| Sloan GreenAlloy, C90410 | 41.8 | 45.7 | 22.9 | 24.1 | 18 | 25.7 | 75 | 16,200 |
| Sloan GreenAlloy, C90420 | 42.3 | 45.5 | 23.4 | 24.55 | 17 | 21.6 | 76.4 | 15,580 |

Machinability Test—Cuttings

Machinability testing described in the present application was performed using the following method. The piece parts were machined by a coolant fed, 2 axis, CNC Turning Center. The cutting tool was a carbide insert. The machinability is based on a ratio of energy that was used during the turning on the above mentioned CNC Turning Center. The calculation formula can be written as follows:

$$C_F=(E_1/E_2)\times 100$$

$C_F$=Cutting Force $E_1$=Energy used during the turning of the New Alloy.

$E_2$=Energy used during the turning of a "known" alloy C 36000 (CDA).

Feed rate=0.005 IPR

Spindle Speed=1,500 RPM

Depth of Cut=Radial Depth of Cut=0.038 inches

An electrical meter was used to measure the electrical pull while the cutting tool was under load. This pull was captured via milliamp measurement.

Figure 29:
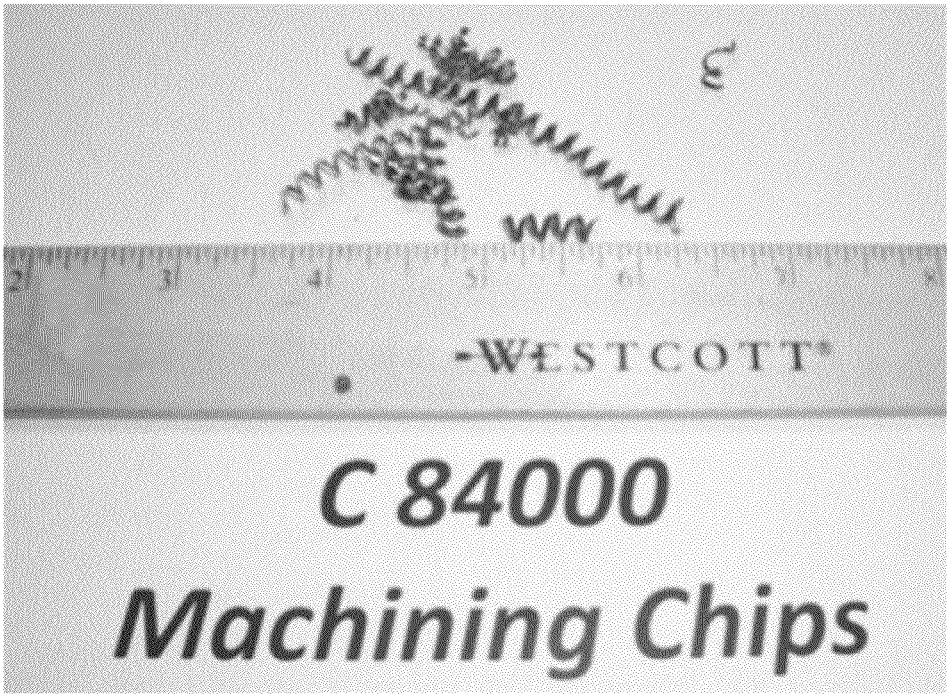
FIG. 29 illustrates chips from a machinability test of a group I-C C84000 alloy.
Figure 30:
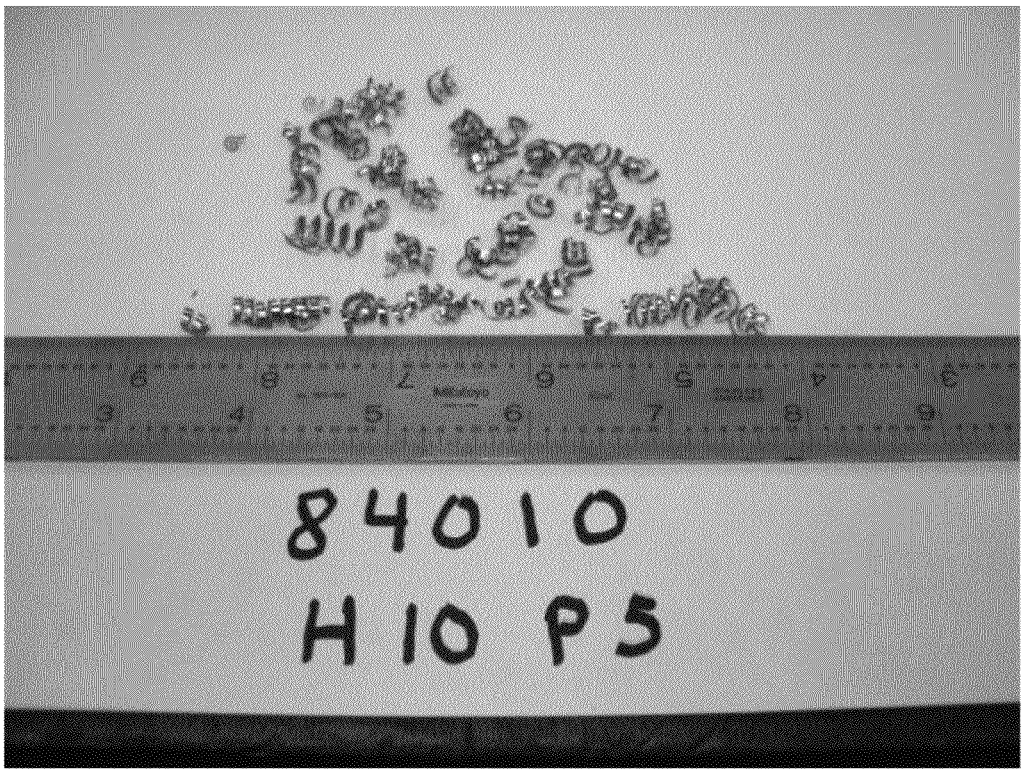
FIG. 30 illustrates chips from a machinability test of a group I-C C84010 alloy.
Figure 31:
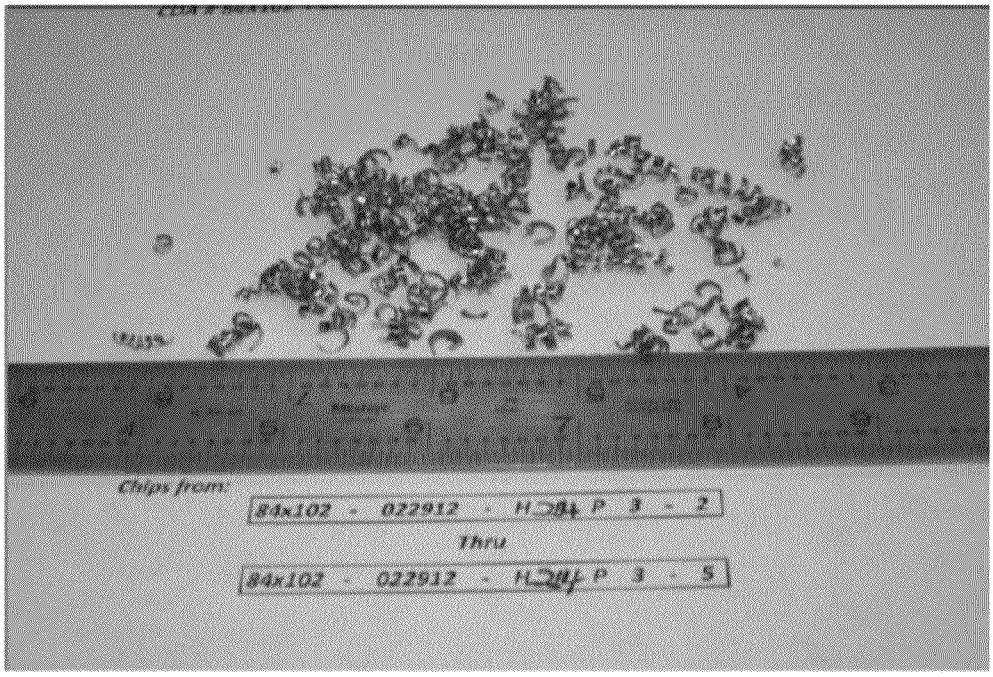
FIG. 31 illustrates chips from a machinability test of a group I-C C84020 alloy.
Figure 32:
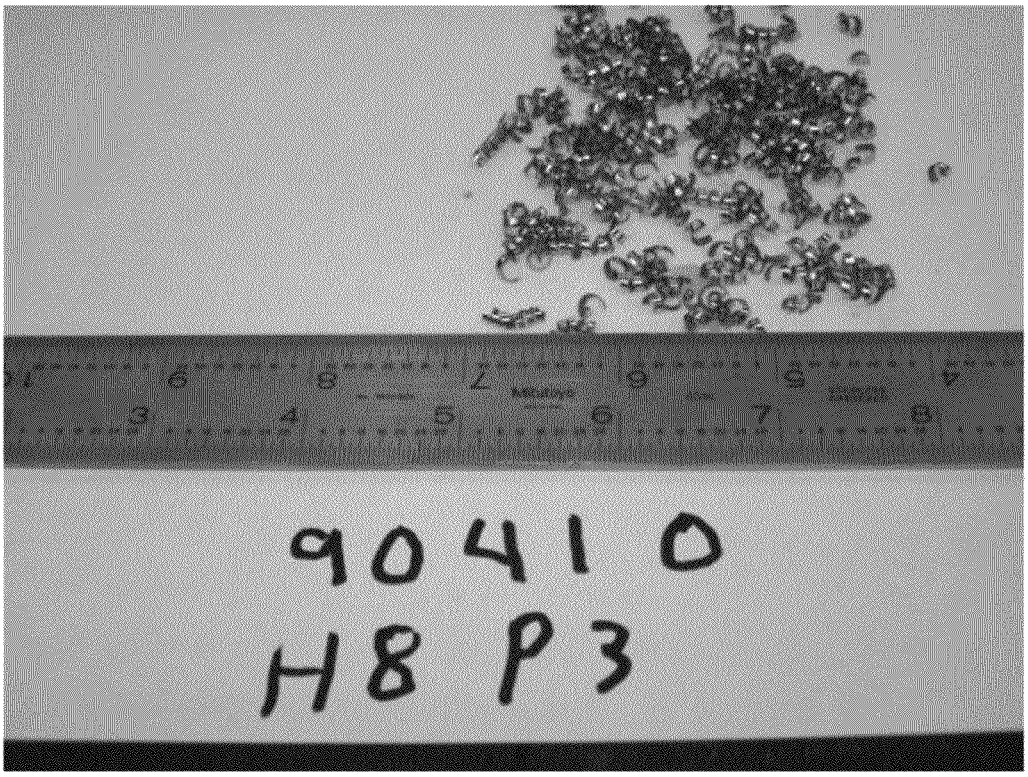
FIG. 32 illustrates chips from a machinability test of a group II-B C90410 alloy.
Figure 33:
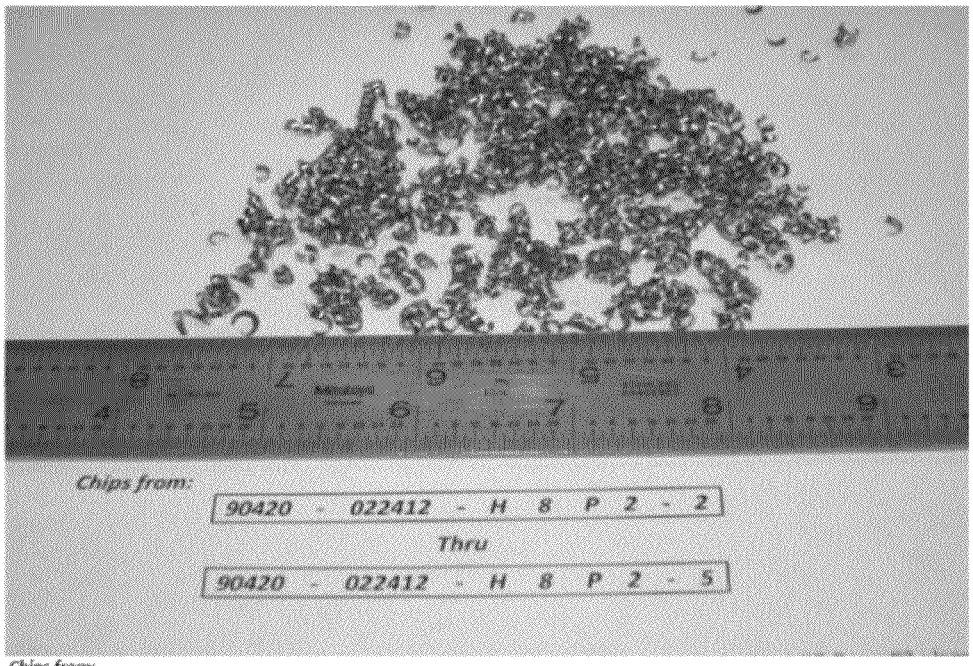
FIG. 33 illustrates chips from a machinability test of a group II-C C90420 alloy.

FIGS. 29-33 respectfully illustrate chip morphology for C84000, C84010, C84020, C90410 and C90420 alloys. As can be seen from the figures, the chip morphology indicates generally good chip formation. This is an indication of the presence of chip-breakers in the alloy. It is believed that the sulfur acts as a chip-breaker through presence at interdentric boundaries. The tailings indicate good machinability with chips breaking due to the presence of sulfides as indicated in the SEM and phase analysis below. FIG. 29 illustrates chip morphology for a C84000 alloy having low sulfur (0.06% sulfur with a 39% machinability rating). As can be seen, the chip morphoplogy indicates a chip breaker is present, though less so than at the high concentrations of sulfur seen in the FIGS. 30-33. Table 1 below indicates the chemistries for the tested alloy formulations.

TABLE 1

| Heat No | Cu | Sn | Zn | Ni | S | Mn | C |
|---|---|---|---|---|---|---|---|
| C84010-H10P5. | 85.5 | 3.07 | 9.75 | 1.06 | 0.351 | 0.024 | — |
| C90410-H8P3 | 87.89 | 7.97 | 2.63 | 0.803 | 0.346 | 0.029 | — |
| 84020-022912-H24P3-7-C | 86.29 | 2.98 | 9.07 | 1.01 | 0.394 | — | 0.01 |
| 90420-022412-H8P2-7-C | 86.98 | 8.26 | 3.61 | 0.646 | 0.161 | 0.131 | 0.002 |

Figure 34:
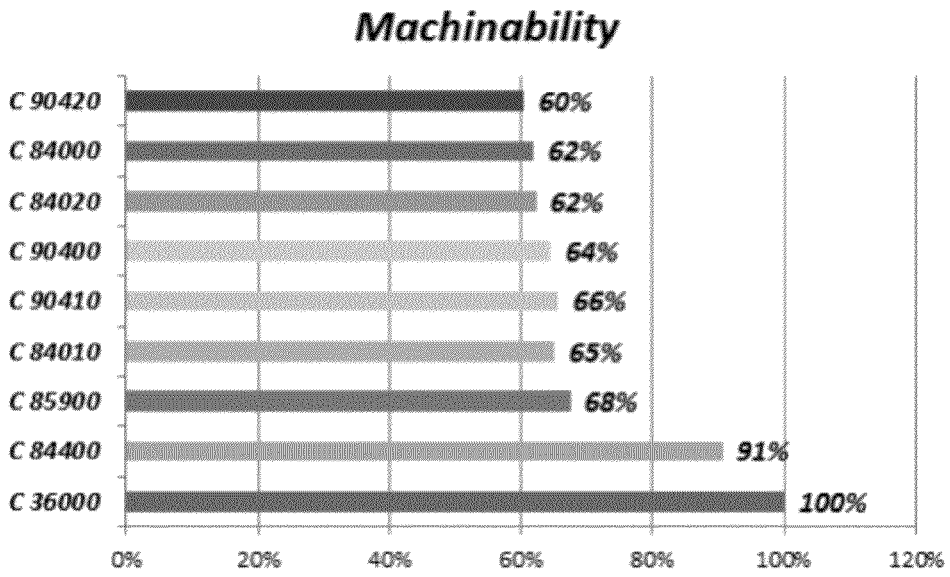
FIG. 34 is a chart depicting the machinability of several alloys.

FIG. 34 illustrates a chart showing the relative machinability in graphical terms of various alloys. FIG. 35A-C above lists machineability data for certain embodiments of the present invention, as well as for a prior alloy C84400. The machineability data was calculated as discussed above and expressed with respect to the percentage of electrical pull with respect to that used for known alloy C36000. As can be seen in FIG. 35A-C each of the alloys of the present invention demonstrate an improved machinability with respect to the reference alloy C36000 as well as an improvement with respect to a comparable leaded alloy, C84400. In general, the machinability percentage of the tested alloys of the present invention are between 60% and 66%. These are lower than the C84400 (81 alloy) by 27 to 34%.

Scanning Electron Microscope Analysis

A micrographical analysis of certain embodiments was undertaken to characterize the alloy and provide information regarding the microstructure and positioning of various elements within the alloy's structure. Table 2 lists the chemistries for the alloys whose micrographs are shown in FIGS. 10-17.

TABLE 2

CHEMISTRY OF SAMPLES FOR MICROGRAPHICAL, ANALYSIS

| Heat No | Cu | Sn | Zn | Ni | S | Mn | Fe | C | Zr | B |
|---|---|---|---|---|---|---|---|---|---|---|
| 84020-012112-H6-P2-7 | 83.2 | 2.88 | 11.67 | 1.54 | 0.278 | 0.068 | 0.272 | 0.004 | — | <0.001 |
| 90410-120711-H6P2-12 | 87.05 | 7.67 | 3.72 | 0.834 | 0.367 | 0.038 | 0.277 | — | 0.016 | — |
| 90410-121911-H5P3-11 | 88.56 | 7.77 | 2.17 | 0.864 | 0.34 | 0.038 | 0.22 | — | — | <0.0003 |
| 84010-111711-H4P4-12 | 86.46 | 3.44 | 8.26 | 1.25 | 0.256 | 0.027 | 0.239 | — | 0.022 | — |
| 84010-120611-H7P1-9 | 82.13 | 2.96 | 13.07 | 1.01 | 0.309 | 0.039 | 0.441 | — | — | — |
| 90420-022712-H10-P1-8-B-C | 86.03 | 7.98 | 4.84 | 0.686 | 0.155 | — | 0.179 | 0.005 | — | <0.0005 |

Figure 10B:
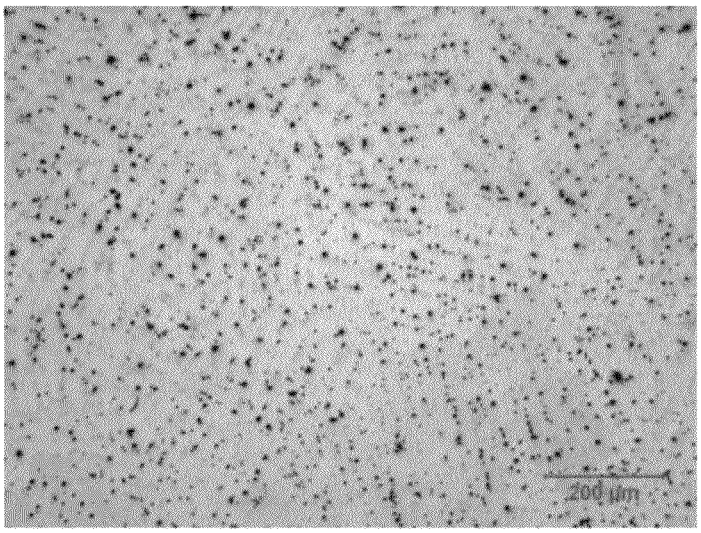
FIG. 10B is an micrograph of alloy C84010-120611-H7P1-8 as polished at 100× original magnification.
Figure 10C:
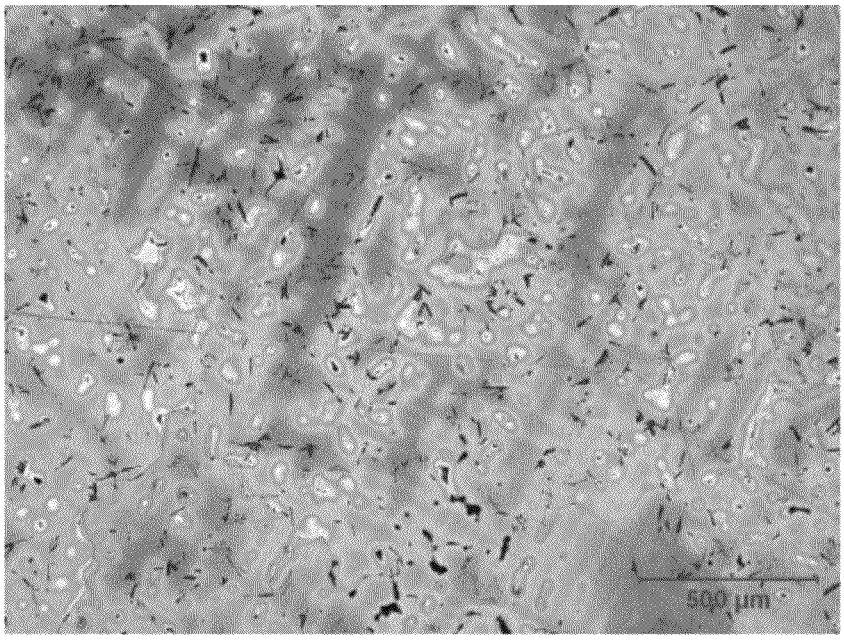
FIG. 10C is a micrograph of alloy C84010 etched with ammonium hydroxide and peroxide at 50×.
Figure 10D:
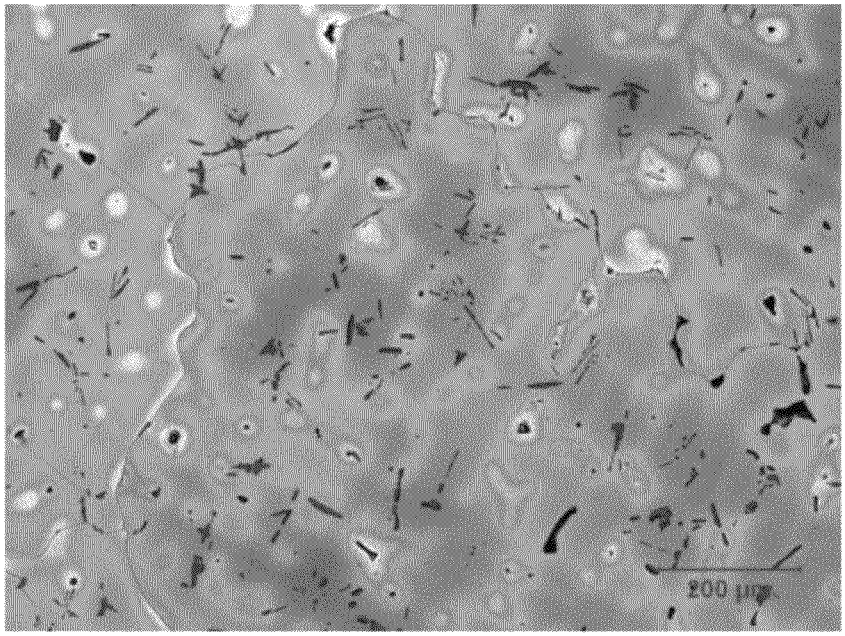
FIG. 10D is a micrograph of alloy C84010 etched with ammonium hydroxide and peroxide at 100×.

FIG. 10A is an micrograph of alloy C84010-120611-H7P1-8 as polished at 50× original magnification. FIG. 10B is an micrograph of alloy C84010-120611-H7P1-8 as polished at 100× original magnification. FIG. 10C is a micrograph of alloy C84010 etched with ammonium hydroxide and peroxide at 50×. FIG. 10D is a micrograph of alloy C84010 etched with ammonium hydroxide and peroxide at 100×. The dark materials illustrate sulfur distribution within the alloy. As can be seen, the sulfur distribution is copper sulfides and zinc sulfides are present in dendritic and interdendritic areas.

FIG. 11A is an micrograph of alloy C84020-012112-H6-P2-7-Ti—C as polished at 50× original magnification. FIG. 11B is an micrograph of alloy C84020-012112-H6-P2-7-Ti—C as polished at 100× original magnification. FIG. 11C is a micrograph of alloy C84020-012112-H6-P2-7-Ti—C etched by ammonium hydroxide and peroxide at 50×. FIG. 11D is a micrograph of alloy C84020-012112-H6-P2-7-Ti—C etched by ammonium hydroxide and peroxide at 100×. These again show the presence of copper and zinc sulfides in the dendritic and interdendritic areas.

Figure 14A:
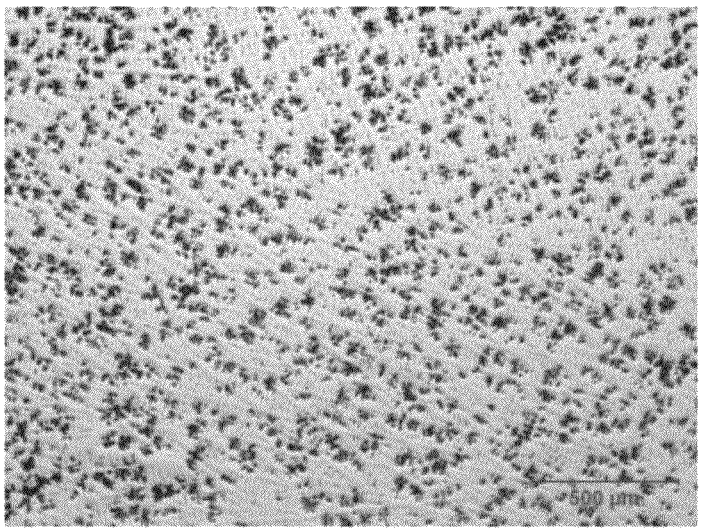
FIG. 14A: is a micrograph of alloy C90410-121911-H5P3-8 as polished at 50× original magnification.
Figure 14B:
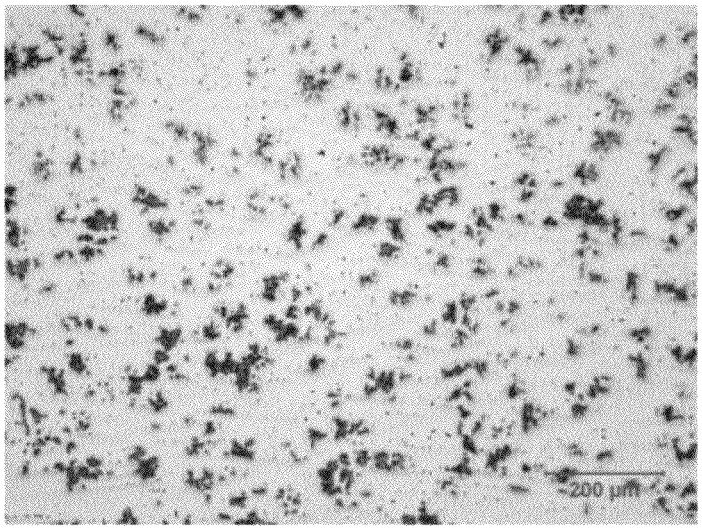
FIG. 14B is an micrograph of alloy C90410-121911-H5P3-8 as polished at 100× original magnification.
Figure 14C:
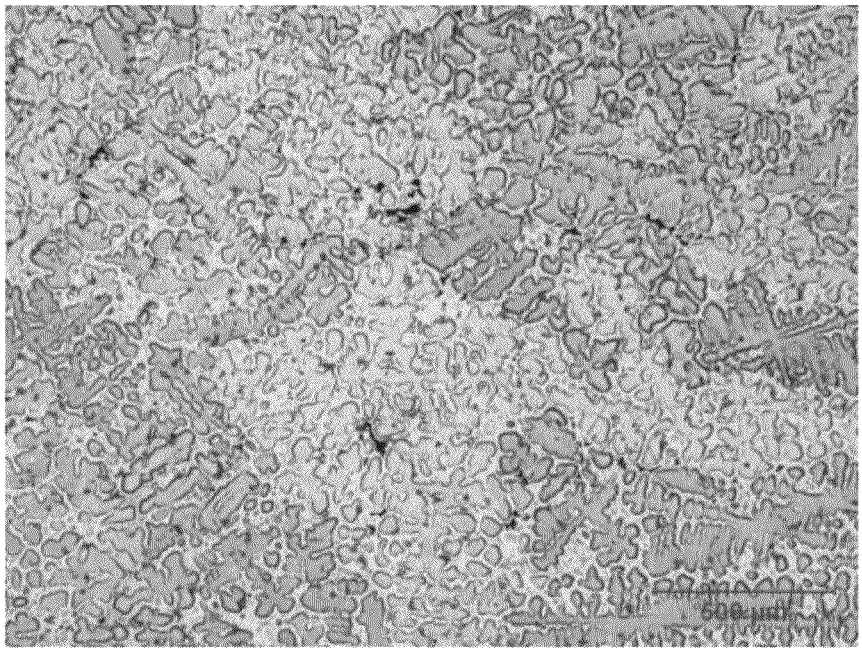
FIG. 14C is a micrograph of alloy C90410 etched with ammonium hydroxide and peroxide at 50×.
Figure 14D:
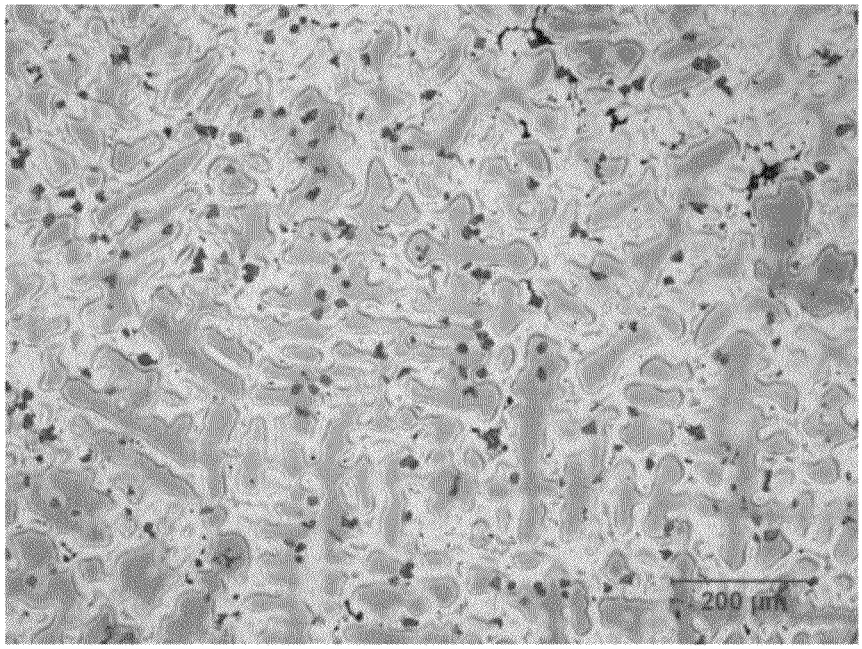
FIG. 14D is a micrograph of alloy C90410 etched with ammonium hydroxide and peroxide at 100×.

FIG. 12A is a SEM image of C84010-111711-H4P4-12. FIG. 12B illustrates elemental mapping of silicon in the portion shown in FIG. 12A. FIG. 12C illustrates elemental mapping of iron in the portion shown in FIG. 12A. FIG. 12D illustrates elemental mapping of nickel in the portion shown in FIG. 12A. FIG. 12E illustrates elemental mapping of copper in the portion shown in FIG. 12A. FIG. 12F illustrates elemental mapping of zinc in the portion shown in FIG. 12A. FIG. 12G illustrates elemental mapping of tin in the portion shown in FIG. 12A. FIG. 12H illustrates elemental mapping of sulfur in the portion shown in FIG. 12A. FIG. 12I illustrates elemental mapping of antimony in the portion shown in FIG. 12A. These show the presence of sulfides of copper and zinc in the interdendritic areas FIG. 13A is a SEM image of C84020-012112-H6-P2-7-Ti—C. FIG. 13B illustrates elemental mapping of silicon in the portion shown in FIG. 13A. FIG. 13C illustrates elemental mapping of sulfur in the portion shown in FIG. 13A. FIG. 13D illustrates elemental mapping of manganese in the portion shown in FIG. 13A. FIG. 13E illustrates elemental mapping of iron in the portion shown in FIG. 13A. FIG. 13F illustrates elemental mapping of nickel in the portion shown in FIG. 13A. FIG. 13G illustrates elemental mapping of copper in the portion shown in FIG. 13A. FIG. 13H illustrates elemental mapping of zinc in the portion shown in FIG. 13A. FIG. 13I illustrates elemental mapping of tin in the portion shown in FIG. 13A. FIG. 13J illustrates elemental mapping of lead in the portion shown in FIG. 13A. These show that in addition to the presence of copper and zinc sulfides, some manganese sulfides are also present FIG. 14A: is a micrograph of alloy C90410-121911-H5P3-8 as polished at 50× original magnification. FIG. 14B is an micrograph of alloy C90410-121911-H5P3-8 as polished at 100× original magnification. FIG. 14C is a micrograph of alloy C90410 etched with ammonium hydroxide and peroxide at 50×. FIG. 14D is a micrograph of alloy C90410 etched with ammonium hydroxide and peroxide at 100×. Here also sulfur is present as sulfides of copper and zinc in the dendritic and interdendritic areas FIG. 15A is an micrograph of alloy C90420-022712-H10-P1-8-B—C as polished at 50× original magnification. FIG. 15B is an micrograph of alloy C90420-022712-H10-P1-8-B—C as polished at 100× original magnification. FIG. 15C is a micrograph of alloy C90420-022712-H10-P1-8-B—C etched by ammonium hydroxide and peroxide at 50×; FIG. 15D is a micrograph of alloy C90420-022712-H10-P1-8-B—C etched by ammonium hydroxide and peroxide at 100×; Here also sulfur is present as sulfides of copper and zinc in the dendritic and interdendritic areas. But the sulfides are much finer than those in C90410. It is believed that the presence of carbon results in finer sulfide particles.

Figures 16A, 16B, 16C, 16G, 16H, 16I:
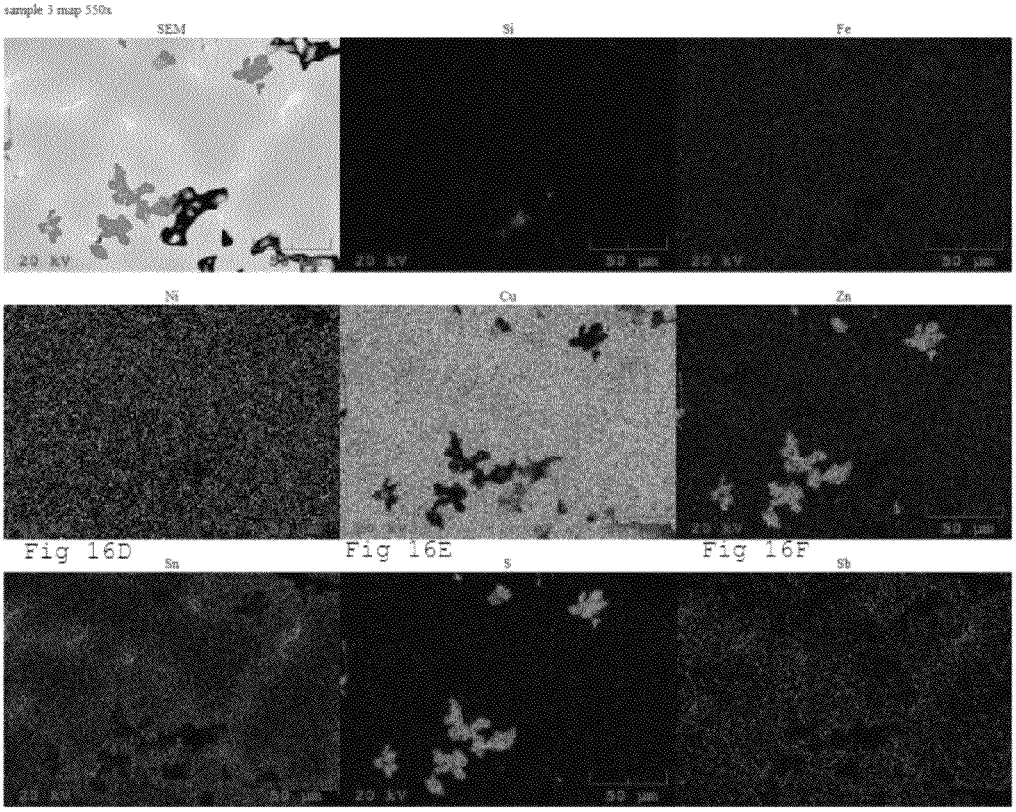
FIG. 16A is a SEM image of C90410-120711-H6P2-12.
FIG. 16B illustrates elemental mapping of silicon in the portion shown in FIG. 16A.
FIG. 16C illustrates elemental mapping of iron in the portion shown in FIG. 16A.
FIG. 16G illustrates elemental mapping of tin in the portion shown in FIG. 16A.
FIG. 16H illustrates elemental mapping of sulfur in the portion shown in FIG. 16A.
FIG. 16I illustrates elemental mapping of antimony in the portion shown in FIG. 16A.

FIG. 16A is a SEM image of C90410-120711-H6P2-12. FIG. 16B illustrates elemental mapping of silicon in the portion shown in FIG. 16A. FIG. 16C illustrates elemental mapping of iron in the portion shown in FIG. 16A. FIG. 16D illustrates elemental mapping of nickel in the portion shown in FIG. 16A. FIG. 16E illustrates elemental mapping of copper in the portion shown in FIG. 16A. FIG. 16F illustrates elemental mapping of zinc in the portion shown in FIG. 16A. FIG. 16G illustrates elemental mapping of tin in the portion shown in FIG. 16A. FIG. 16H illustrates elemental mapping of sulfur in the portion shown in FIG. 16A. FIG. 16I illustrates elemental mapping of antimony in the portion shown in FIG. 16A. Sulfides of copper and zinc are observed in the dendtitic and interdendritic areas, bute are relatively coarser than for C90410, believed due to the lack of carbon.

Figures 17A, 17B, 17C, 17D, 17E, 17F, 17G, 17H, 17I, 17J:
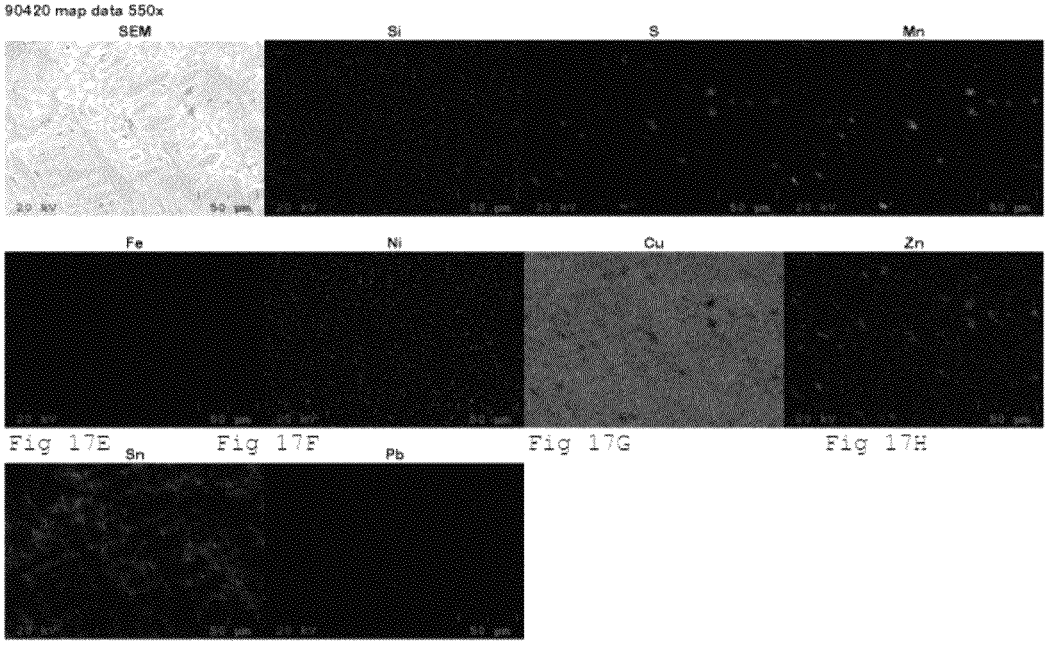
FIG. 17A is a SEM image of 90420-022712-H10-P1-8-B—C.
FIG. 17B illustrates elemental mapping of silicon in the portion shown in FIG. 17A.
FIG. 17C illustrates elemental mapping of sulfur in the portion shown in FIG. 17A.
FIG. 17D illustrates elemental mapping of manganese in the portion shown in FIG. 17A.
FIG. 17E illustrates elemental mapping of iron in the portion shown in FIG. 17A.
FIG. 17F illustrates elemental mapping of nickel in the portion shown in FIG. 17A.
FIG. 17G illustrates elemental mapping of copper in the portion shown in FIG. 17A.
FIG. 17H illustrates elemental mapping of zinc in the portion shown in FIG. 17A.
FIG. 17I illustrates elemental mapping of tin in the portion shown in FIG. 17A.
FIG. 17J illustrates elemental mapping of lead in the portion shown in FIG. 17A.

FIG. 17A is a SEM image of C90420-022712-H10-P1-8-B—C. FIG. 17B illustrates elemental mapping of silicon in the portion shown in FIG. 17A. FIG. 17C illustrates elemental mapping of sulfur in the portion shown in FIG. 17A. FIG. 17D illustrates elemental mapping of manganese in the portion shown in FIG. 17A. FIG. 17E illustrates elemental mapping of iron in the portion shown in FIG. 17A. FIG. 17F illustrates elemental mapping of nickel in the portion shown in FIG. 17A. FIG. 17G illustrates elemental mapping of copper in the portion shown in FIG. 17A. FIG. 17H illustrates elemental mapping of zinc in the portion shown in FIG. 17A. FIG. 17I illustrates elemental mapping of tin in the portion shown in FIG. 17A. FIG. 17J illustrates elemental mapping of lead in the portion shown in FIG. 17A. In addition to the presence of copper and zinc sulfides, some manganese sulfides are also observed in the microstructure.

Figure 18A:
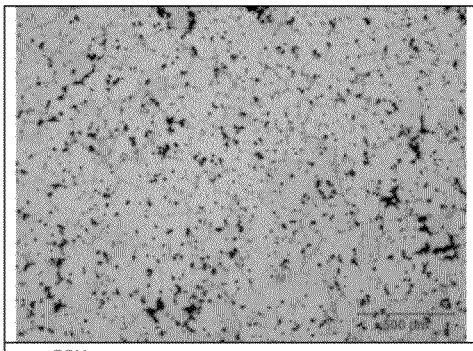
FIGS. 18A (50×) and 18B (100×) illustrate micrographs of polished alloy C90410-120711-H8P3-12.

FIGS. 18A (50×) and 18B (100×) illustrate micrographs of polished alloy C90410-120711-H8P3-12. FIGS. 18C (50×) and 18D (100×) illustrate micrographs of polished alloy C90410-120711-H6P2-12. FIGS. 18E (50×) and 18F (100×) illustrate micrographs of polished alloy C90410-121911-H5P3-11-B. These micrographs show that B is a good grain refiner in tin bronzes.

Figure 19A:
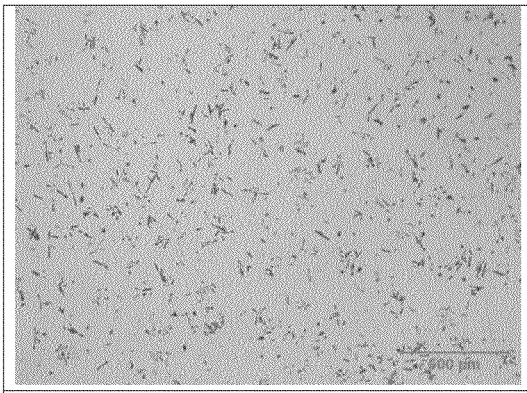
FIGS. 19A (50×) and 19B (100×) illustrate micrographs of polished alloy C84010-120611-H7P1-8.
Figure 19B:
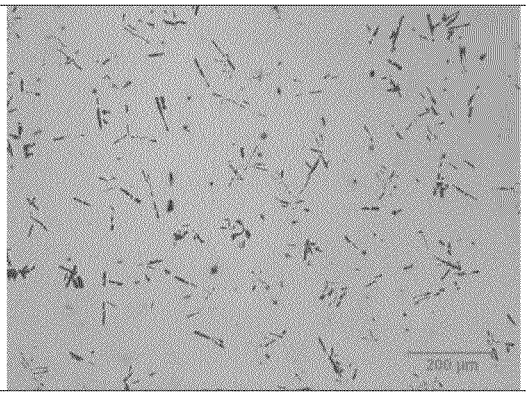
FIGS. 19C (50×) and 19D (100×) illustrate micrographs of etched alloy C84010-120611-H7P1-8.
FIGS. 19E (50×) and 19F (100×) illustrate micrographs of polished alloy C84010-111711-H4P4-12.
FIGS. 19G (50×) and 19H (100×) illustrate micrographs of polished alloy 84010-111711-H10P5-12.
Figure 19C:
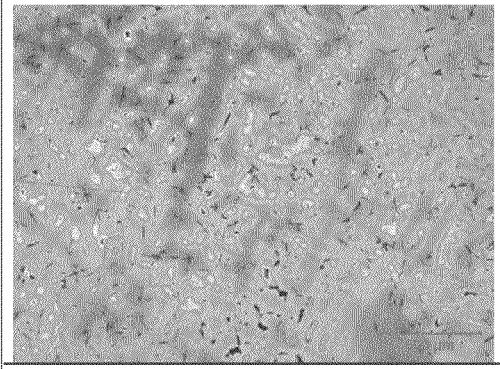
Figure 19D:
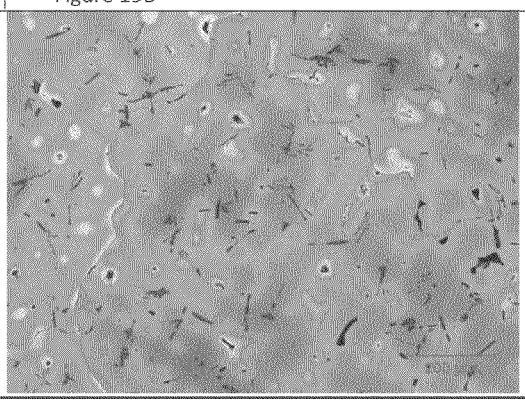
Figure 19E:
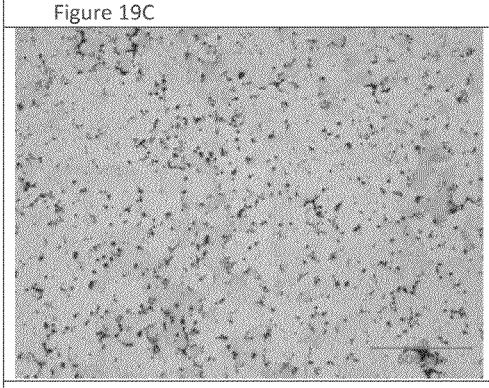
Figure 19F:
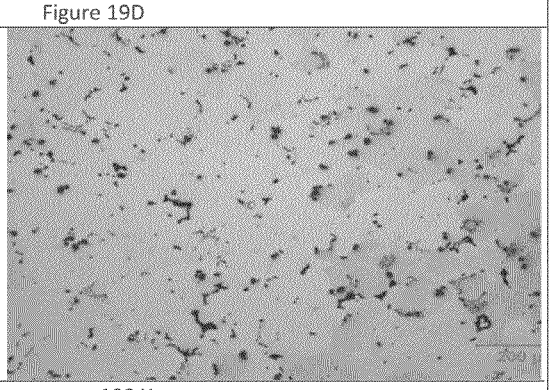
Figure 19G:
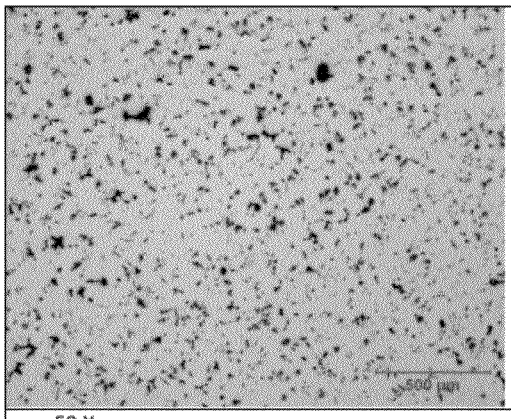

FIGS. 19A (50×) and 19B (100×) illustrate micrographs of polished alloy C84010-120611-H7P1-8. FIGS. 19C (50×) and 19D (100×) illustrate micrographs of etched alloy C84010-120611-H7P1-8. FIGS. 19E (50×) and 19F (100×) illustrate micrographs of polished alloy C84010-111711-H4P4-12. FIGS. 19G (50×) and 19H (100×) illustrate micrographs of polished alloy 84010-111711-H10P5-12. Both Zr and B appear to be effective in producing grain refinement in semi-red brasses.

Phase Analysis

Phase information was gathered for the alloys in Table 3. Although these alloys do not include the carbon of the corresponding alloys I-C and II-C, it is believed the low levels of carbon obtained in alloys I-C and II-C do not alter the phase analysis for these carbon containing alloys. Alloy C83470 is a known alloy whose full composition is listed in FIG. 1. For comparison, nominal composition of commercially available alloy—C83470 (Biwalite™) is also included in Table 3.

TABLE 3

Alloy Compositions for Phase Analysis

| Alloy Type | Cu | S | Sn | Zn | Mn |
|---|---|---|---|---|---|
| Alloy I-A-11a | 88.9 | 0.6 | 3 | 7.5 | — |
| Alloy I-A-11b | 88.1 | 0.6 | 2.9 | 8.5 | — |

TABLE 3-continued

Alloy Compositions for Phase Analysis

| Alloy Type | Cu | S | Sn | Zn | Mn |
|---|---|---|---|---|---|
| Alloy I-A-11c * | 91.2 | 0.6 | 3.2 | 5 | — |
| Alloy I-A-11d | 85.4 | 0.6 | 3 | 11 | — |
| Alloy I-A-11e | 81.4 | 0.6 | 3 | 14 | — |
| Alloy I-A Nominal | 86 | 0.4 | 3 | 9 | — |
| Biwalite ™(C83470) | 93.96 | 0.6 | 2.5 | 3 | — |
| Alloy I-B-11a | 86 | 0.4 | 3 | 9 | 0.5 |
| Alloy II-A-11a | 87 | 0.4 | 8 | 3 | — |

* Alloy I-A-11c exceeds the allowable copper, but is included for comparative purposes In order to understand the strengthening mechanisms in these alloys, phase diagrams of the Cu—Zn—Sn—S systems with and without Mn were determined using both equilibrium and non-equilibrium cooling (Scheil cooling) conditions. It should be noted that sand casting generally corresponds to non-equilibrium cooling. The phases present in these alloys have been studied using the vertical sections of the multicomponent systems.

Analysis done using conventional techniques was performed to determine the relative amount of the phases present at room temperature in the alloys of Table 4. In a first phase study, the five specific formulations of Alloy Group I-A were tested to observe the variance in phases within an Alloy Group. A known commercial alloy, C83470, was also studied as a reference. Table 4 lists as a percentage, the phases for each alloy. The C83470 exhibits less of the Beta phase than the alloys of present invention.

As carbon is not present in sufficient quantities to impact the phases observed in the alloy, it has been ignored for purposes of the phase analysis. As can be seen in FIG. 20, the sulfur in the alloy will react with zinc and manganese to form their respective sulfides. Due to the relatively low amount of manganese (or no manganese in some embodiments), the predominate sulfide formed is zinc sulfide. The melting point of zinc sulfide is 1185 C and for copper sulfide, it is 1130 C. The three alloys groups in the C84000-C84020(I-A, I-B, and I-C) melt at 1029 to 1056 C. For the three groups of alloys in the C90400-C90420, melting point is 987 to 1018 C. Hence, during solidification, ZnS forms first followed by copper sulfide. It is believed that once copper starts solidifying, these sulfides get trapped between the dendrites.

TABLE 4

Relative amount of the phases present at room temperature

| | Equilibrium | | | Scheil Cooling | | | | | | | |
|---|---|---|---|---|---|---|---|---|---|---|---|
| | | | | | | | | β | β' | | |
| Alloy | FCC | $Cu_3Sn$ | ZnS | FCC | $Cu_3Sn$ | MnS | $Cu_2S$ | (BCC1) | (BCC2) | MnS | γ |
| Alloy I-A-12a | 90.8 | 7.3 | 1.8 | 87.5 | 1.1 | 0 | 2.8 | 5.4 | 2.5 | 0 | 0.6 |
| Alloy I-A-12b | 91.3 | 7.1 | 1.6 | 87.8 | 1.3 | 0 | 2.3 | 7.8 | 0.2 | 0 | 0.5 |
| Alloy I-A-12c | 90.9 | 7.3 | 1.9 | 87.5 | 0.7 | 0 | 2.8 | 4.3 | 3.9 | 0 | 0.8 |
| Alloy I-A-12d | 90.6 | 7.6 | 1.9 | 86.0 | 1.9 | 0 | 2.6 | 7.7 | 1.5 | 0 | 0.15 |
| Alloy I-A-12e | 90.5 | 7.5 | 2 | 85 | 2.3 | 0 | 2.6 | 9 | 1.1 | 0 | |
| C83470 | 93.5 | 4.7 | 1.9 | 91.5 | 0.4 | 0 | 2.9 | 3.4 | 1.1 | 0 | 0.8 |
| Biwalite ™ | | | | | | | | | | | |
| Alloy I-A 12f | 90.6 | 6.8 | 0.9 | 85.5 | 1.6 | 0 | 1.8 | 8.4 | 0.5 | 0 | 0.50 |
| Alloy I-B-12a | 90.8 | 6.7 | 0.5 | 86.6 | 1.7 | 0.6 | 1.0 | 7.5 | 1.3 | 0.5 | 0.4 |
| Alloy II-A-12a | 79.7 | 17.4 | 1.2 | 74.2 | 1.6 | 0 | 1.9 | 16.1 | 0.1 | 0 | 3.6 |

Figure 21:
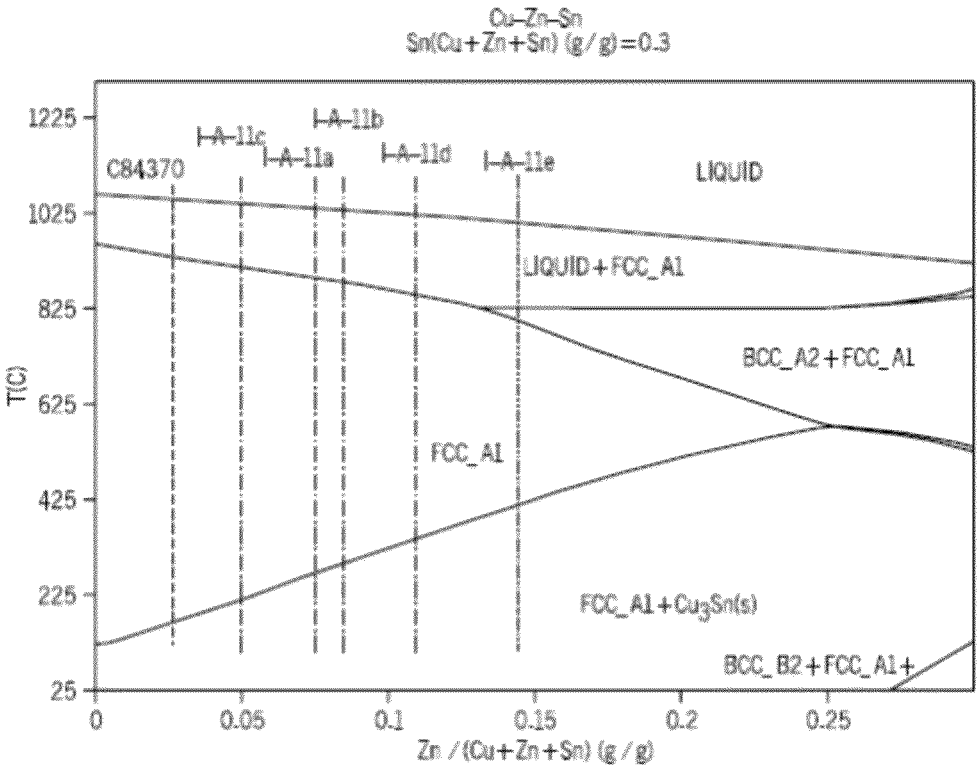
FIG. 21 is a vertical section of different alloys in the Cu—Sn—Zn—S alloys.
Figure 23:
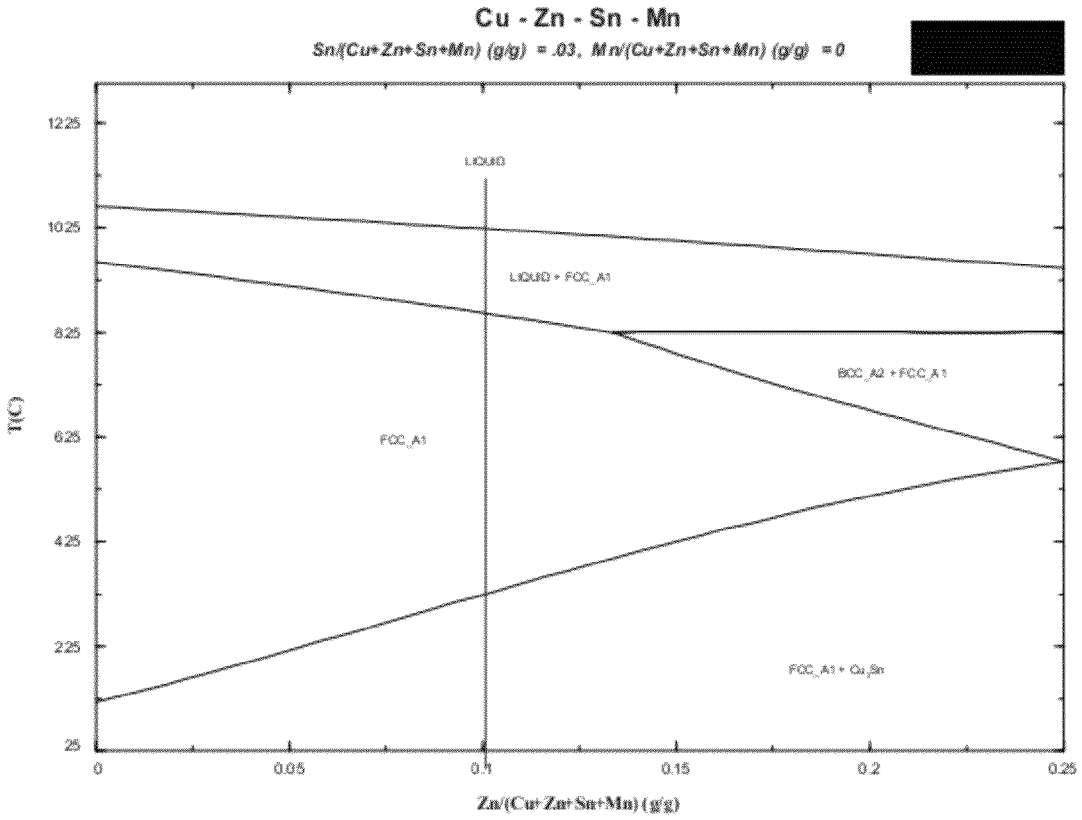
FIG. 23 is phase diagram of Vertical Section of Group I-A.
Figure 24A:
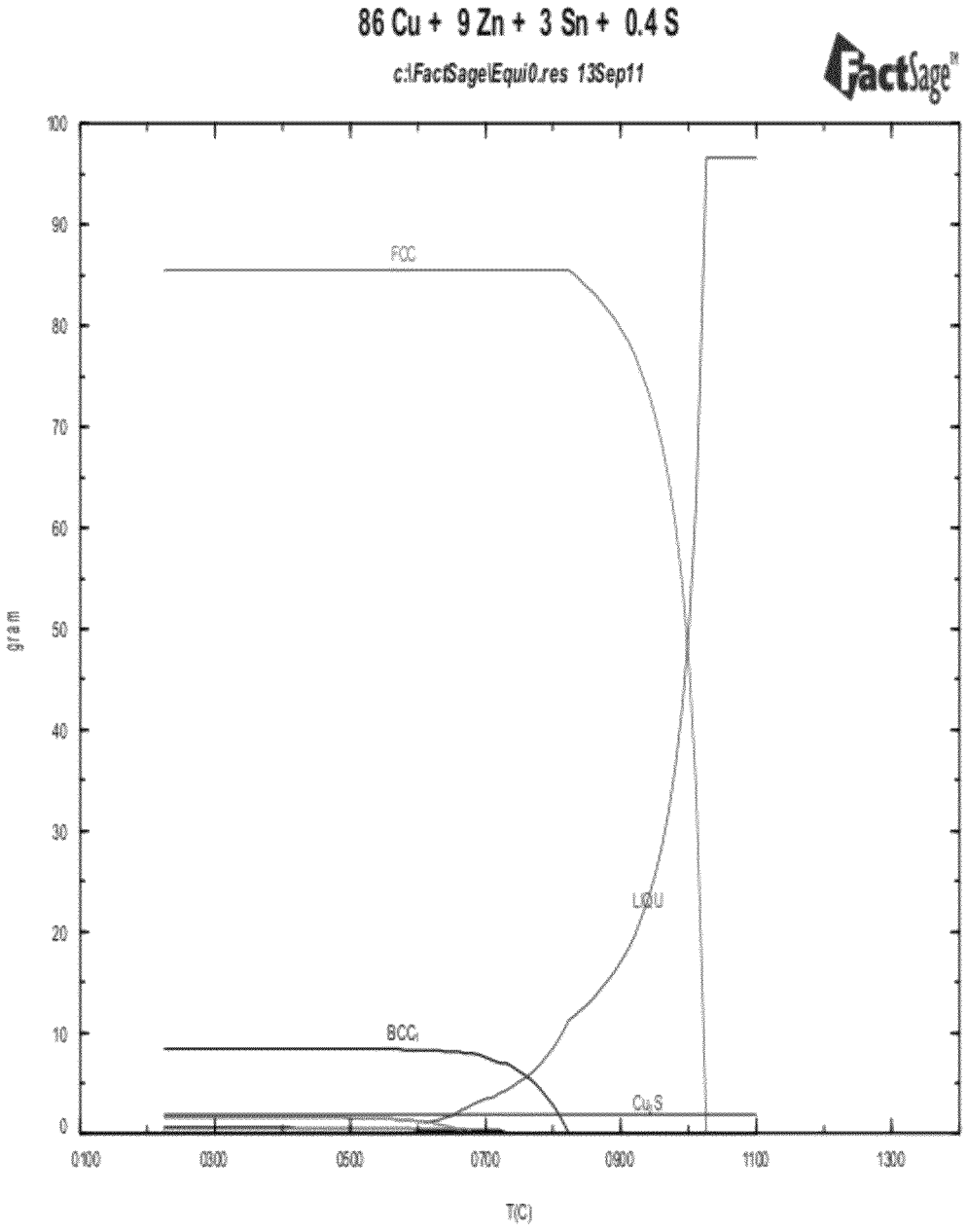
FIG. 24A is a Scheil Phase assemblage diagram of Group I-A.
Figure 24B:
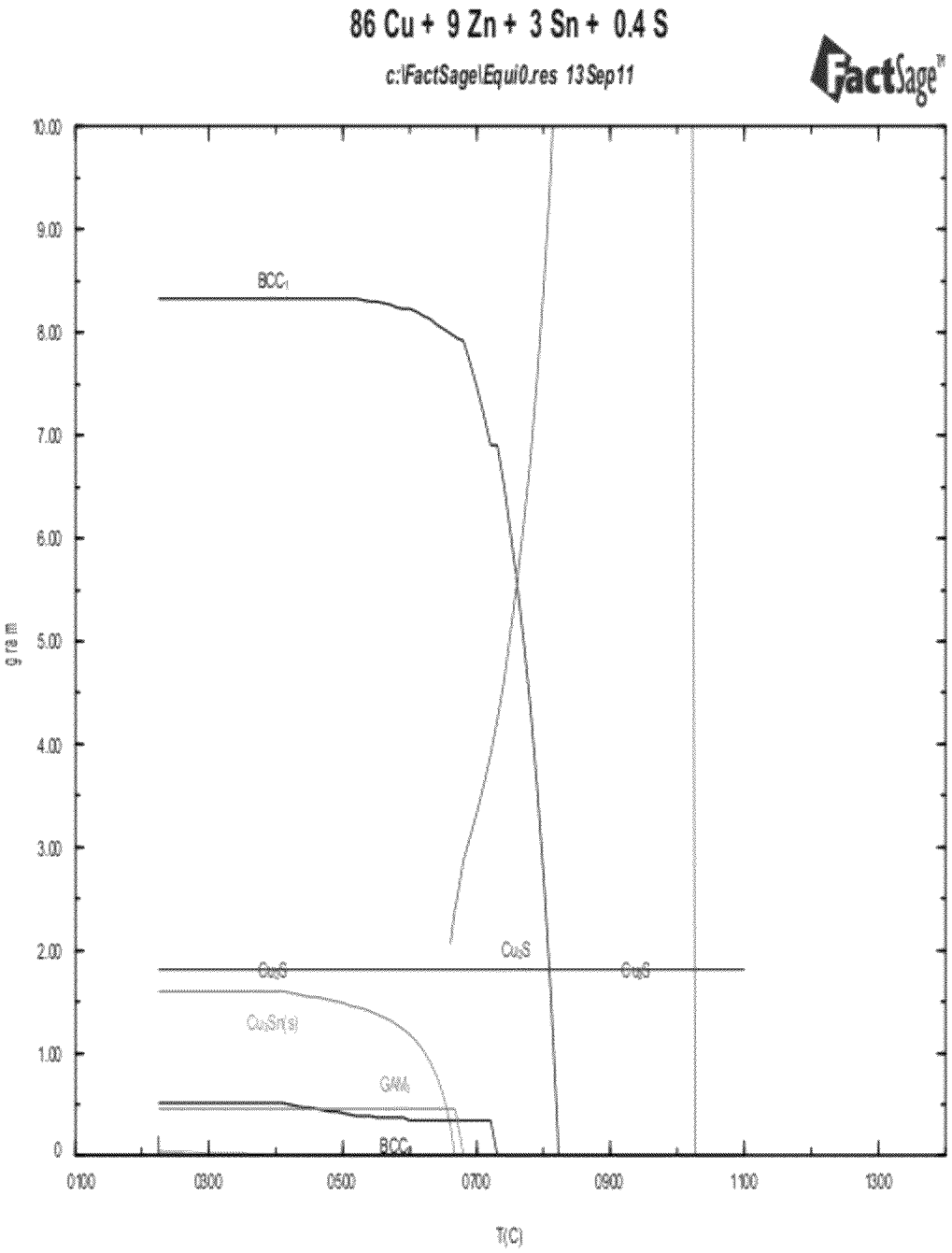
FIG. 24B is a magnified Scheil Phase assemblage diagram of Group I-A
Figure 25:
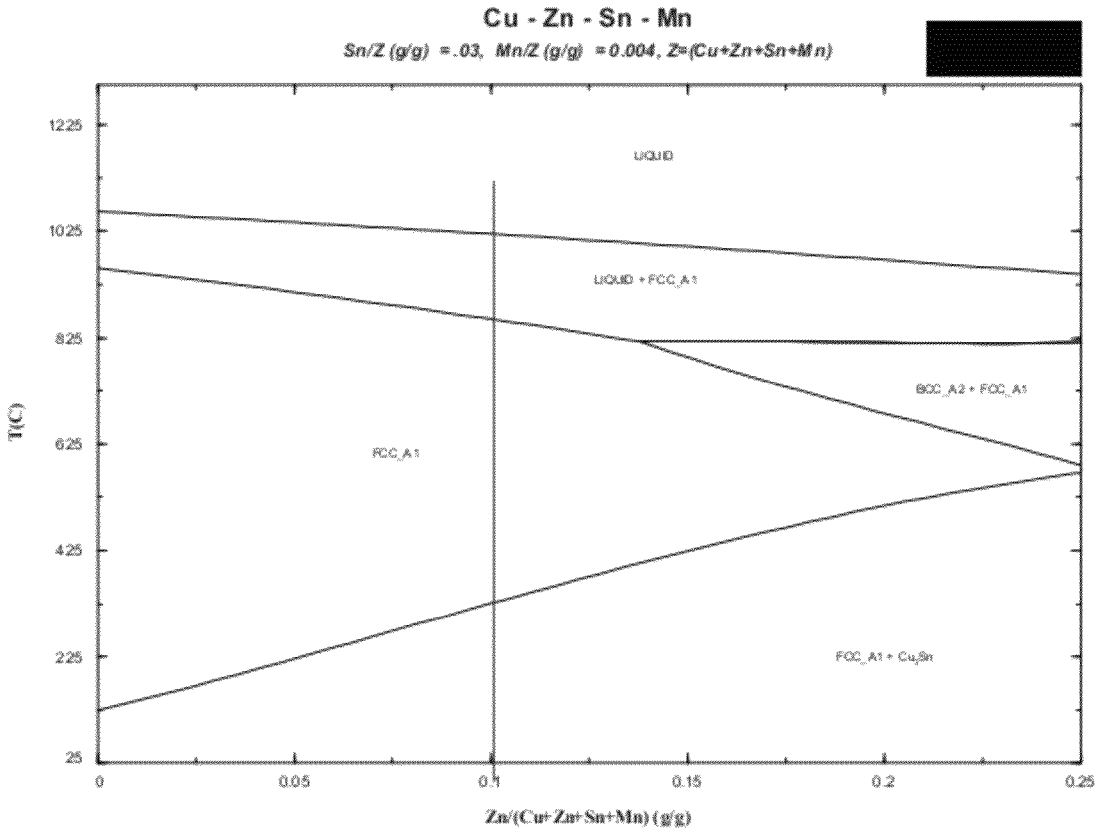
FIG. 25 is a vertical Section of Group I-B.
Figure 26A:
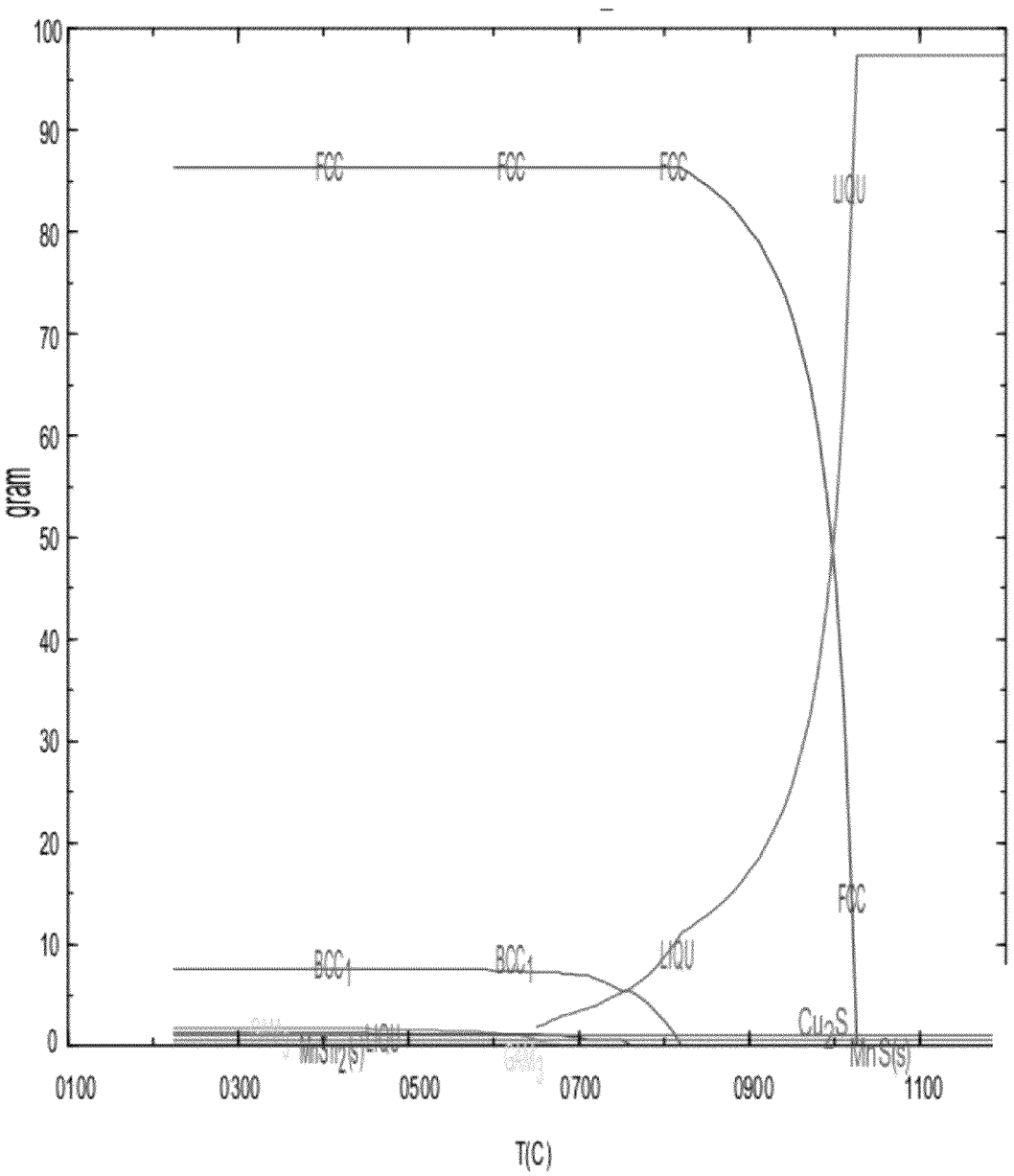
FIG. 26A is a Scheil Phase assemblage diagram of Group I-B
Figure 26B:
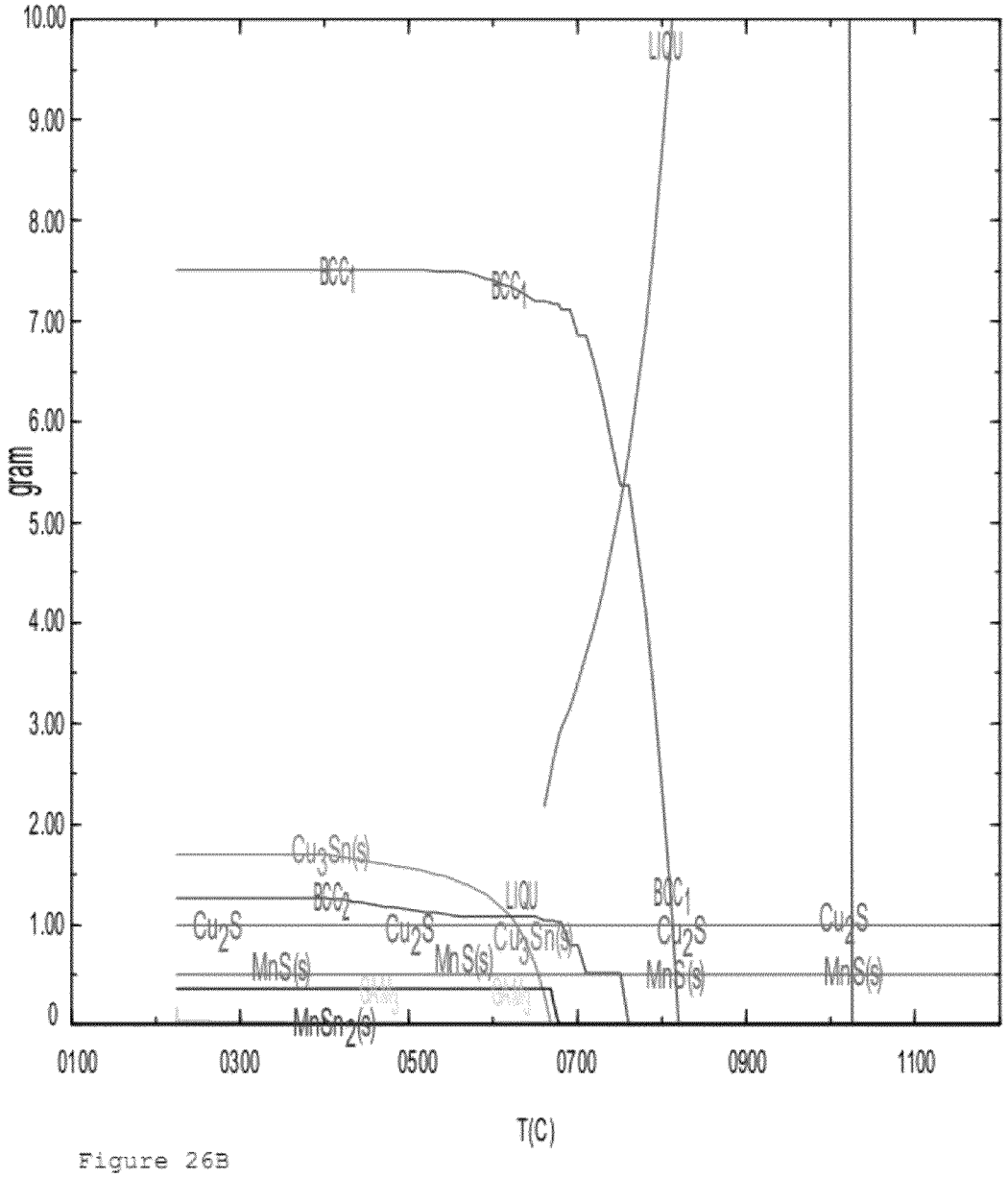
FIG. 26B is a magnified Scheil Phase assemblage diagram of Group I-B.
Figure 27:
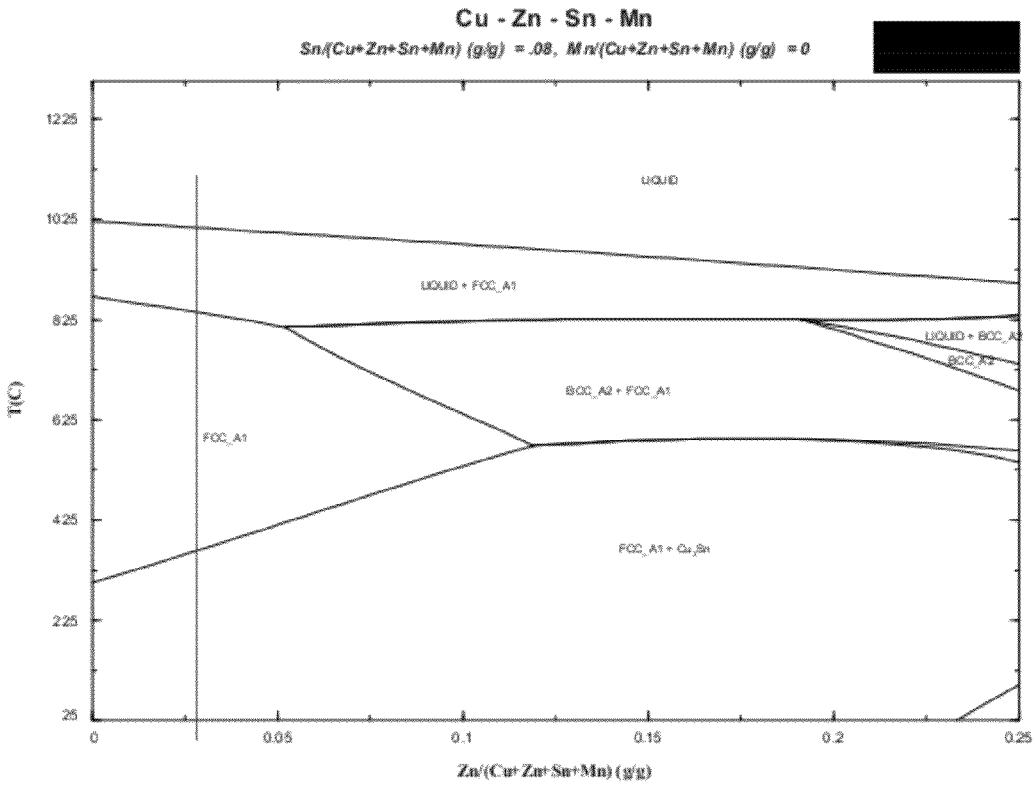
FIG. 27 is a vertical Section of Group II-A.
Figure 28A:
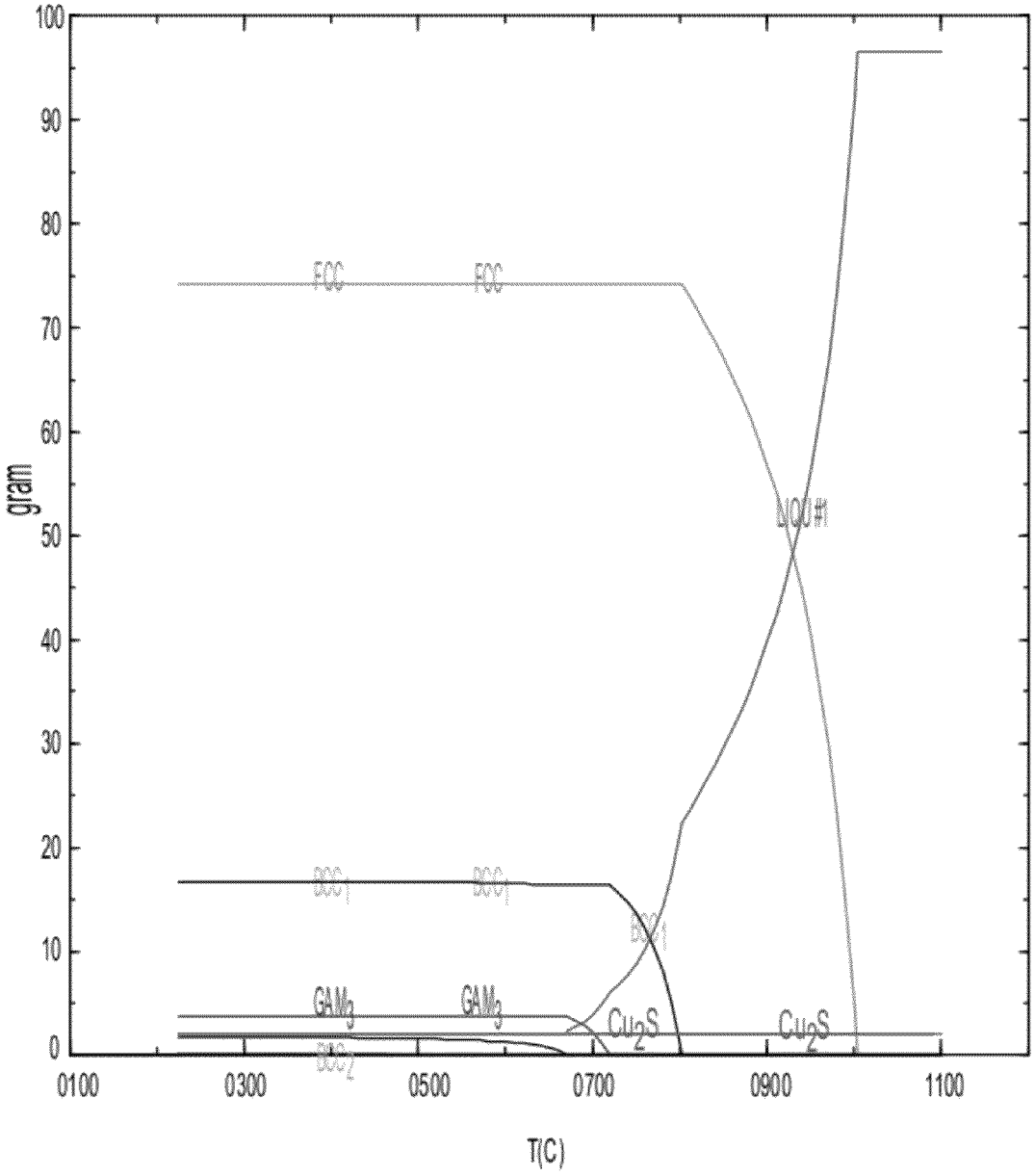
FIG. 28A is a Scheil Phase assemblage diagram of Group II-A.
Figure 28B:
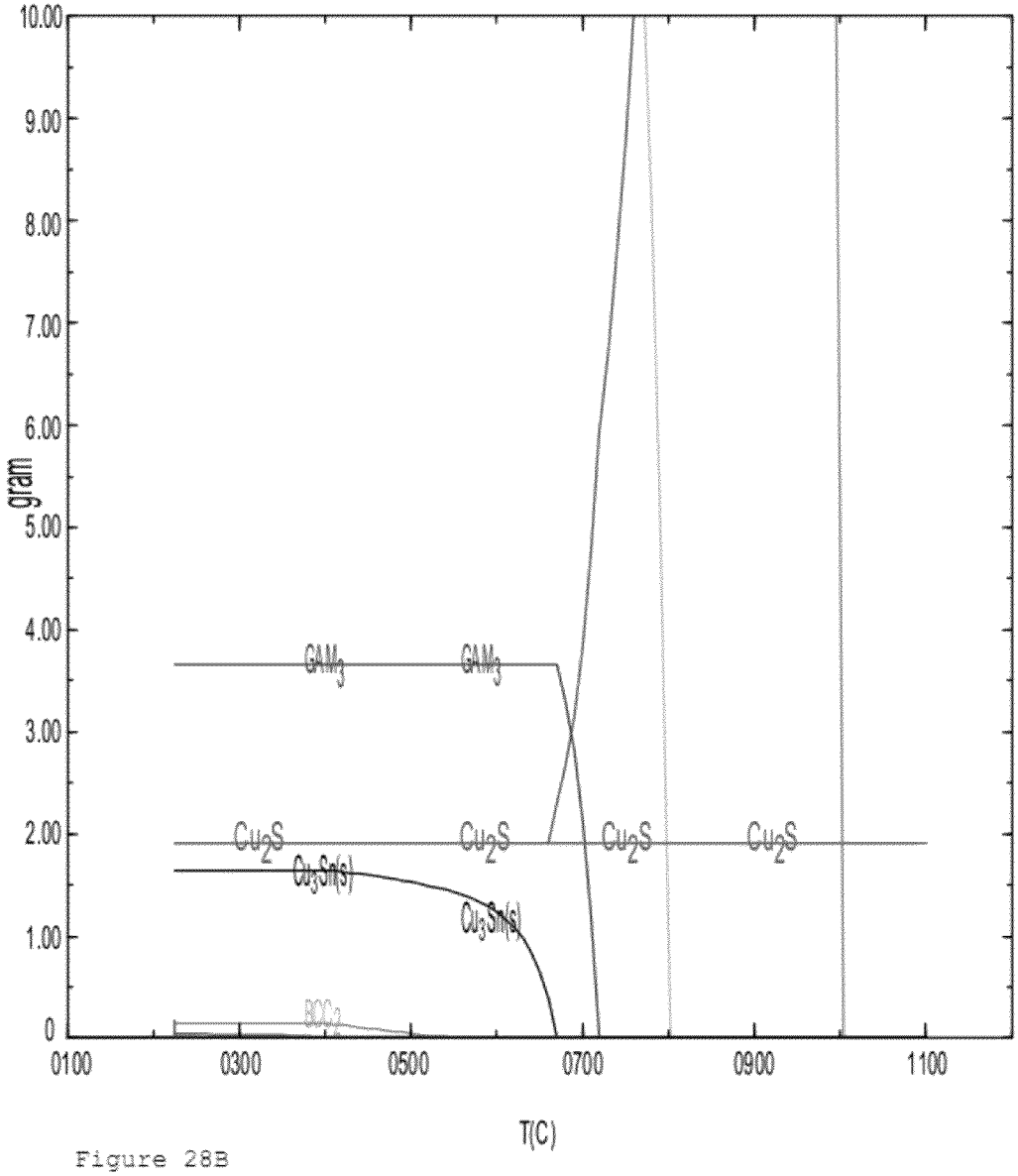
FIG. 28B is a magnified Scheil Phase assemblage diagram of Group II-A.

FIG. 21 plots the position of the alloys in Table 3 on a copper/zinc/tin phase diagram. The alloys proceed from the highest percentage of copper and zinc on the left to the lowest copper and zinc on the right. A phase distribution diagram of I-A-11a, I-A-11b, I-A-11c, I-A-11d, I-A-11e, using Scheil cooling is shown. The relative amounts of the melt having FCC, Liquid, $BCC_1$, $BCC_2$, $Cu_2S$, and $Cu_3Sn$ in relation to temperature is shown in Figures. FIG. 23 is phase diagram of Vertical Section of Group I-A. FIG. 24A is a Scheil Phase assemblage diagram of Group I-A, FIG. 24B is a magnified Scheil Phase assemblage diagram of Group I-A, FIG. 25 is a vertical Section of Group I-B. FIG. 26A is a Scheil Phase assemblage diagram of Group, I-B FIG. 26B is a magnified Scheil assemblage diagram of Group I-B. FIG. 27 is a vertical Section of Group II-A. FIG. 28A is a Scheil Phase assemblage diagram of Group II-A, FIG. 28B is a magnified Scheil Phase assemblage diagram of Group II-A.

FIGS. 22A-22B illustrates a similar series of phase distributions as FIGS. 24-28 but for an existing commercial alloy, C83470. FIG. 22A is a phase distribution diagram of C83470 alloy using Scheil cooling. FIG. 22B is a magnified part of the phase distribution diagram showing the relative amounts of secondary phases.

The phase distribution diagrams show the phase that can be expected and the temperature at which they start appearing. The relative amount of each phase can also be estimated from these diagrams. Table 4 is based on these diagrams which shows that for non-equilibrium cooling, it is the 0 (BCCI) phase (which is an intermetallic compound of Cu and Zn) that contributes to the strength of the alloys. However, strength increases at the expense of ductility. The alloys of the present invention show high strength and ductility. Their high ductility may be due to the good melt quality, low gas content and good homogeneity. The finer distribution of sulfides also contribute to high strength and high ductility in addition to contributing to pressure tightness and machinability. In one embodiment, a higher cooling rate provides finer distribution of sulfides. By way of comparison, Biwalite had 0.59% S compared with 0.1 to 0.3% S in certain embodiments in accordance with the teachings herein. The sulfide distribution indicates that there is s agglomeration in Biwalite due to high S content. It should be appreciated that a finer distribution of sulfides provides for superior mechanical properties while providing for more even and superior machinability.

Liquidus Study

TABLE 5

Liquidus and solidus temperatures

| Alloy Type | Liquidus Temperature ° C. (° F.) | Solidus Temperature ° C. (° F.) | Freezing Range ° C. (° F.) |
|---|---|---|---|
| Alloy I-A-11c | 1043 (1910) | 936 (1717) | 107 (193) |
| Alloy I-A-11a | 1041 (1906) | 942 (1728) | 99 (178) |
| Alloy I-A-11b | 1036 (1897) | 947 (1737) | 89 (160) |
| Alloy I-A-11d | 1029 (1884) | 948 (1738) | 81 (146) |
| Alloy I-B-11a | 1035 (1895) | 939 (1722) | 96 (173) |
| C84020-121311-H1P1-8(Alloy I-C) | 1056 (1933) | 936 (1717) | 120 (216) |
| C84400, Leaded Alloy, | 1004 (1840) | 843 (1549) | 161 (291) |
| Biwalite ™, C83470 | 1013 (1855) | 951 (1744) | 62 (111) |
| Biwalite ™, C83470 (Reported) | 1027, (1881) | 982 (1800) | 45 (81) |
| C90400 (Alloy II-A) | 987 (1810) | 852 (1566) | 135 (244) |
| C90410-120711-H2P3-8 (Alloy II-B) | 1018 (1864) | 849 (1560) | 169 (304) |
| C90420-022912-H1P4-14 (II-C) | 1017 (1863) | 836 (1537) | 181 (326) |
| C90300, Leaded Alloy, | 1000 (1832) | 854 (1570) | 146 (262) |

Procedure

Thermal investigation of the systems was performed using a DSC-2400 Setaram Setsys Differential Scanning calorimetry. Temperature calibration of the DSC was done using 7 pure metals: In, Sn, Pb, Zn, Al, Ag, and Au spanning the temperature range from 156 to 1065° C. The samples were cut and mechanically polished to remove any possible contaminated surface layers. Afterwards, they were cleaned with ethanol and placed in a graphite crucible with a lid cover to limit possible evaporation and protect the apparatus. To avoid oxidation, the analysis chamber was evacuated to $10^{-2}$ mbar and then flooded with argon. The DSC measurements were carried out under flowing argon atmosphere. Three replicas of each sample were tested. The weight of the sample was 62~78 mg.

The sample was heated from room temperature to 1080° C. Then it was cooled to 800° C. and kept at that temperature for 10 minutes. This is termed "first heating and cooling cycle." In the second and third cycles the sample was heated to 1080° C. and then cooled to 800° C. twice. Finally the sample was cooled down to room temperature. A constant rate of 5° C./min was used for all heating and cooling. A baseline experiment, with two empty graphite crucibles was run using the same experimental program. The baseline was subtracted for all runs. The analysis for temperatures and enthalpies was carried on these baseline adjusted thermograms.

The results from the second and third cycles were used to determine the relevant thermal parameters, namely the $T_{start}$ of melting, the $T_{onset}$ of solidification, and $T_{peak}$ of melting and solidification, as well as, the enthalpy, E, of melting and of solidification. Usually, $T_{start}$ (heating) and $T_{peak}$ (cooling) were taken as the $T_S$ (solidus) and $T_L$ (liquidus).

The results of the liquidus study (Table 5) indicate that the introduction of sulphides appear to reduce the liquidus temperatures and the freezing ranges in comparison with the leaded alloys. In the I-A group of alloys, as the Zn content increases, liquidus temperature and the freezing range decrease.

With respect to freezing ranges, Biwalite™ (C83470), has a medium freezing range. The alloys of Table 5 have a broad freezing range. In contrast, with Biwalite™ (C83470), one can expect a deep pipe in the riser which can extend to the casting to produce shrinkage porosity. With broad freezing range alloys, porosity can be distributed well in the casting. In addition, it can be minimized/eliminated by using proper risering design and/or by using metal chills. In a way, the alloys I-A, I-B, I-C and II-A, II-B, II-C of Table 5 can be less susceptible to shrinkage porosity with good feeding systems. This would lead to better strength and elongation values as observed.

Sulfide Particle Size

A particle size study was performed using the alloy compositions of Table 6. With the exception of C90300 where lead particle size is measured, the particle size observed was that of sulfides. Table 7 lists the respective particle sizes as minimum, maximum and average. As can be seen, the carbon containing alloys I-C and II-C include a minimum particle size larger than that of most of the other tested alloys and approaching the lead particle size. Further, the small average particle size is approaching that of the lead particle size.

TABLE 6

| Alloys for Particle Size Study | | | | | | | |
|---|---|---|---|---|---|---|---|
| Element | Alloy I-A-14a | Alloy I-A-14b | Alloy I-A-14a | BiWalite ™ C83470 | C90300 | Alloy I-C | Alloy II-C |
| Cu | 88.26 | 90.46 | 87.46 | 91.82 | 87.58 | 83.2 | 86.03 |
| Ag | <0.01 | <0.01 | 0.03 | <0.01 | 0.02 | — | |
| Bi | 0.01 | 0.01 | 0.07 | 0.01 | 0.02 | | |
| Fe | 0.16 | 0.05 | 0.16 | 0.26 | 0.09 | 0.272 | 0.179 |
| Mn | <0.01 | 0.01 | 0.01 | <0.01 | <0.01 | 0.068 | |
| Ni | 0.88 | 1.13 | 0.89 | 0.69 | 0.07 | 1.54 | 0.686 |
| P | 0.012 | 0.006 | 0.015 | 0.012 | 0.023 | 0.013 | 0.012 |
| Pb | 0.02 | 0.12 | 0.01 | 0.02 | 0.11 | 0.057 | 0.007 |
| S | 0.11 | 0.13 | 0.19 | .59 | 0.012 | 0.278 | 0.155 |
| Sb | <0.01 | <0.01 | <0.01 | <0.01 | 0.01 | 0.004 | 0.003 |
| Sn | 3.23 | 3.63 | 8.18 | 4.02 | 8.22 | 2.88 | 7.98 |
| Zn | 7.32 | 4.45 | 2.99 | 2.58 | 3.84 | 11.67 | 4.84 |

TABLE 7

| Particle Sizes | | | |
|---|---|---|---|
| Alloy | Minimum (μm) | Maximum (μm) | Average (μm) |
| Alloy I-A-14a | 0.1 | 9 | 2 |
| Alloy I-A-14b | 0.1 | 7 | 2 |
| Alloy I-A-14a | 0.1 | 14 | 2 |
| BiWalite ™ C83470 | 0.1 | 14 | 3 |
| C90300 | 0.2 | 5 | 2 |
| Alloy I-B-10a | 0.1 | 5 | 1 |
| Alloy III-A | 0.1 | 5 | 1 |
| Alloy I-A-10a | 0.2 | 18 | 5 |

TABLE 7-continued

| Particle Sizes | | | |
|---|---|---|---|
| Alloy | Minimum (μm) | Maximum (μm) | Average (μm) |
| Alloy II-A-10a | 0.1 | 53 | 6 |
| Alloy I-C | 0.14 | 13 | 1.6 |
| Alloy II-C | 0.14 | 8.9 | 1.4 |

Figure 18B:
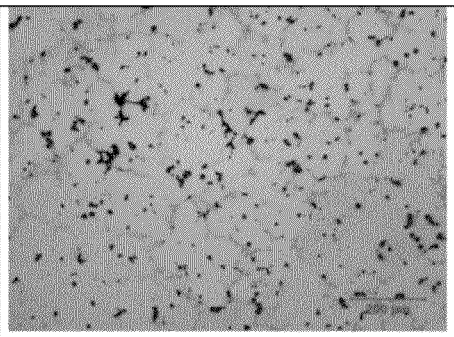
FIGS. 18C (50×) and 18D (100×) illustrate micrographs of polished alloy C90410-120711-H6P2-12—FIGS. 18E (50×) and 18F (100×) illustrate micrographs of polished alloy C90410-121911-H5P3-11-B.
Figure 18C:
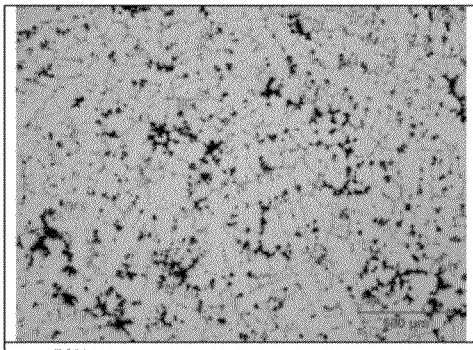
Figure 18D:
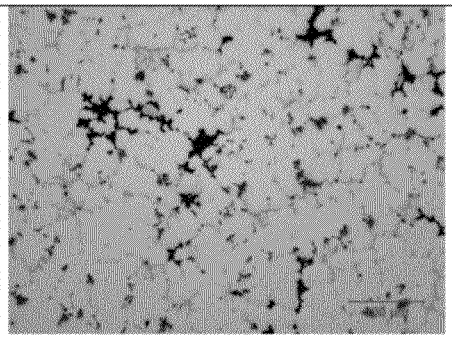
Figure 18E:
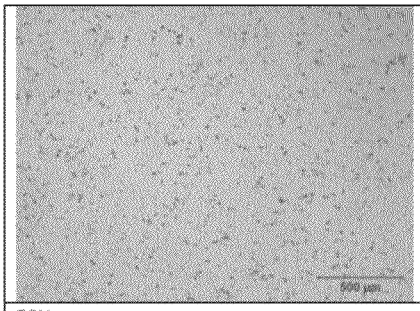
Figure 18F:
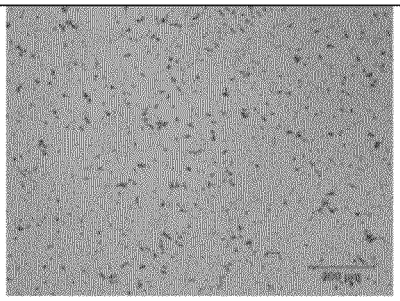

FIG. 18A-F illustrates Grain Size due to Zr or B in the Group II-B alloys (C90410) as listed in Table 8. These microstructures show that B is effective in producing grain refinement even when present in trace amounts. However, it has been observed that Zr addition does not do so. FIGS. 18A and 18B illustrate an alloy with no Zr or B. FIGS. 18C and D are of an alloy with Zr. No improvement to grain refinement is observed. However, the inclusion of B in the alloy of FIGS. 18E-F does illustrate an improvement to grain refinement.

TABLE 8

| Compositions of Alloys for C90410 Zr/B grain study. | | | | | | | | | |
|---|---|---|---|---|---|---|---|---|---|
| Heat No | FIGS. | Cu | Sn | Zn | Ni | S | Mn | Zr | B |
| 90410-120711-H8P3-12 | 18A-B | 87.89 | 7.97 | 2.63 | 0.803 | 0.346 | 0.029 | — | — |
| 90410-120711-H6P2-12 | 18C-D | 87.05 | 7.67 | 3.72 | 0.834 | 0.367 | 0.038 | 0.016 | |
| 90410-121911-H5P3-11-B | 18E-F | 88.56 | 7.77 | 2.17 | 0.864 | 0.340 | 0.038 | — | <0.0003 |

Figure 19H:
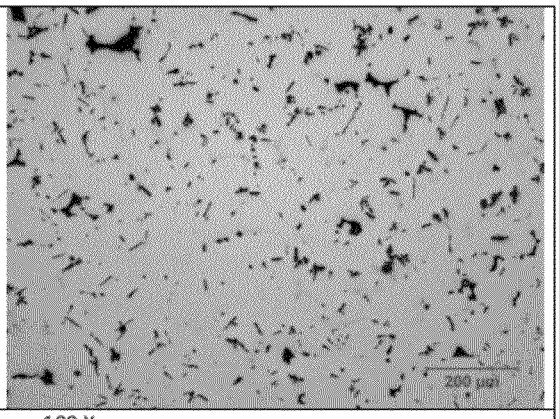

FIGS. 19A (50×) and 19B (100×) illustrate micrographs of polished alloy C84010-120611-H7P1-8; FIGS. 19C (50×) and 17D (100×) illustrate micrographs of etched alloy C84010-120611-H7P1-8; FIGS. 19E (50×) and 19F (100×) illustrate micrographs of polished alloy C84010-111711-H4P4-12; FIGS. 19G (50×) and 19H (100×) illustrate micrographs of polished alloy 84010-111711-H10P5-12. FIG. 19A-F illustrates Grain Size due to Zr or B in the Group II-B alloys (C84010) as listed in Table 9. These microstructures show that B is effective in producing grain refinement even when present in trace amounts. However, it has been observed that Zr addition does not do so. FIGS. 19A-19D illustrate an alloy with no Zr or B. FIGS. 19E and F are of an alloy with Zr. No improvement to grain refinement is observed. However, the inclusion of B in the alloy of FIGS. 19G-H does illustrate an improvement to grain refinement.

TABLE 9

Compositions of Alloys for C84010 Zr/B grain study.

| Heat No | FIGS. | Cu | Sn | Zn | Ni | S | Mn | Zr | B |
|---|---|---|---|---|---|---|---|---|---|
| C84010-120611-H7P1-8 | 19A-D | 82.13 | 2.96 | 13.07 | 1.01 | 0.309 | 0.039 | — | — |
| 84010-111711-H4P4-12 | 19E-F | 86.46 | 3.44 | 8.26 | 1.25 | 0.256 | 0.019 | 0.022 | — |
| 84010-111711-H10P5-12 | 19G-H | 85.5 | 3.07 | 9.75 | 1.06 | 0.351 | 0.024 | — | <0.0003 |

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. An alloy composition consisting essentially of:

a copper content of 83 wt % to 88 wt %;

a tin content of 2.0 wt % to 4.0 wt %;

a lead content of less than 0.09 wt %;

a zinc content of 5.0 wt % to 14.0 wt %;

less than 0.1 wt % iron;

an antimony content of 0.02 wt %;

a nickel content of 1.0 wt % to 2.0 wt %;

a sulfur content of 0.1 wt % to 0.8 wt %;

a phosphorus content of 0.05 wt %;

0.005 wt % aluminum;

0.005 wt % silicon;

a manganese content of 0.1% to 0.7 wt %;

less than 0.2 wt % zirconium;

less than 0.2 wt % boron;

a carbon content of 0.01 wt % to 0.5 wt %; and about 0.5 wt % titanium.

* * * * *